US008925925B2

(12) United States Patent
Hodge

(10) Patent No.: US 8,925,925 B2
(45) Date of Patent: Jan. 6, 2015

(54) TARGET SYSTEM METHODS AND APPARATUS

(76) Inventor: Bruce Hodge, Greenfield, NY (US)

( * ) Notice: Subject to any disclaimer, the term of this patent is extended or adjusted under 35 U.S.C. 154(b) by 507 days.

(21) Appl. No.: 13/042,351

(22) Filed: Mar. 7, 2011

(65) Prior Publication Data

US 2012/0074645 A1 Mar. 29, 2012

Related U.S. Application Data

(60) Provisional application No. 61/310,936, filed on Mar. 5, 2010, provisional application No. 61/356,394, filed on Jun. 18, 2010, provisional application No. 61/442,612, filed on Feb. 14, 2011, provisional application No. 61/444,863, filed on Feb. 21, 2011.

(51) Int. Cl.
*A63B 63/00* (2006.01)
*F41J 7/04* (2006.01)

(52) U.S. Cl.
CPC ..... *F41J 7/04* (2013.01)
USPC ..... 273/359; 273/348; 273/367

(58) Field of Classification Search
USPC ..... 273/359
See application file for complete search history.

(56) References Cited

U.S. PATENT DOCUMENTS 474,109 A 5/1892 Vogel
2,188,292 A * 1/1940 Hall et al. ..... 463/52
2,526,369 A * 10/1950 Kieselhorst ..... 124/23.1
3,034,788 A * 5/1962 Cauble ..... 273/408
3,059,930 A * 10/1962 Ryan ..... 273/386
3,580,579 A 5/1971 Scharz (Continued)

FOREIGN PATENT DOCUMENTS

FR 2765318 A1 12/1998
JP 2008-075970 A 4/2008
KR 20-0383671 Y1 5/2005

OTHER PUBLICATIONS

International Search Report and the Written Opinion of the International Search Authority (PCT/ISA/220, PCT/ISA/237, and PCT/ISA/210) dated Jun. 1, 2012, for corresponding International Application No. PCT/US2012/025118 filed on Feb. 14, 2012.

(Continued)

*Primary Examiner* — Tramar Harper
(74) *Attorney, Agent, or Firm* — Heslin Rothenberg Farley & Mesiti P.C.; Nicholas Mesiti, Esq.; Victor A. Cardona, Esq.

(57) ABSTRACT

A target system includes a mannequin target and a mechanism coupled to the target which is moveable to allow the mannequin target to move between a retracted position and an upright position. A projectile impact detection system is coupled to the mannequin target to determine an impact of a projectile onto the mannequin target. The projectile impact detection system is configured to produce a signal as a result of a projectile impacting the mannequin target to allow the mechanism to position the mannequin target in the retracted position wherein the mannequin falls into the retracted position upon impact of the projectile on the mannequin target to simulate a fallen target. A controller that will move the mannequin target from the retracted position to the upright position when receiving a command from a remotely controlled host computer. Impact detectors that will detect and locate impacts from 360 degrees. Thermal signature generators that will produce human thermal signatures. Wiring harness with will withstand impact and continue to function.

35 Claims, 115 Drawing Sheets

(56) References Cited

U.S. PATENT DOCUMENTS

| | | | | | |
|---|---|---|---|---|---|
| 3,845,956 | A | * | 11/1974 | Goldfarb et al. | 273/440.1 |
| 4,052,058 | A | * | 10/1977 | Hintz | 273/446 |
| 5,193,816 | A | | 3/1993 | Ahmed et al. | |
| 5,222,741 | A | * | 6/1993 | Redl | 273/393 |
| 5,403,017 | A | * | 4/1995 | Doss et al. | 273/372 |
| 5,516,113 | A | | 5/1996 | Hodge | |
| 6,133,989 | A | | 10/2000 | Stettner et al. | |
| 6,217,027 | B1 | | 4/2001 | Amrein et al. | |
| 6,414,746 | B1 | | 7/2002 | Stettner et al. | |
| 6,778,915 | B2 | | 8/2004 | Kelly et al. | |
| 7,207,566 | B2 | | 4/2007 | Hodge | |
| 7,694,973 | B1 | * | 4/2010 | Hofmeister et al. | 273/406 |
| 7,862,045 | B2 | | 1/2011 | Hodge | |
| 2005/0237528 | A1 | | 10/2005 | Oldham et al. | |
| 2005/0272534 | A1 | * | 12/2005 | Bayduke | 473/438 |
| 2007/0035528 | A1 | | 2/2007 | Hodge | |
| 2009/0179382 | A1 | * | 7/2009 | Stincelli et al. | 273/392 |
| 2009/0194942 | A1 | | 8/2009 | Hodge | |
| 2010/0032906 | A1 | * | 2/2010 | Wilcox | 273/391 |
| 2012/0074645 | A1 | | 3/2012 | Hodge | |

OTHER PUBLICATIONS

International Search Report and the Written Opinion of the International Search Authority (PCT/ISA/220, PCT/ISA/237, and PCT/ISA/210) dated Jan. 19, 2012, for corresponding International Application No. PCT/US2011/027426 filed on Mar. 7, 2011.

Search Report in related PCT Application No. PCT/US2012/025118, dated Sep. 26, 2014, 7 pages.

* cited by examiner

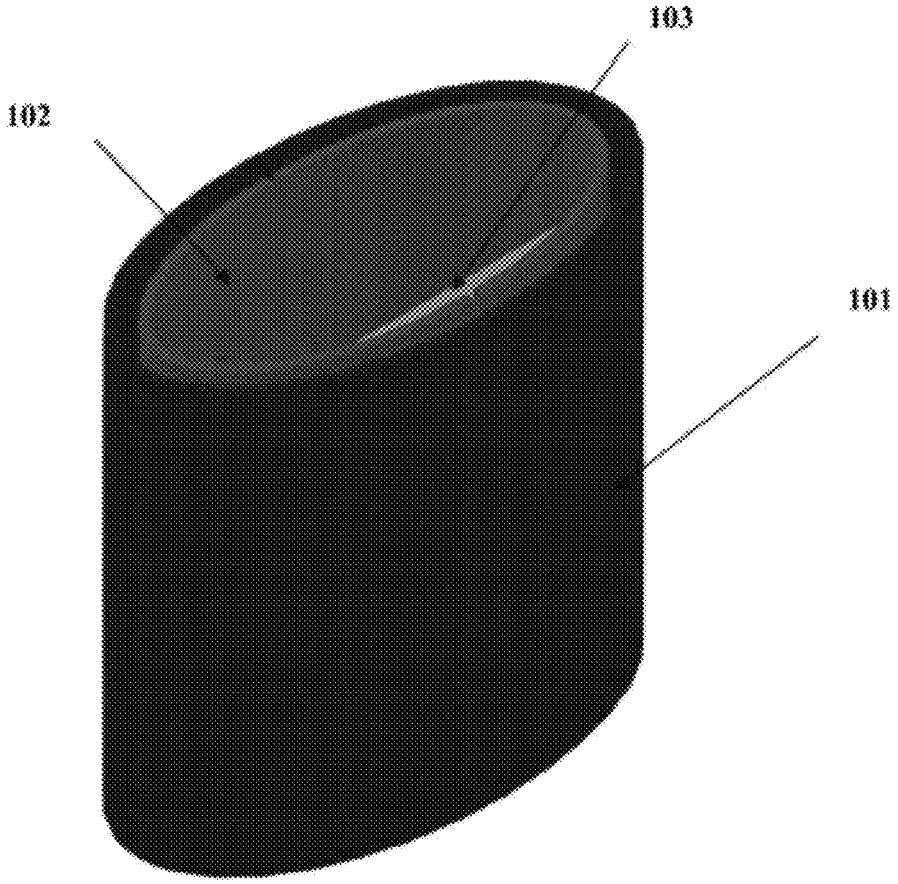
Figure 1: Unidirectional Elliptical Target Isometric View

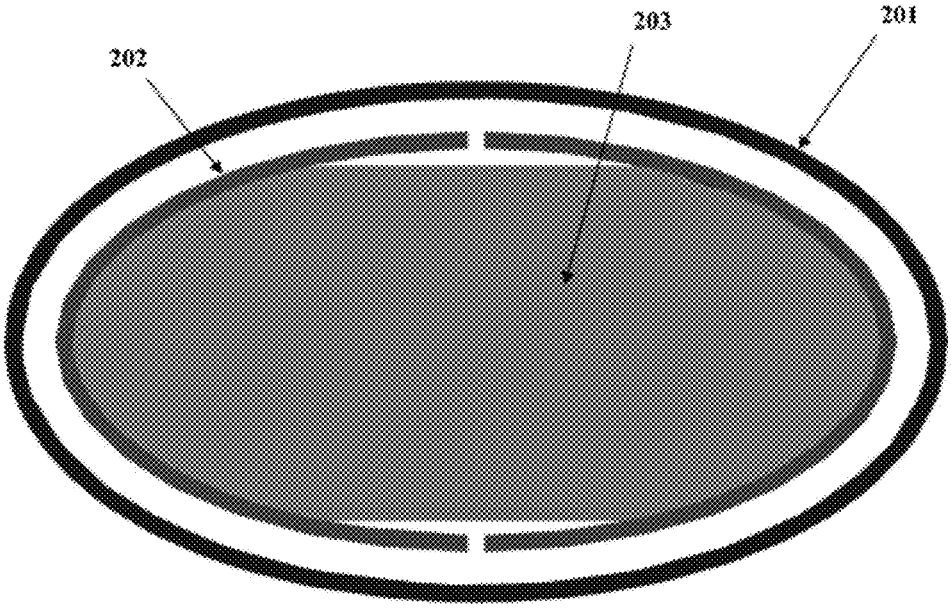
Figure 2: Unidirectional Elliptical Target Top View

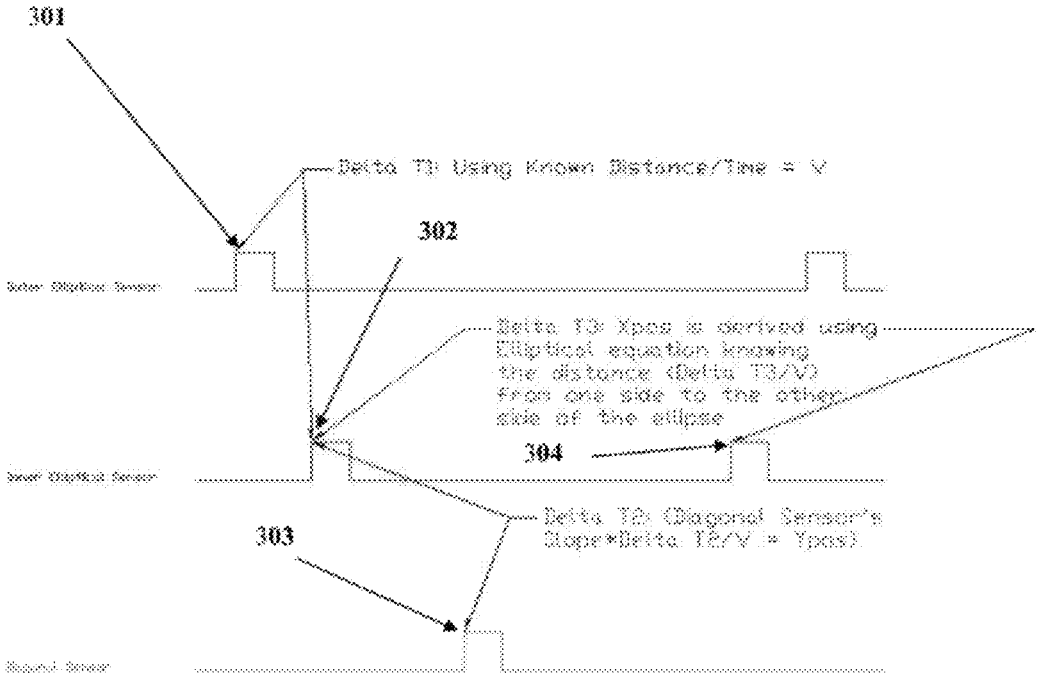
Figure 3: Unidirectional Elliptical Target Timing Diagram

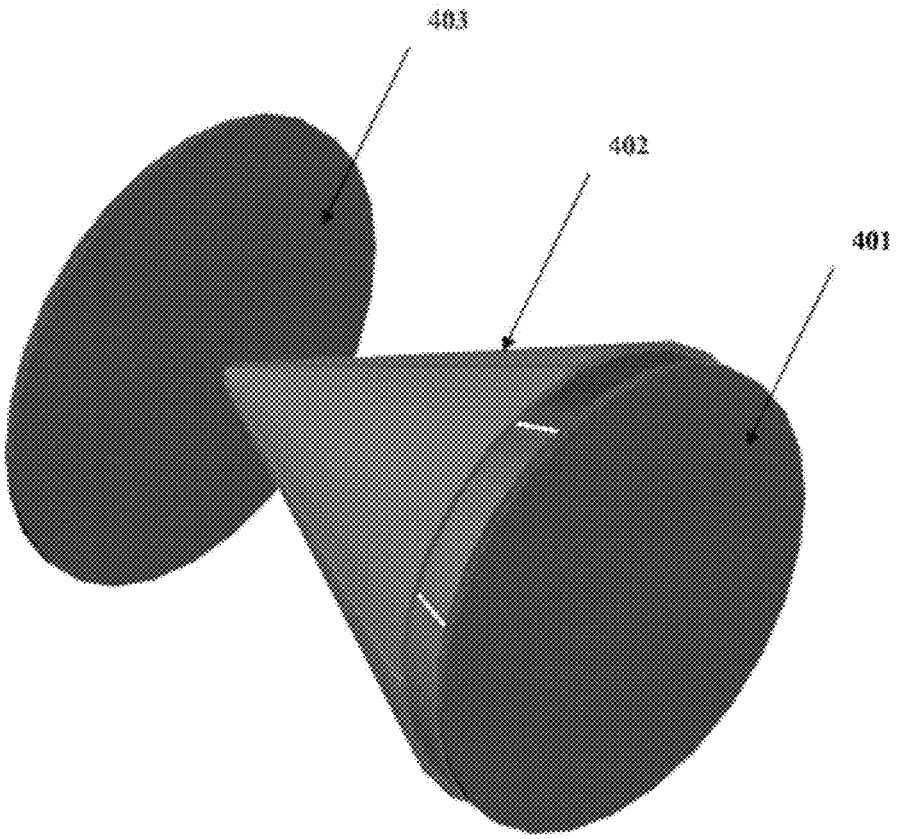
Figure 4: Unidirectional Conic Target with Front & Back Sensors Isometric View

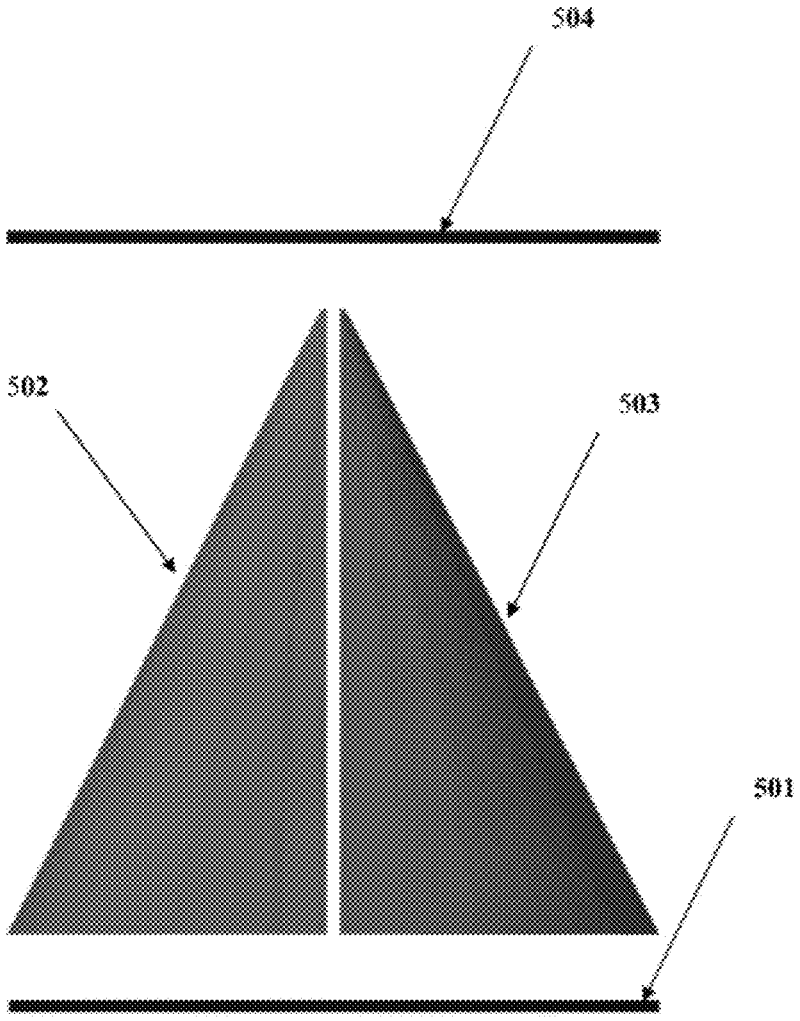
Figure 5: Unidirectional Conic Target with Front & Back Sensors Top View

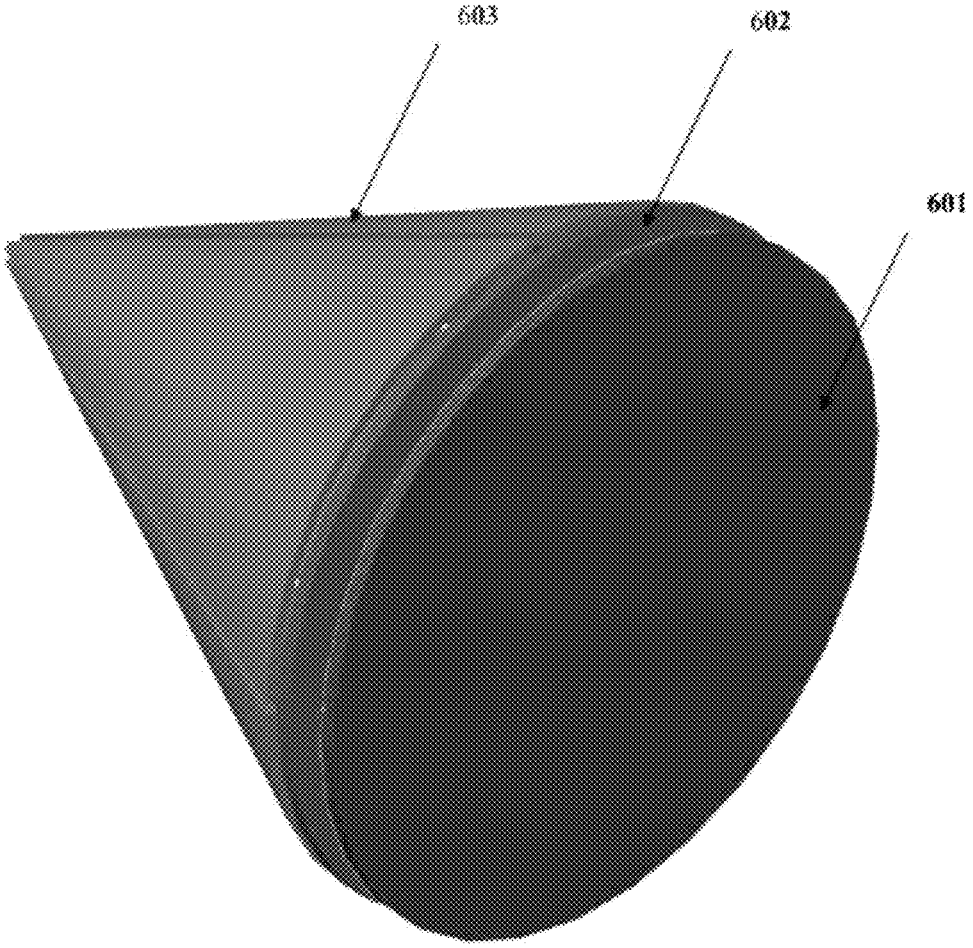
Figure 6: Unidirectional Conic Target with Dual Front Sensors Isometric View

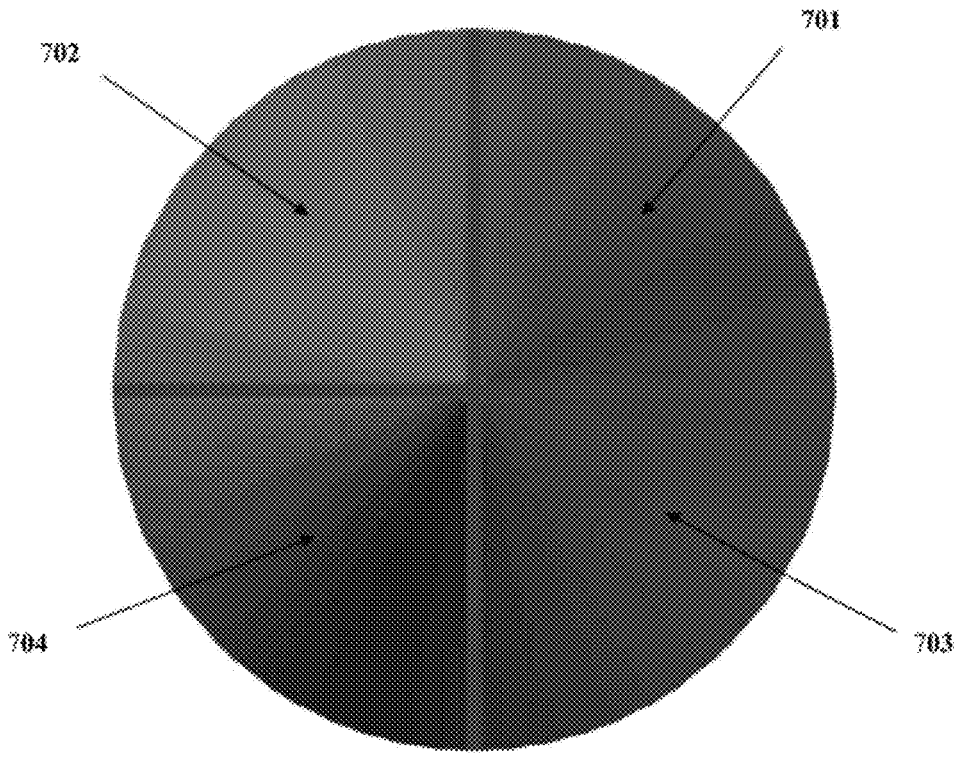
Figure 7: Unidirectional Conic Target with Dual Front Sensors Rear View

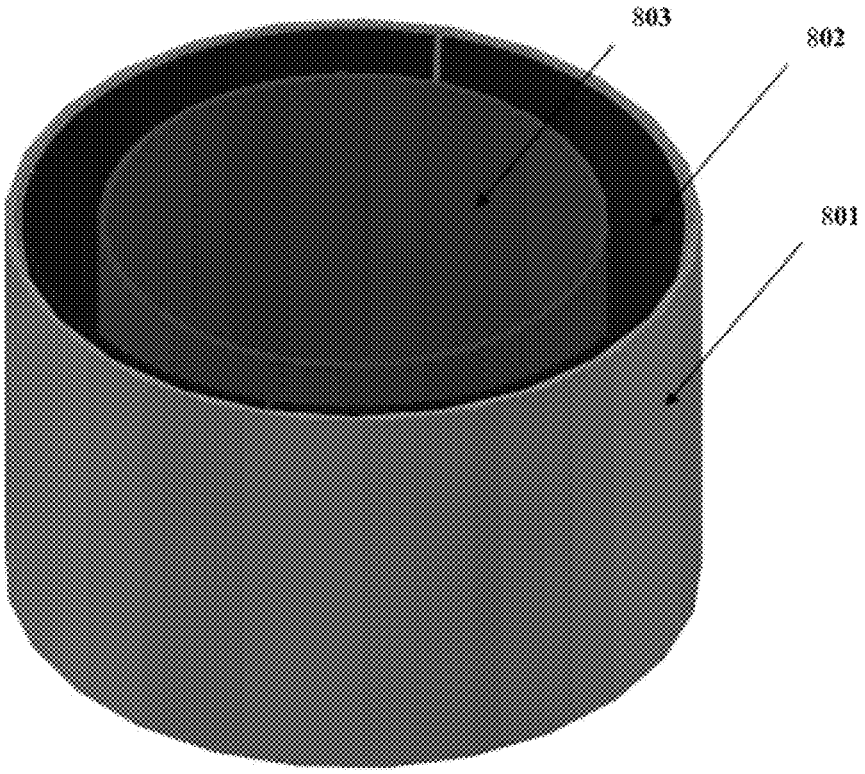
Figure 8: Omni Directional Cylindrical Target with Solid Inner/Outer Sensors Isometric View

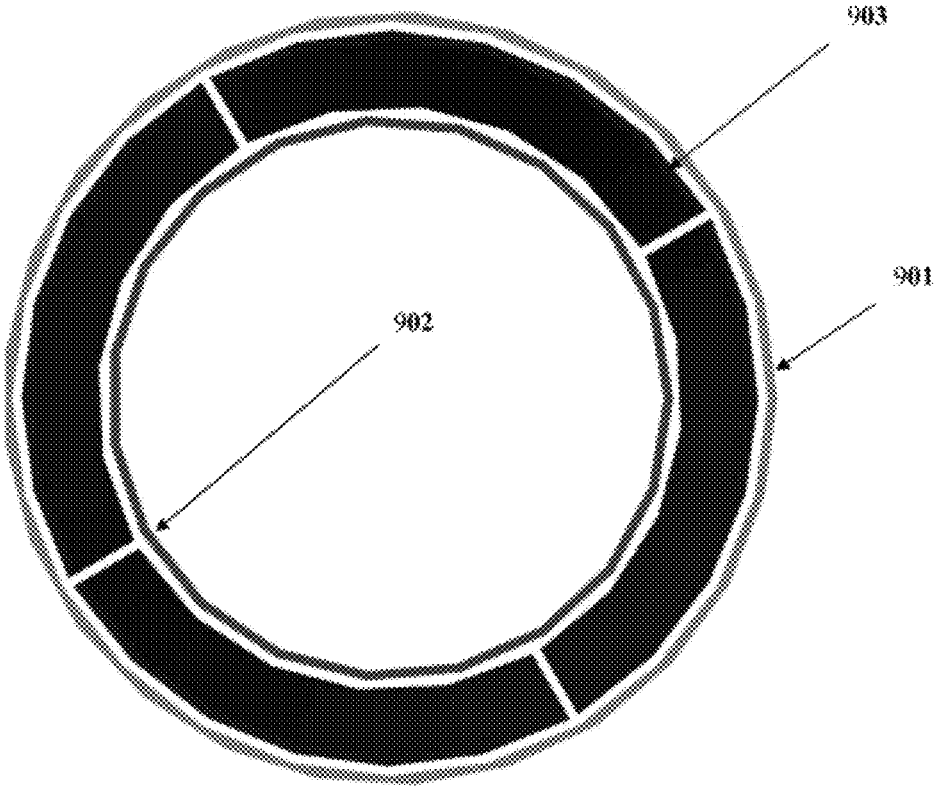
Figure 9: Omni Directional Cylindrical Target with Solid Inner/Outer Sensors Top View

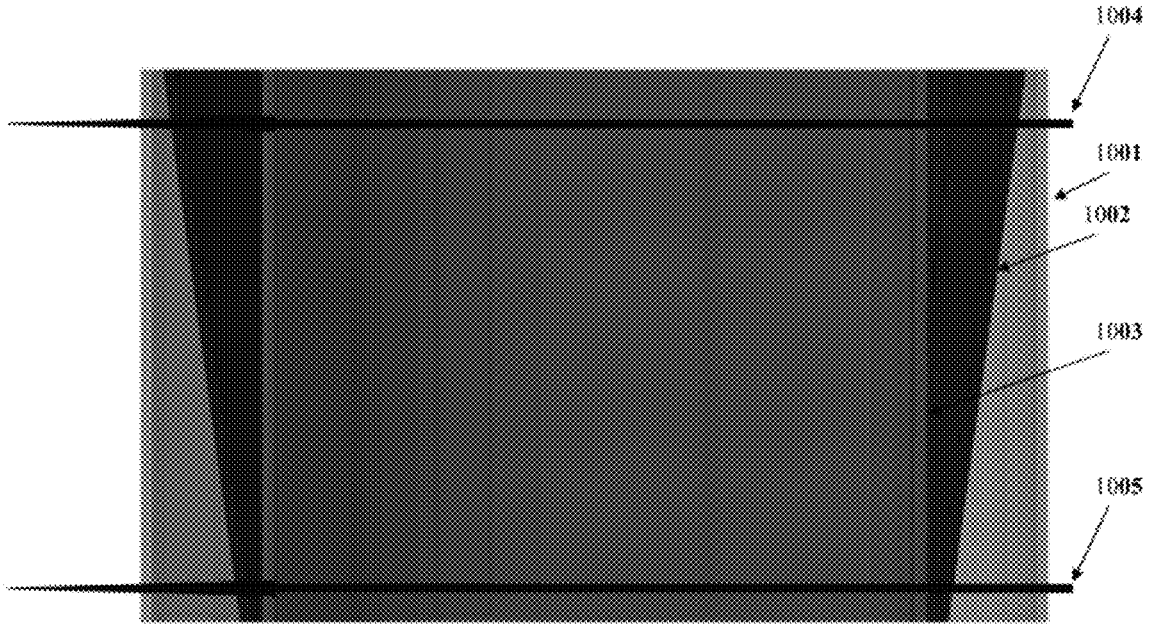
Figure 10: Omni Directional Cylindrical Target with Solid Inner/Outer Sensors Cutaway View

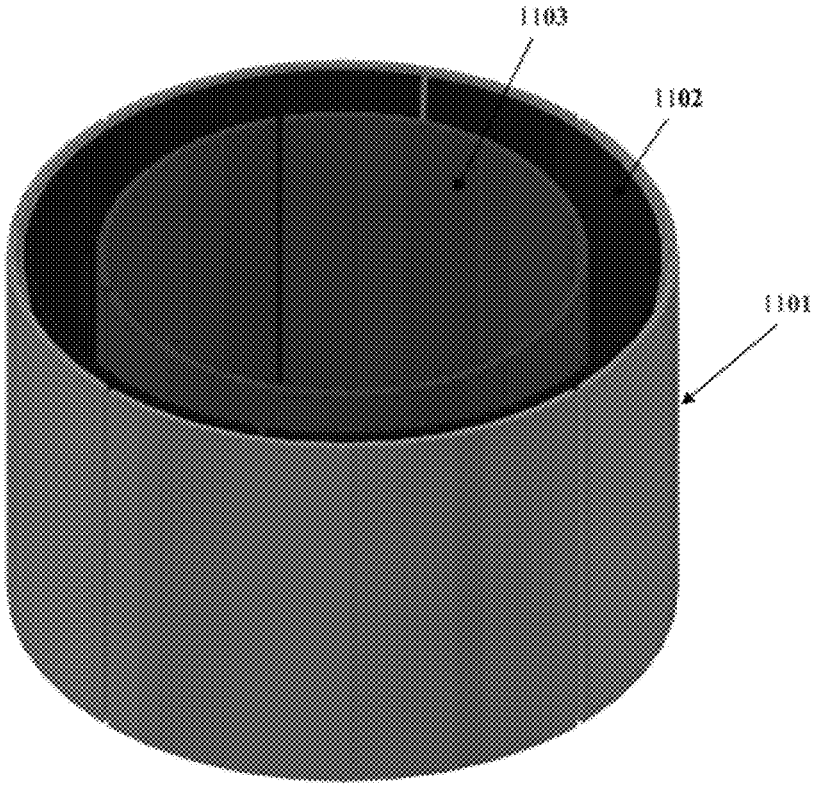
Figure 11: Omni Directional Cylindrical Target with Segmented Inner/Outer Sensors Isometric View

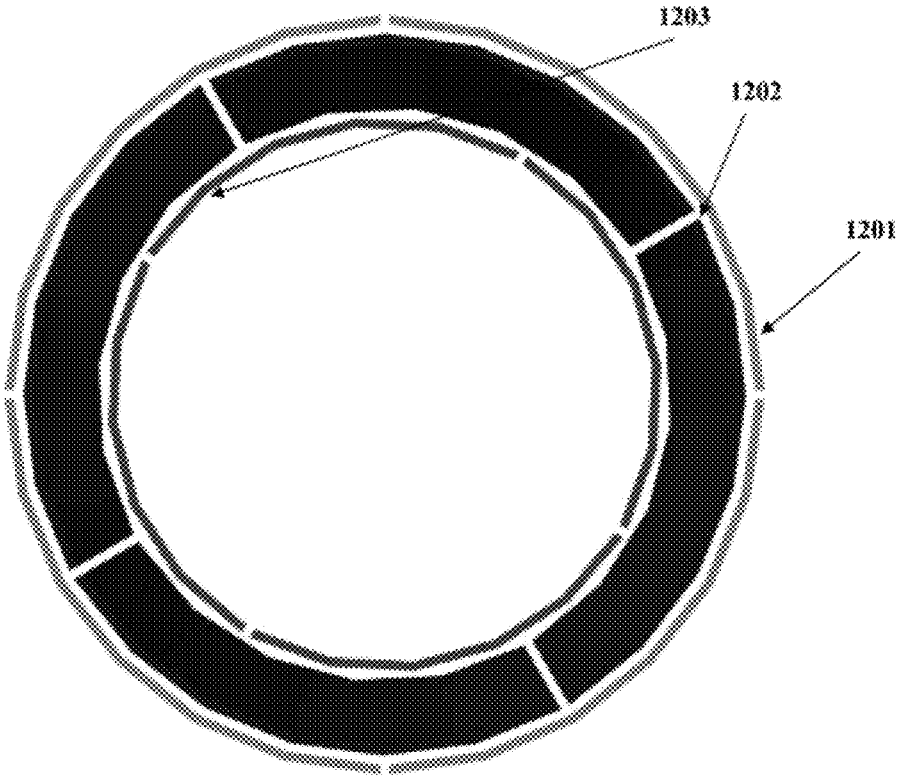
Figure 12: Omni Directional Cylindrical Target with Segmented Inner/Outer Sensors Top View

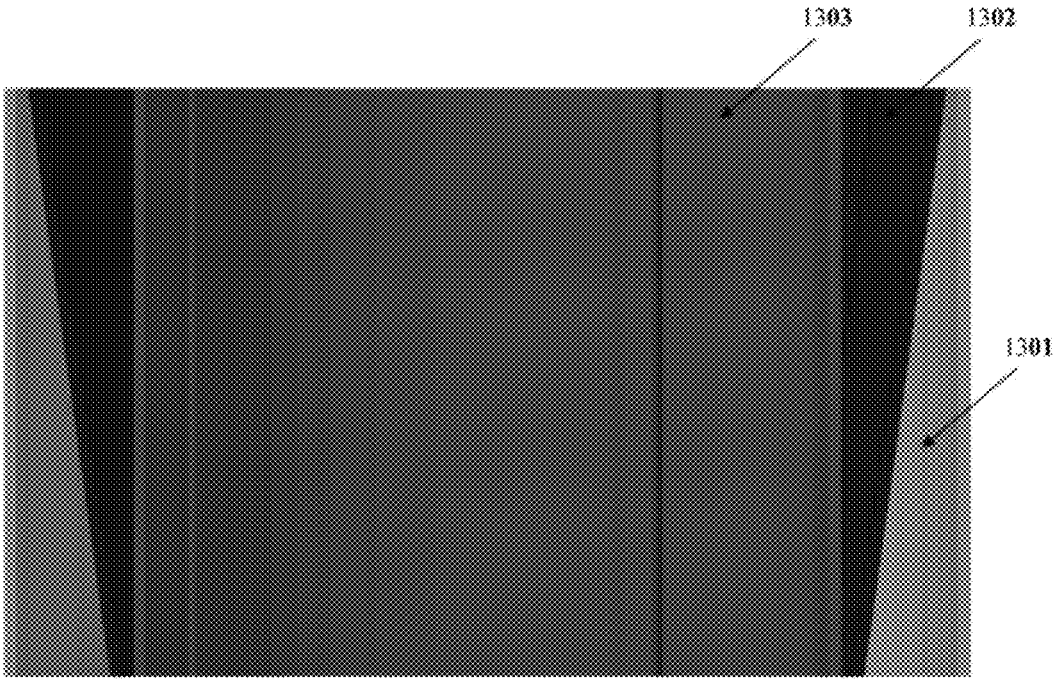
Figure 13: Omni Directional Cylindrical Target with Segmented Inner/Outer Sensors Cutaway View

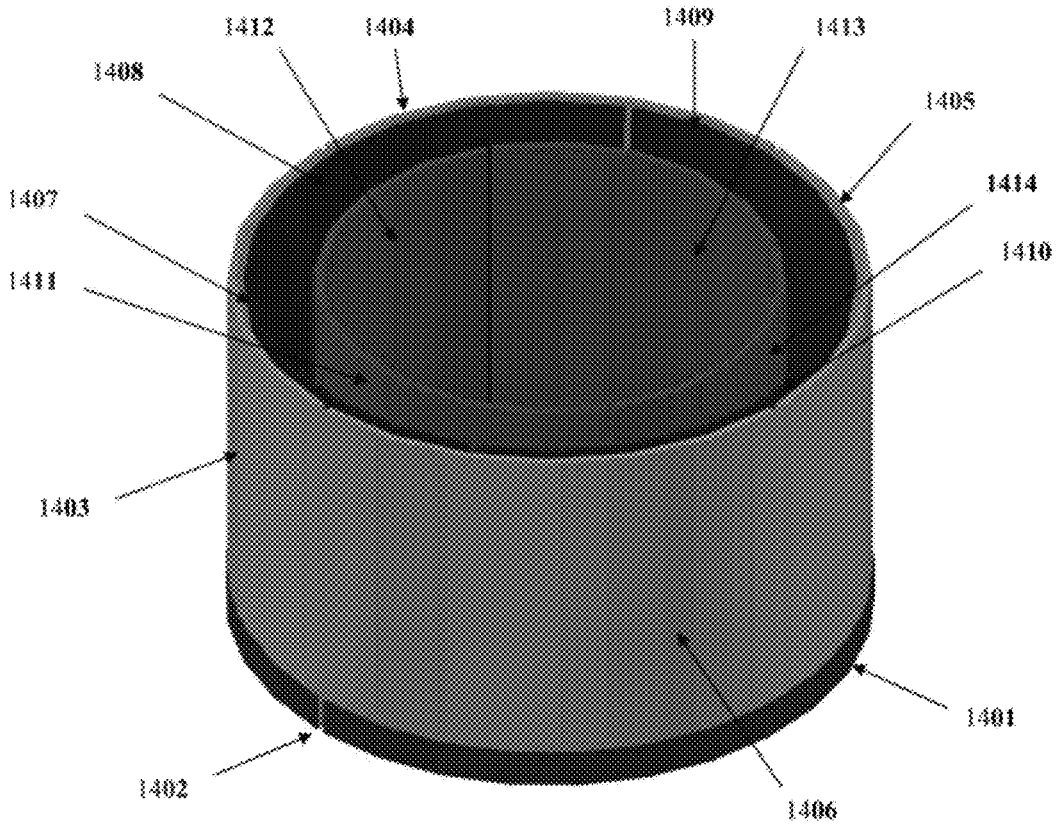
Figure 14: Omni Directional Cylindrical Target with Resistive Rubber Interconnection Isometric View

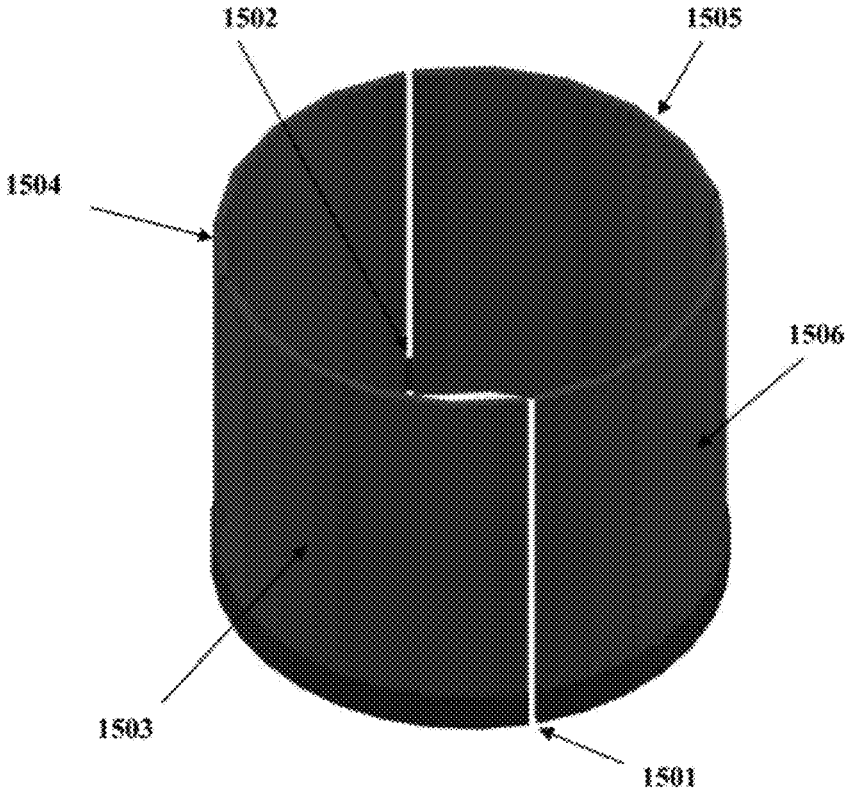
Figure 15: Omni Directional Cylindrical Target with Resistive Rubber Inner Sensor Isometric View

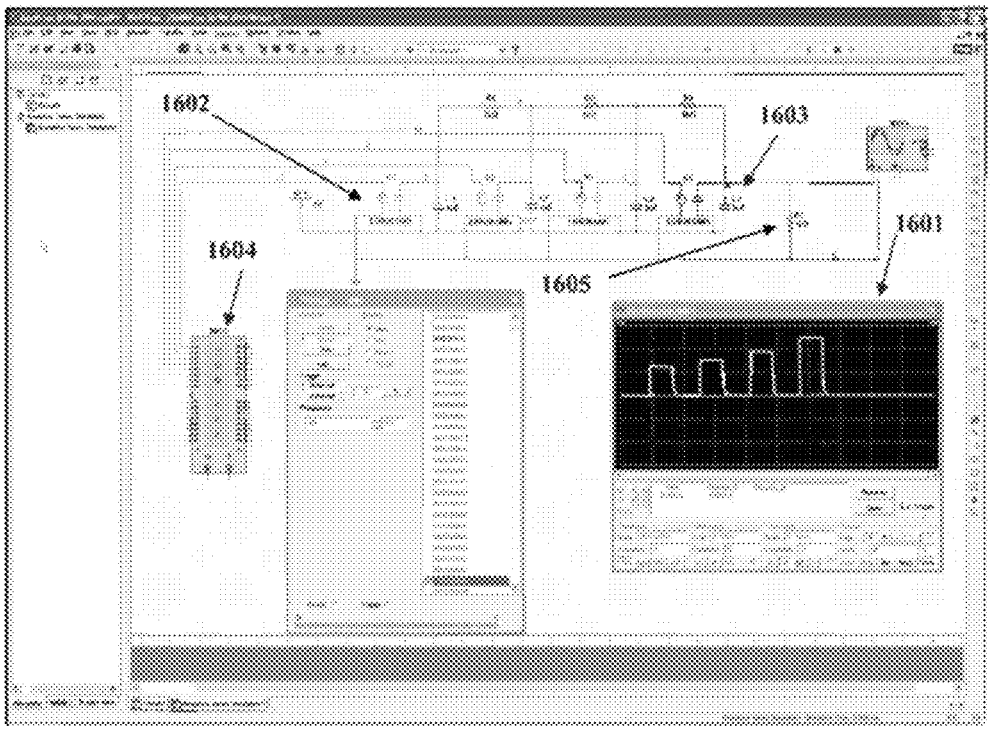
Figure 16: Resistive Rubber Acquisition System Simulated using a Sense Resistor Circuit

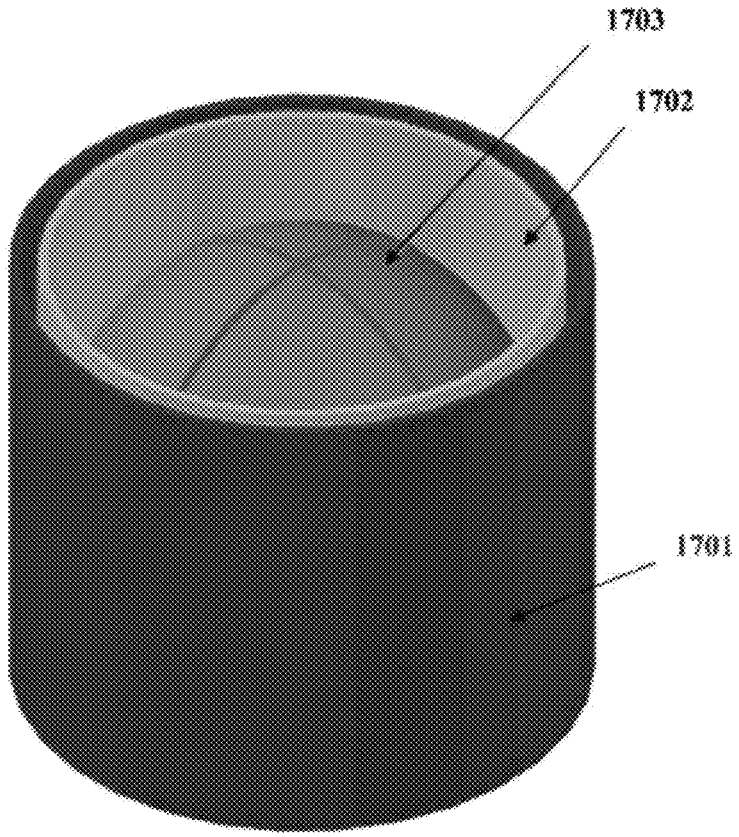
Figure 17: Omni Directional Cylindrical/Spherical Target Isometric View

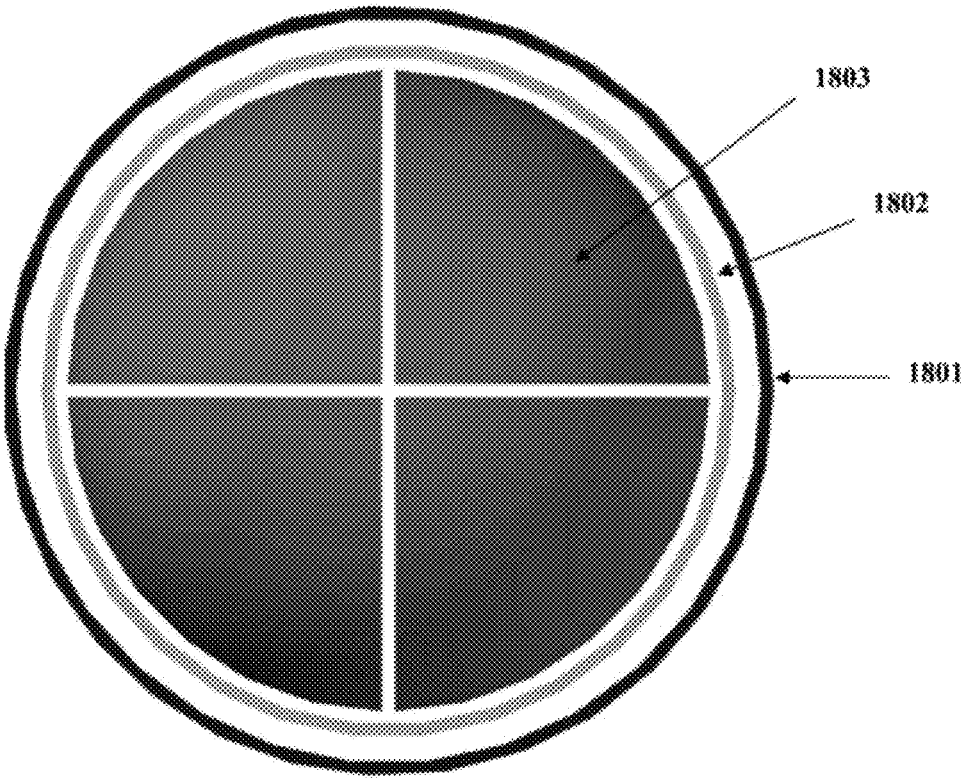
Figure 18: Omni Directional Cylindrical/Spherical Target Top View

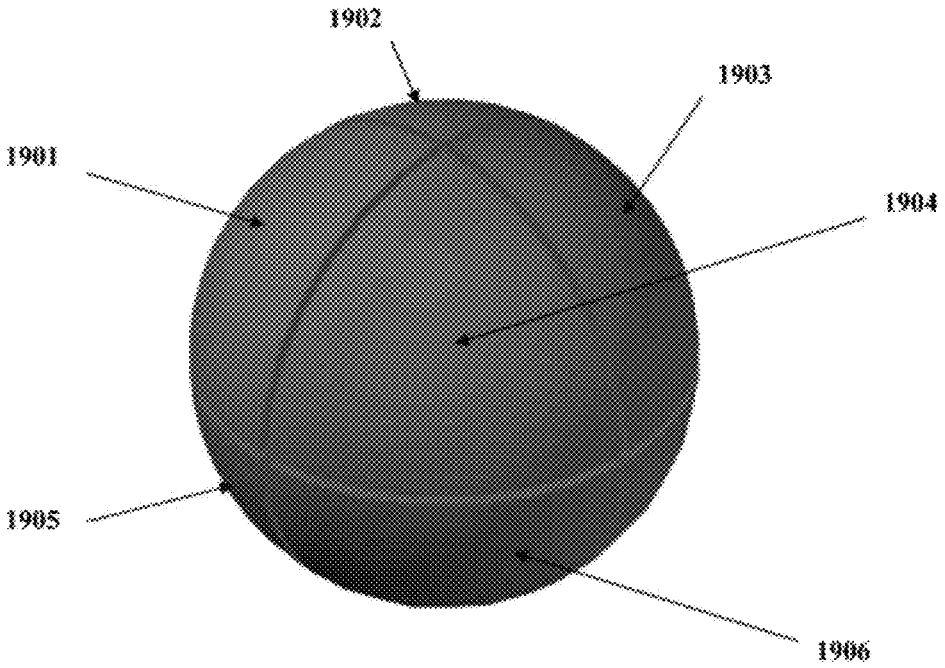
Figure 19: Omni Directional Cylindrical/Spherical Target Spherical sensor Isometric View

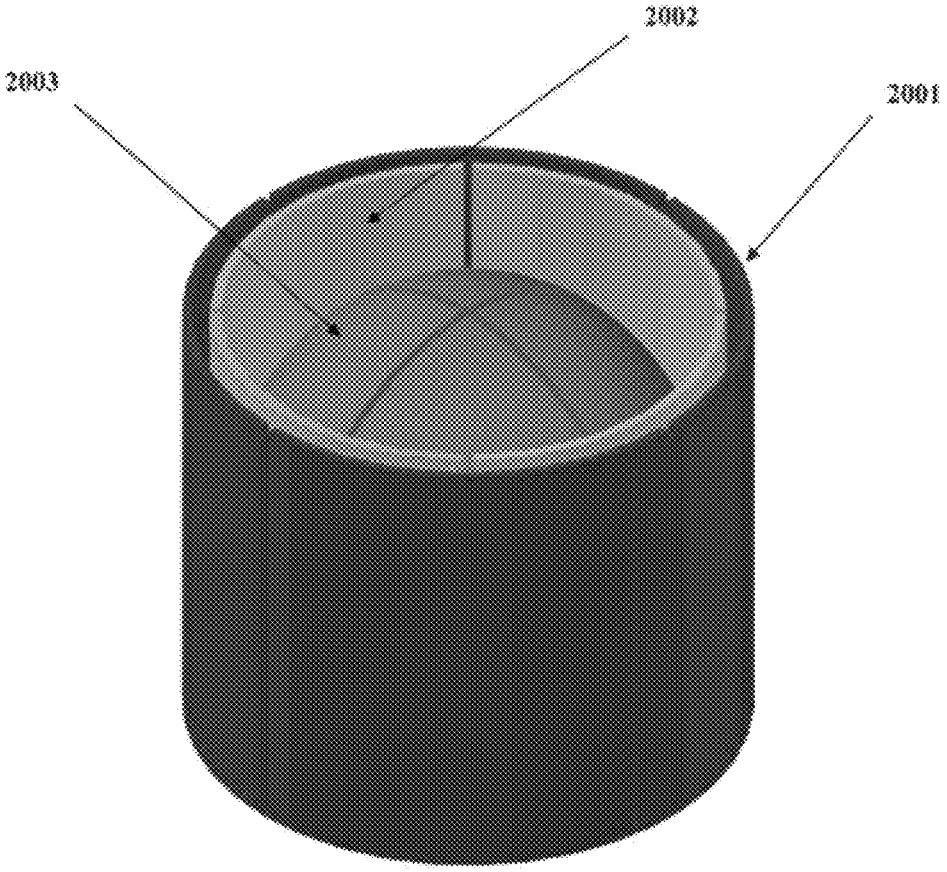
Figure 20: Omni Directional Cylindrical/Spherical Target with segmented Sensors Isometric View

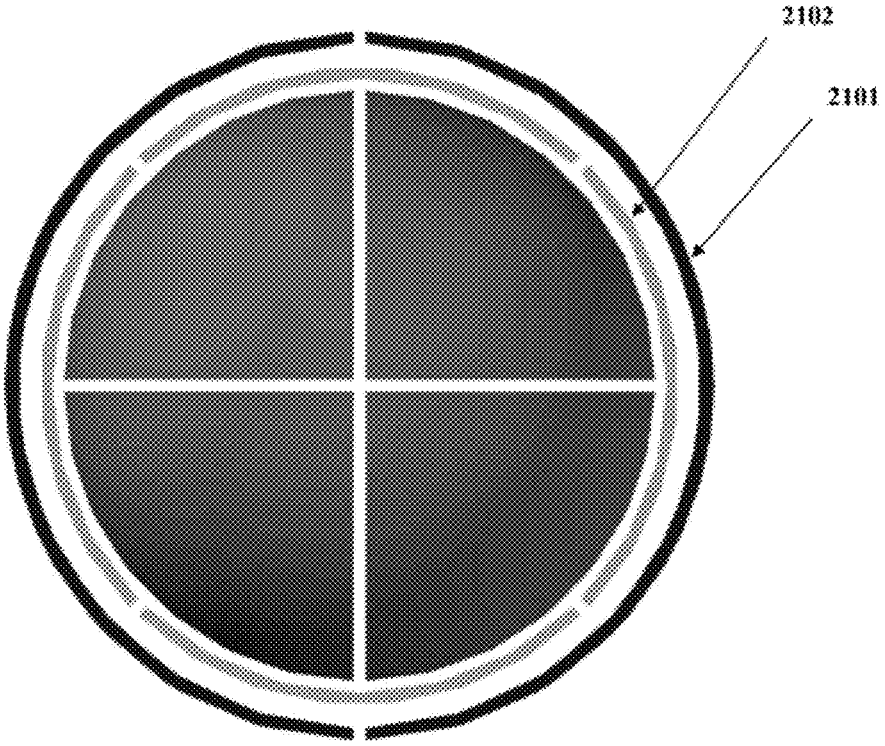
Figure 21: Omni Directional Cylindrical/Spherical Target with segmented Sensors Top View

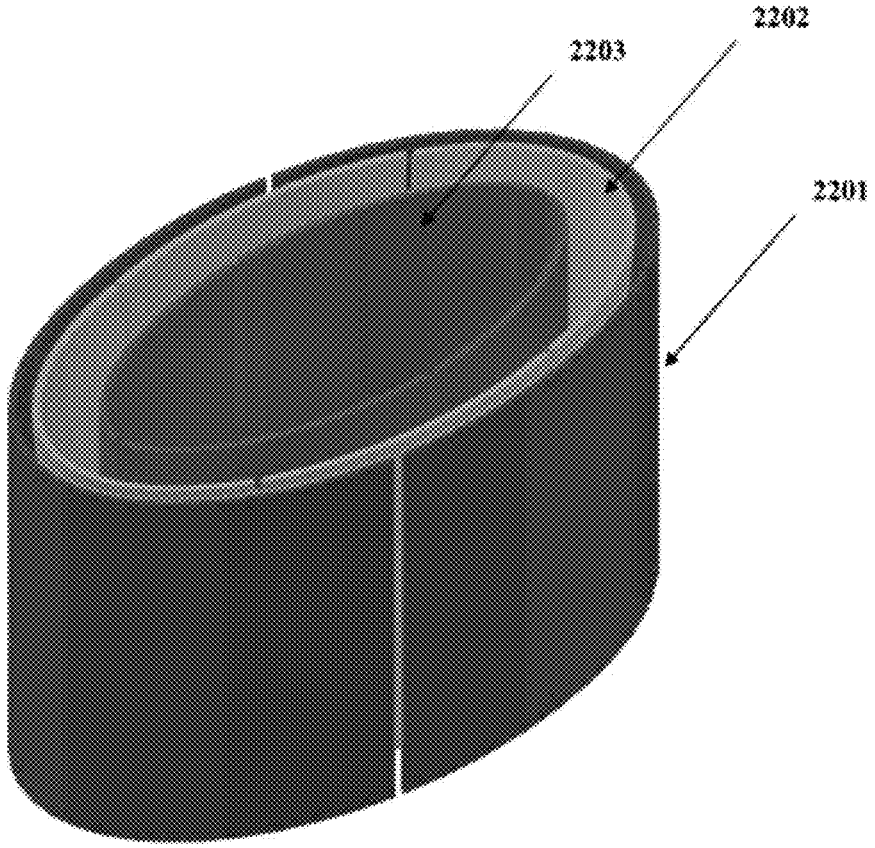
Figure 22: Omni Directional Elliptical Target with segmented Sensors Isometric View

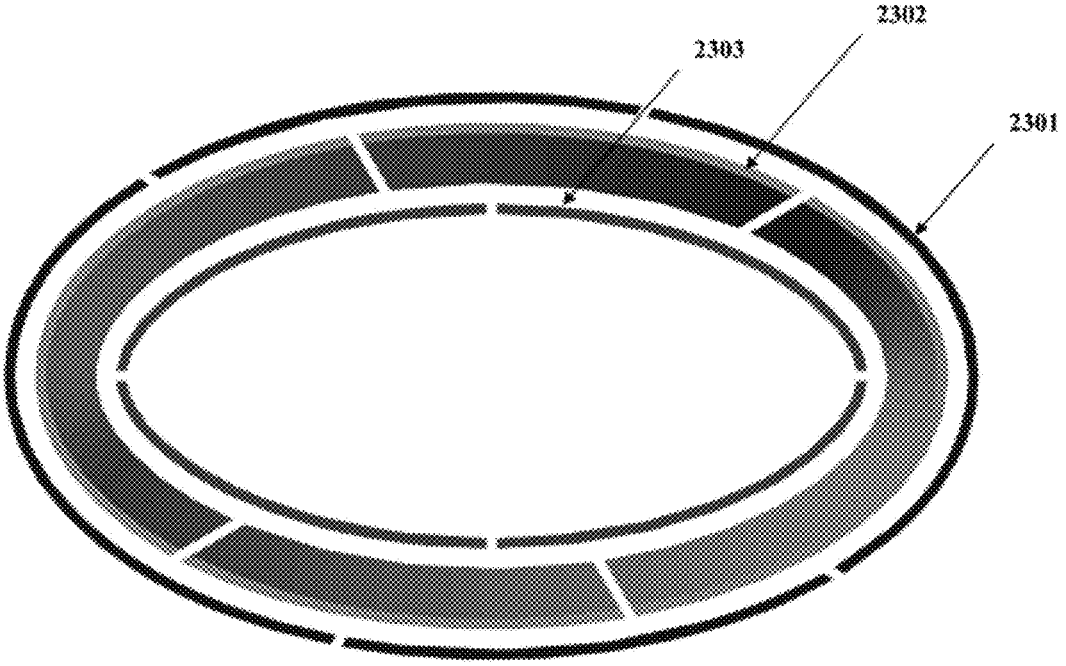
Figure 23: Omni Directional Elliptical Target with segmented Sensors Top View

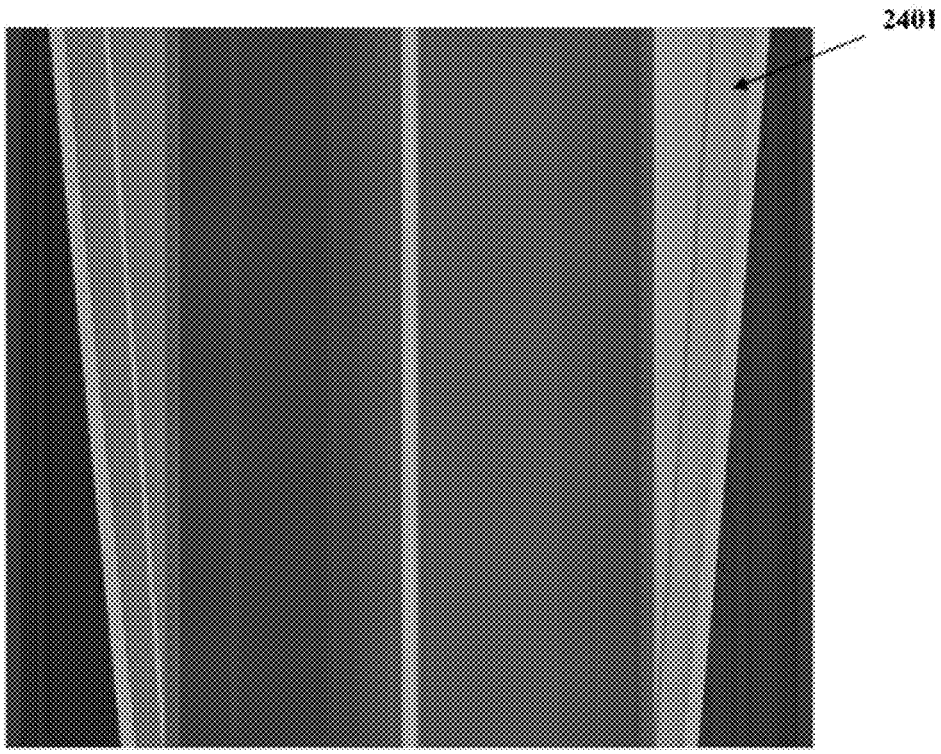
Figure 24: Omni Directional Elliptical Target with segmented Sensors Vertical Cutaway View

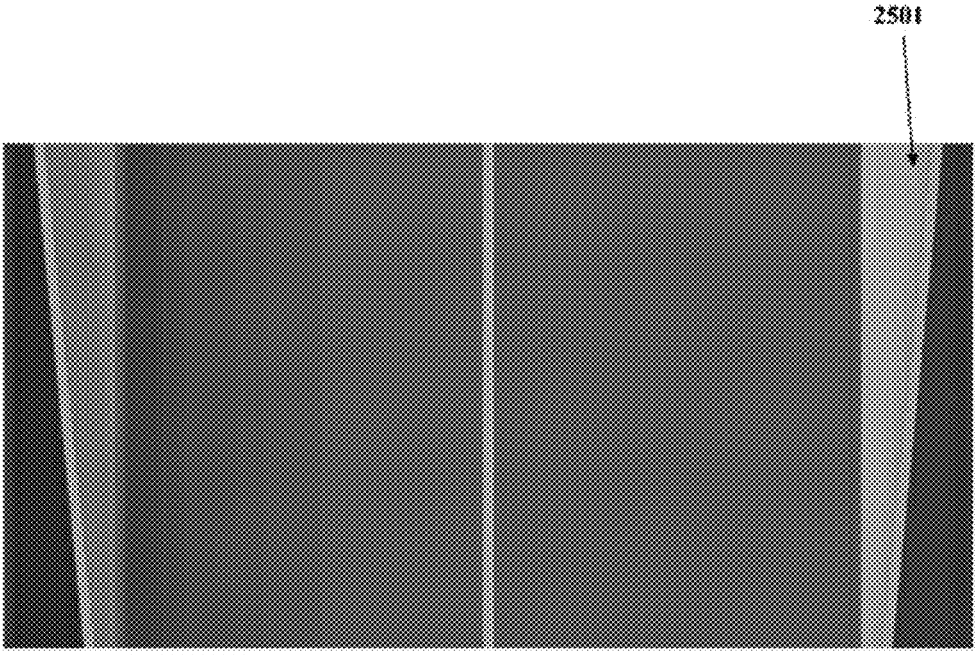
Figure 25: Omni Directional Elliptical Target with segmented Sensors Horizontal Cutaway View

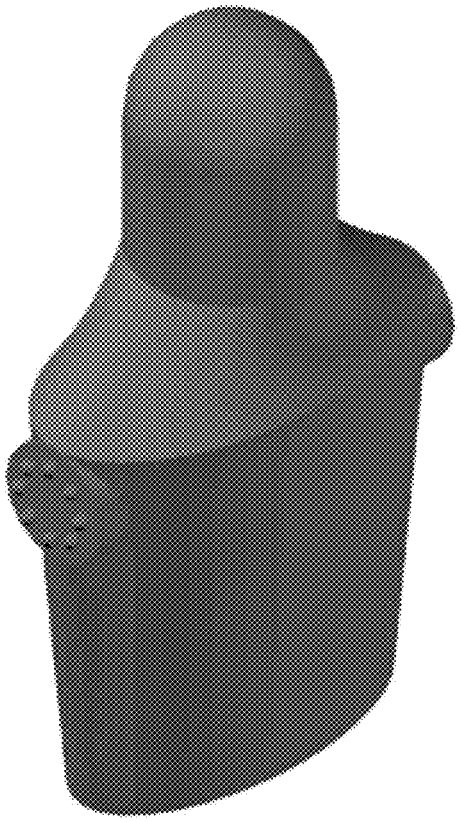
Figure 26: Mannequin HDPE Torso Isometric View

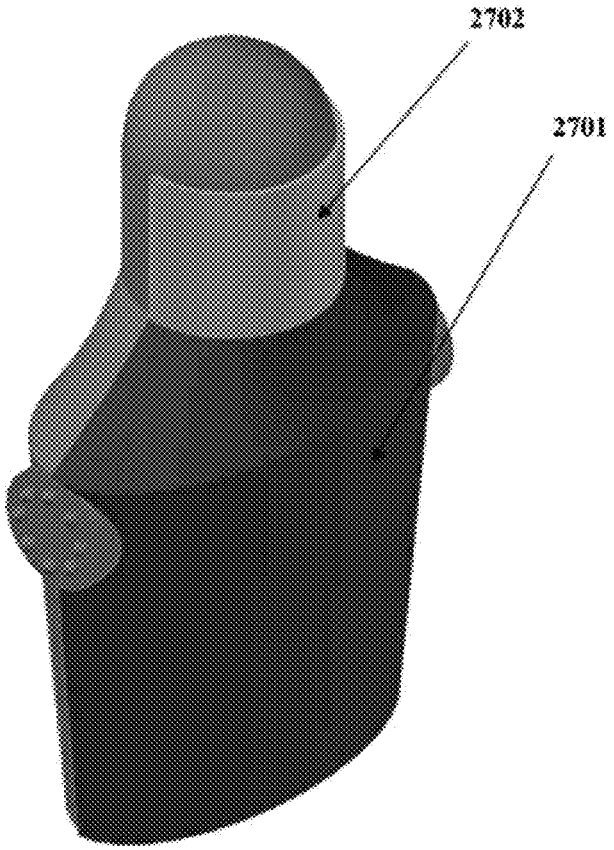
Figure 27: Mannequin HDPE Torso with Front Only Sensors/Heaters Isometric View

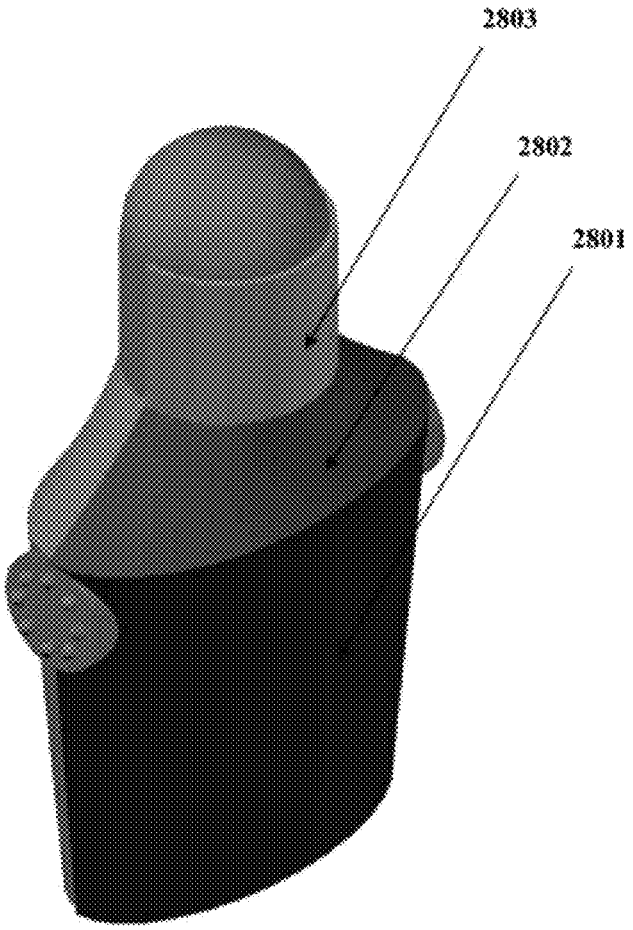
Figure 28: Mannequin HDPE Torso with Front Only Chest, Shoulder, & Head sensors Isometric View

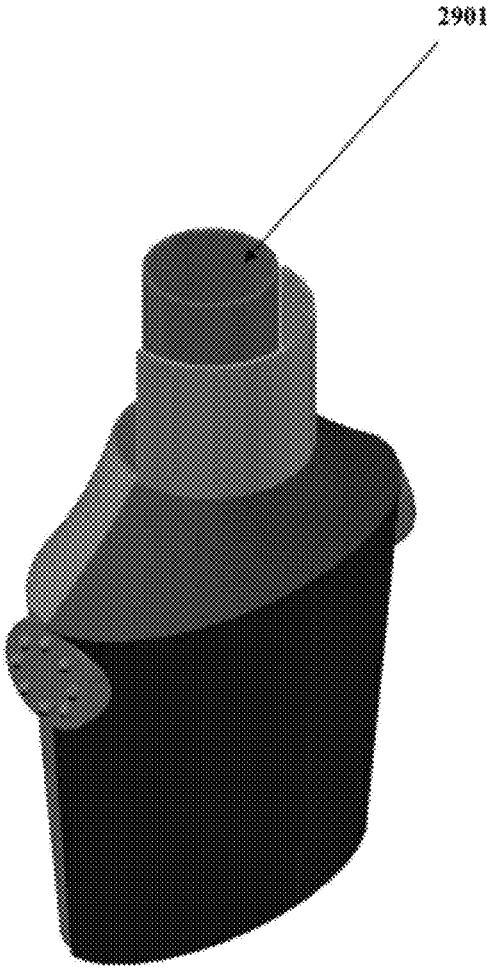
Figure 29: Mannequin HDPE Torso with Front Only Chest, Shoulder, Head & Kill Zone Isometric View

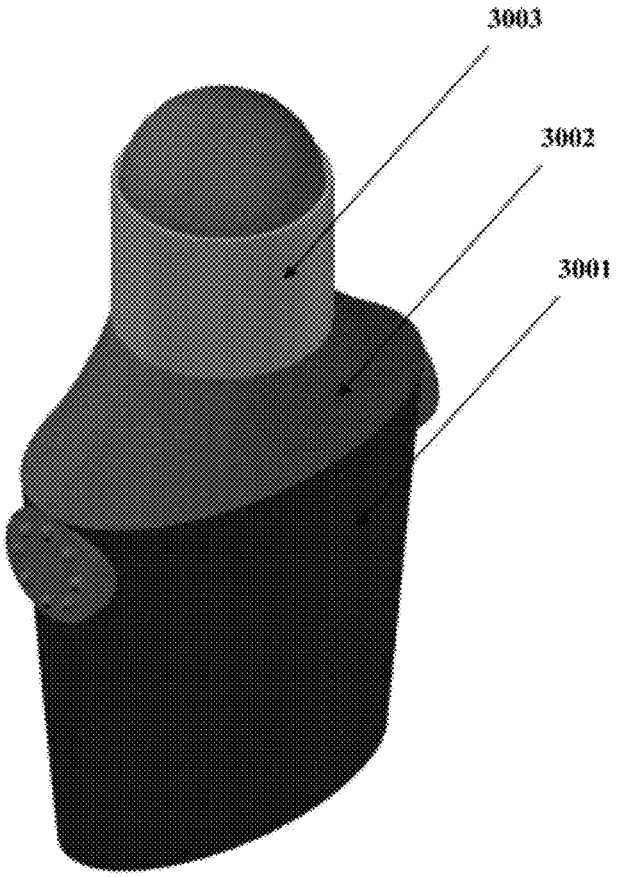
Figure 30: Mannequin HDPE Torso with Enclosed Chest, Shoulder, & Head Isometric View

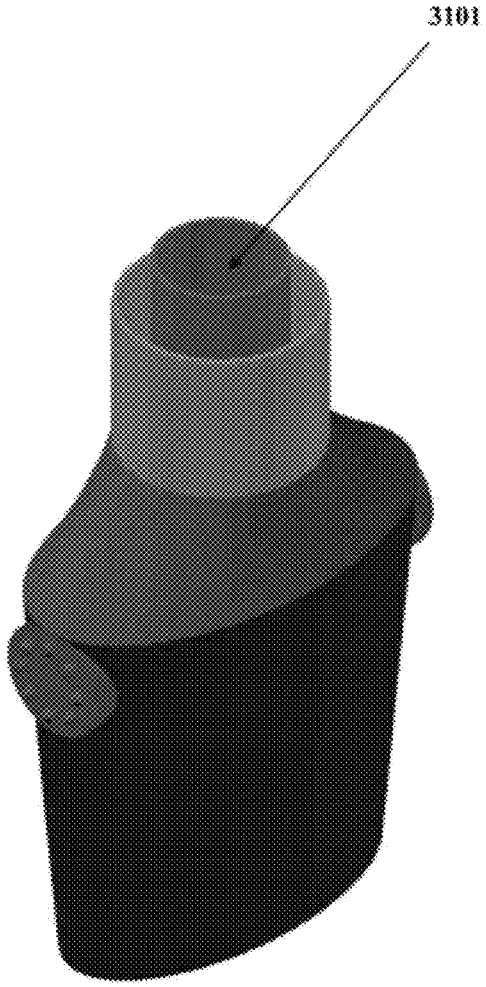
Figure 31: Mannequin HDPE Torso with Enclosed Chest, Shoulder, Head & Kill Zone Isometric View

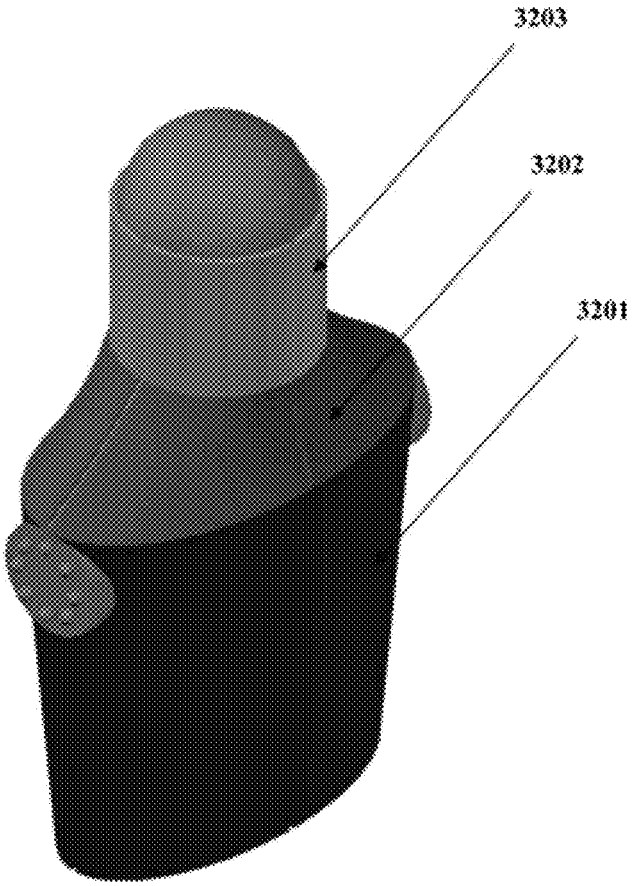
Figure 32: Mannequin HDPE Torso with Segmented Chest, Shoulder, & Head Isometric View

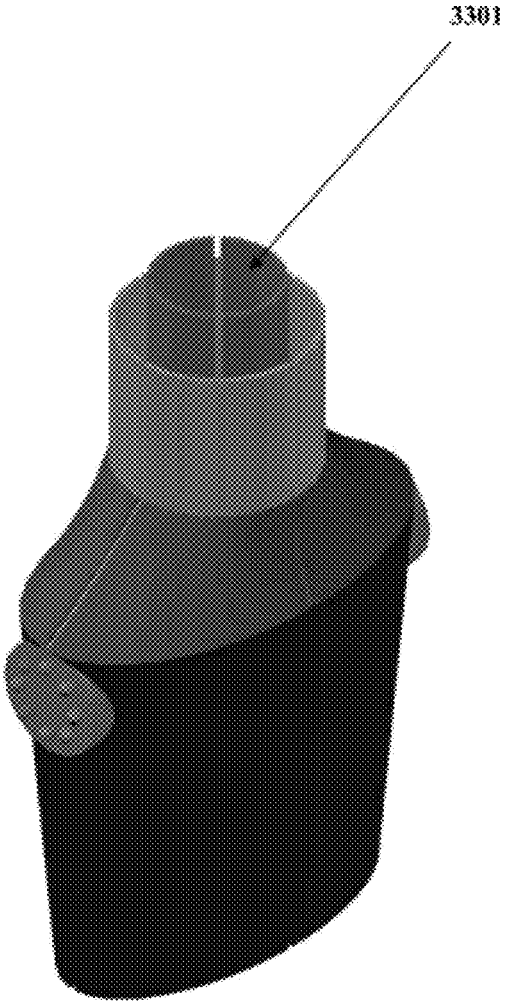
Figure 33: Mannequin HDPE Torso with Segmented Chest, Shoulder, Head & Kill Zone Isometric View

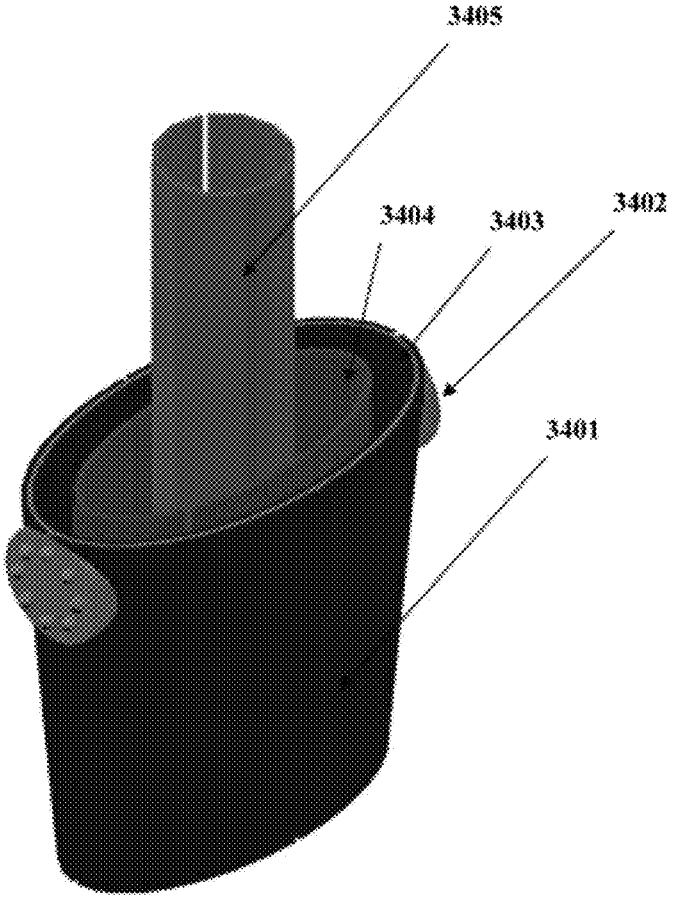
Figure 34: Mannequin HDPE Torso with Segmented Chest & Kill Zone Isometric View

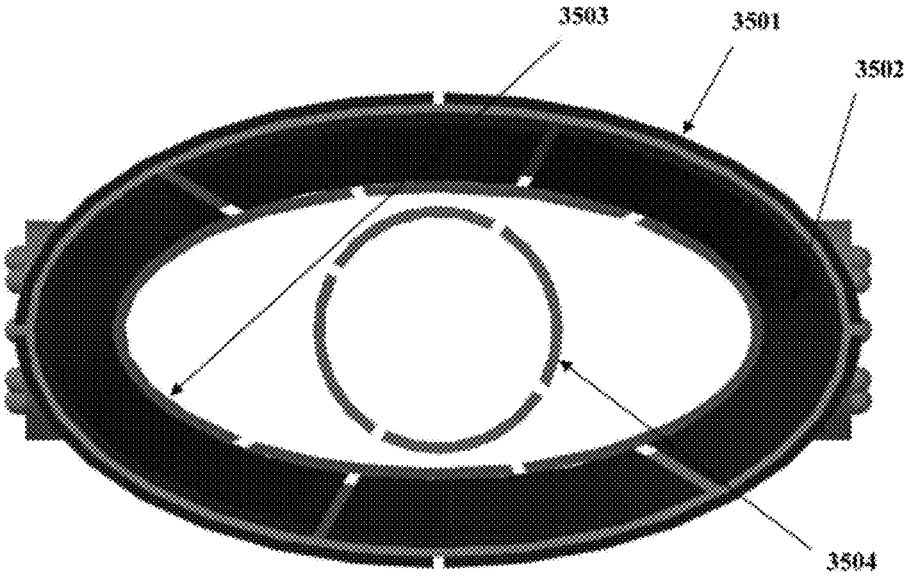
Figure 35: Mannequin HDPE Torso with Segmented Chest & Kill Zone Top View

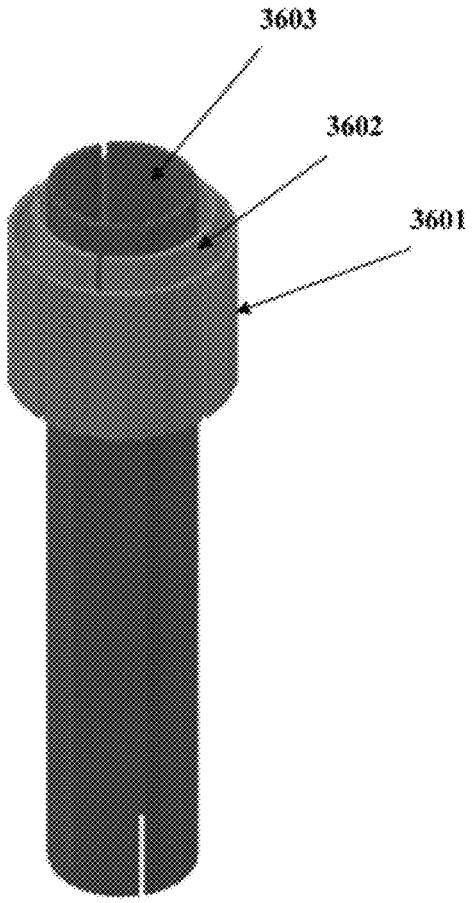
Figure 36: Mannequin HDPE Torso with Segmented Head & Kill Zone Isometric View

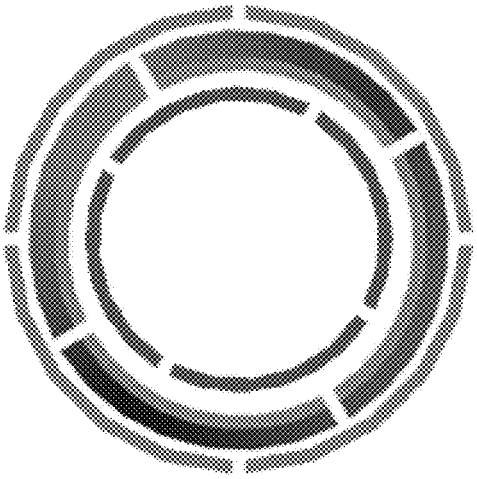
Figure 37: Mannequin HDPE Torso with Segmented Head & Kill Zone Top View

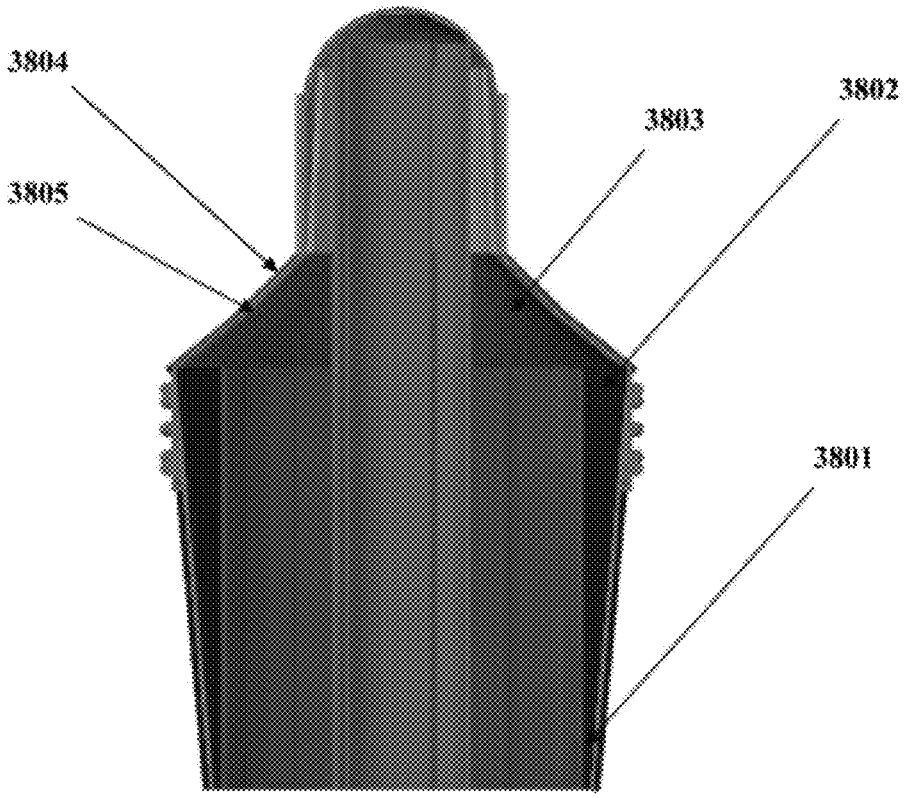
Figure 38: Mannequin HDPE Torso with Segmented Sensors Cutaway View

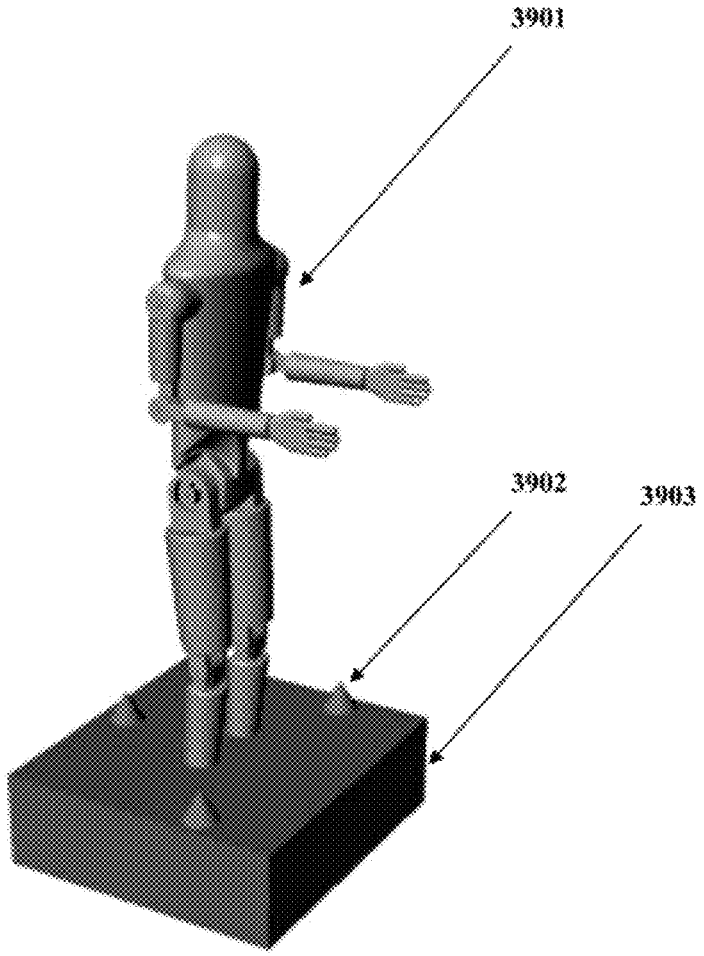
Figure 39: Mannequin Non Contact LIDAR Based System Isometric View

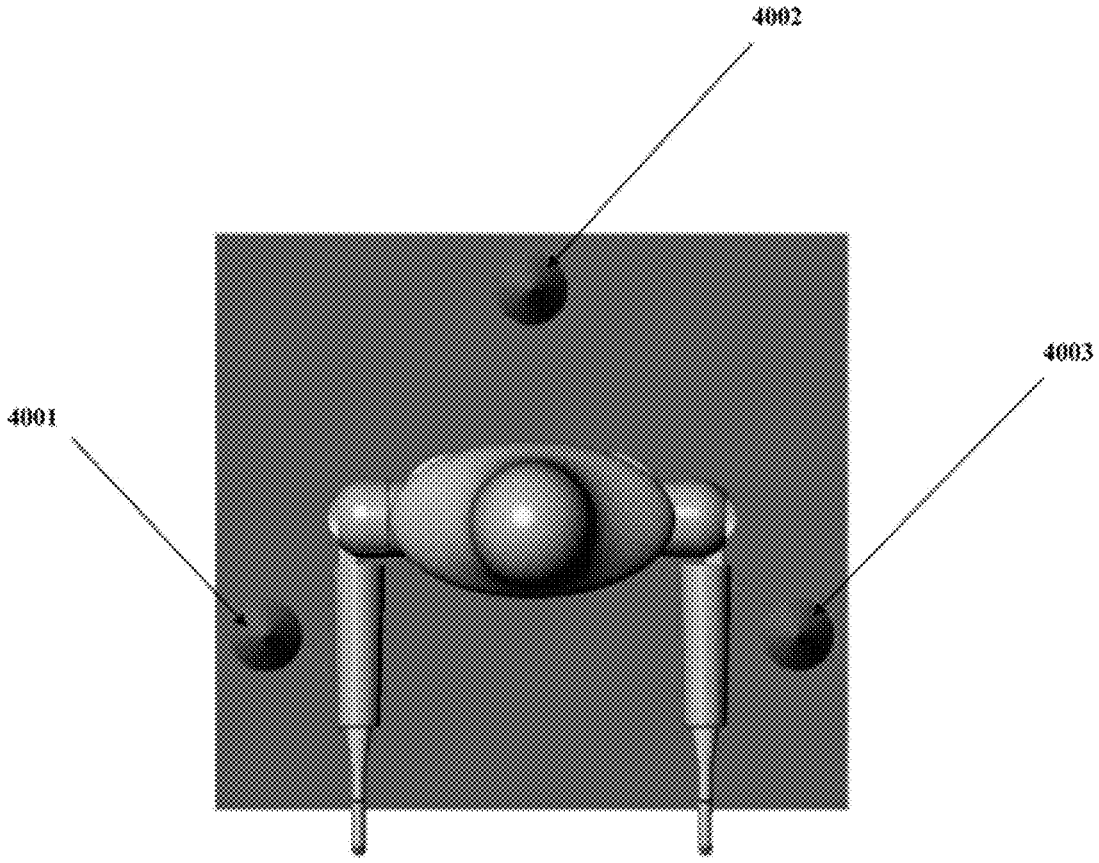
Figure 40: Mannequin Non Contact LIDAR Based System Top View

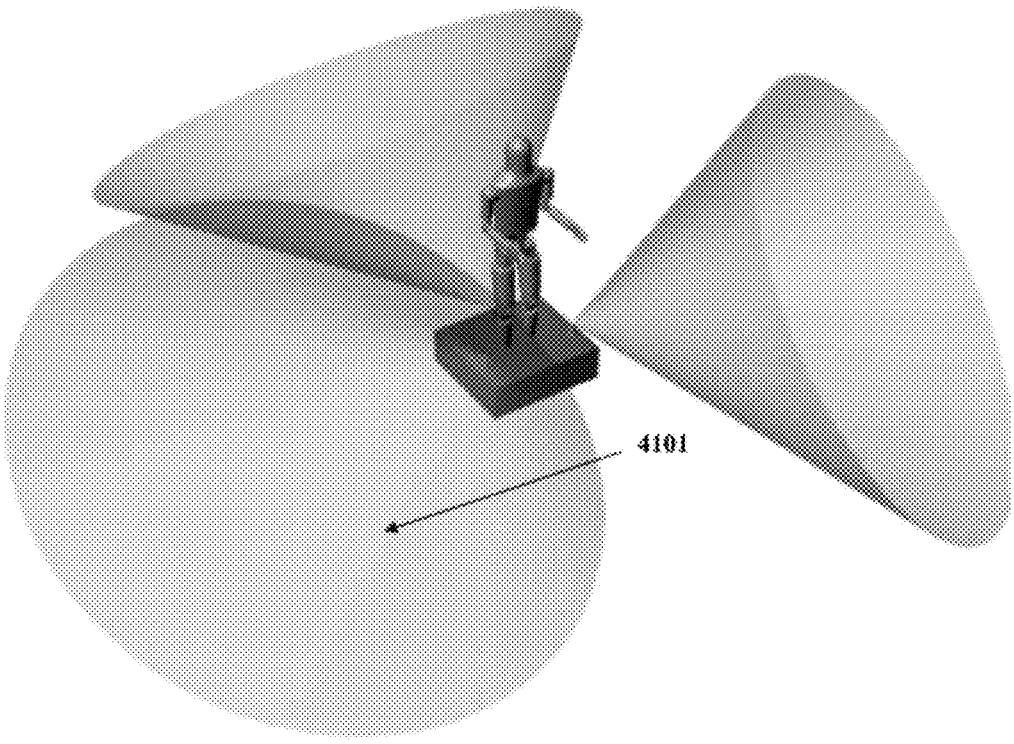
Figure 41: Mannequin Non Contact LIDAR SA/HD Sensors Isometric View

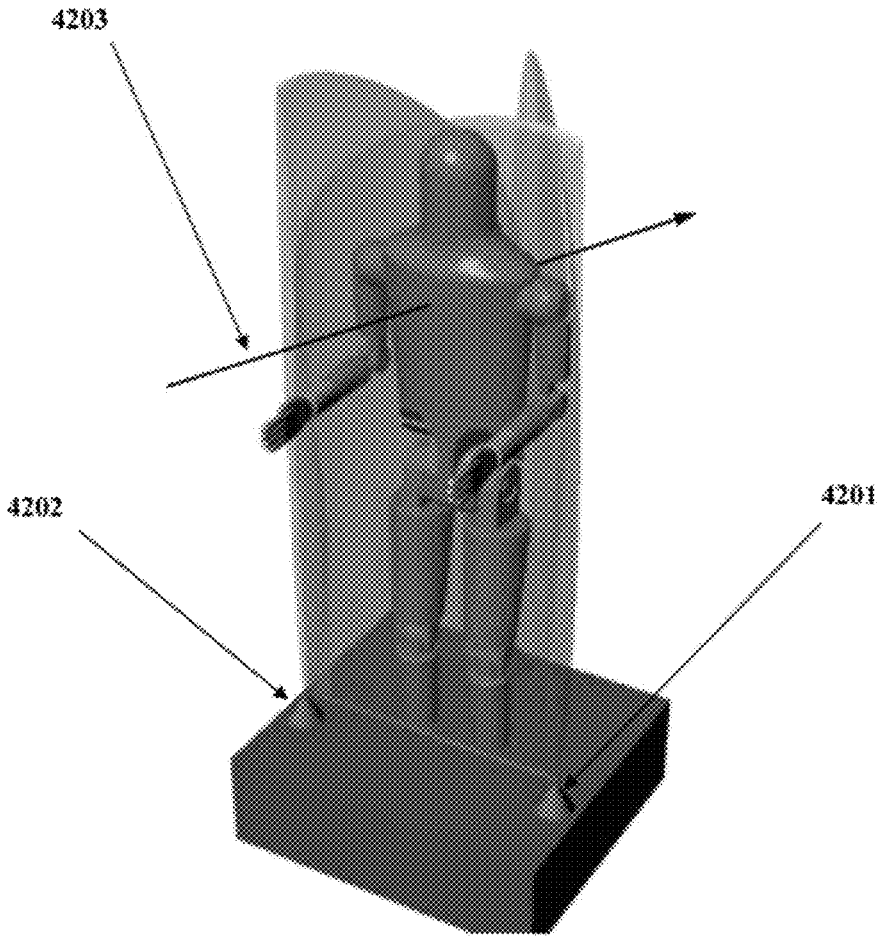
Figure 42: Mannequin Non Contact LIDAR HD Sensors Isometric View

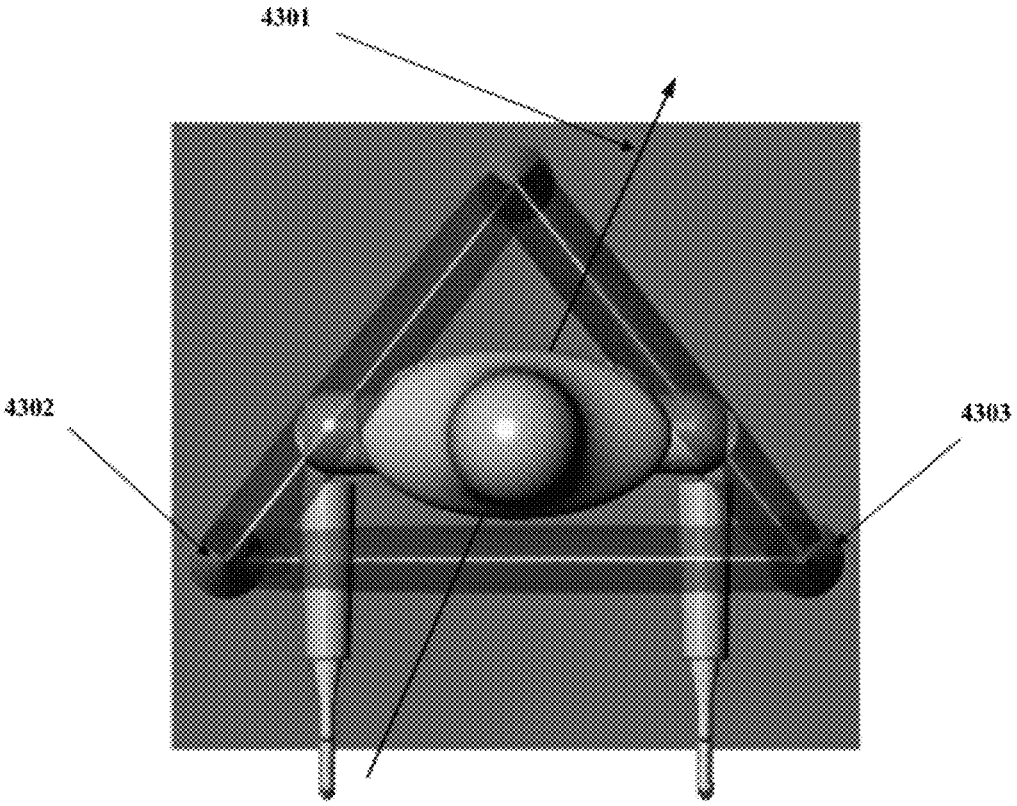
Figure 43: Mannequin Non Contact LIDAR HD Sensors Top View

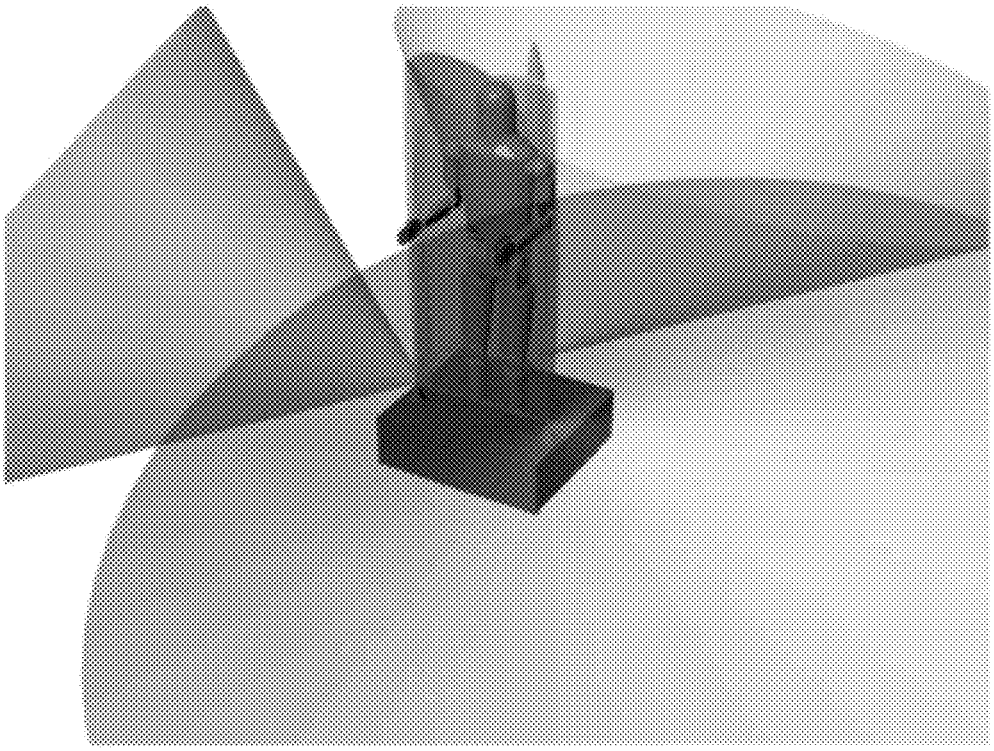
Figure 44: Mannequin Non Contact LIDAR SA & HD Sensors Isometric View

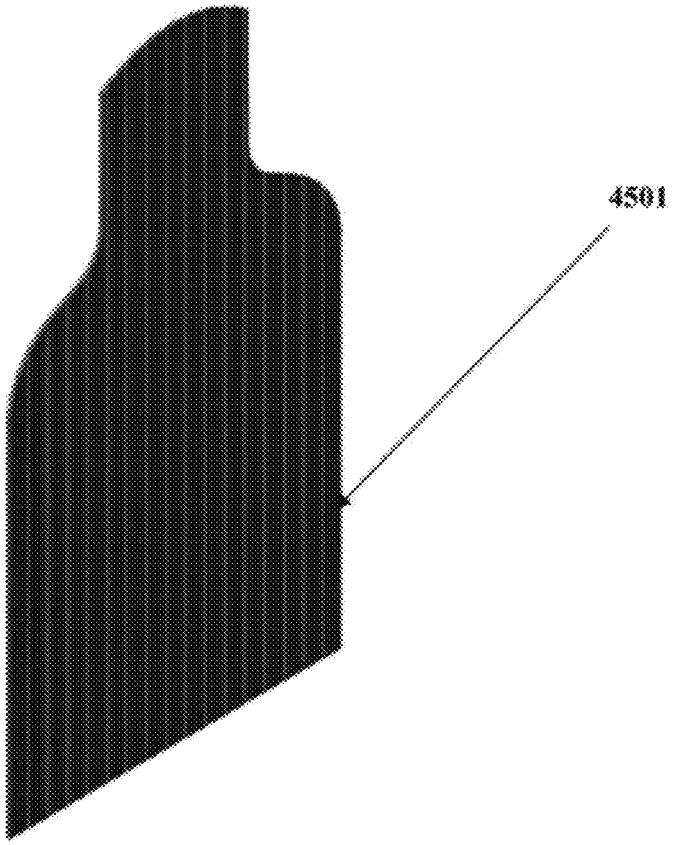
Figure 45: Short Circuit LOMAH Target Front Isometric View

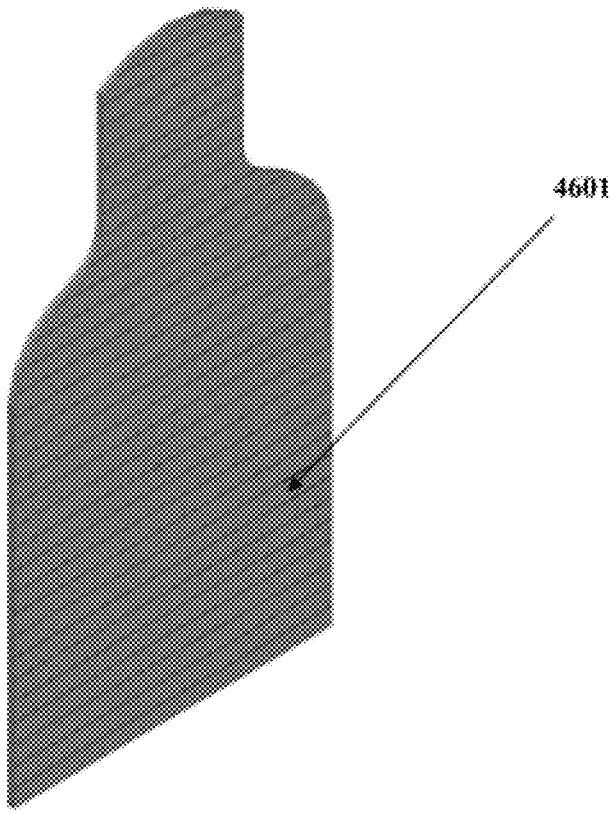
Figure 46: Short Circuit LOMAH Target Back Isometric View

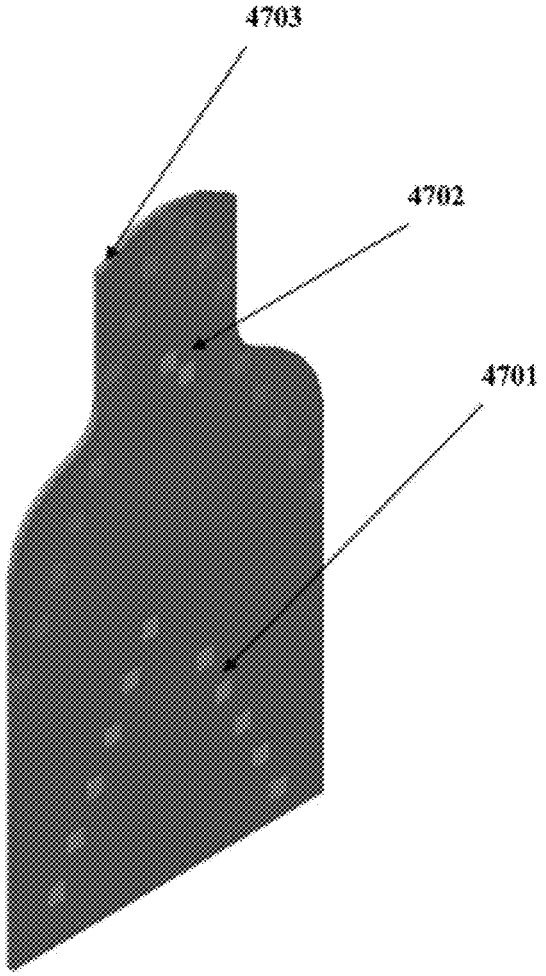
Figure 47: Short Circuit LOMAH Target Row Contact Pads Isometric View

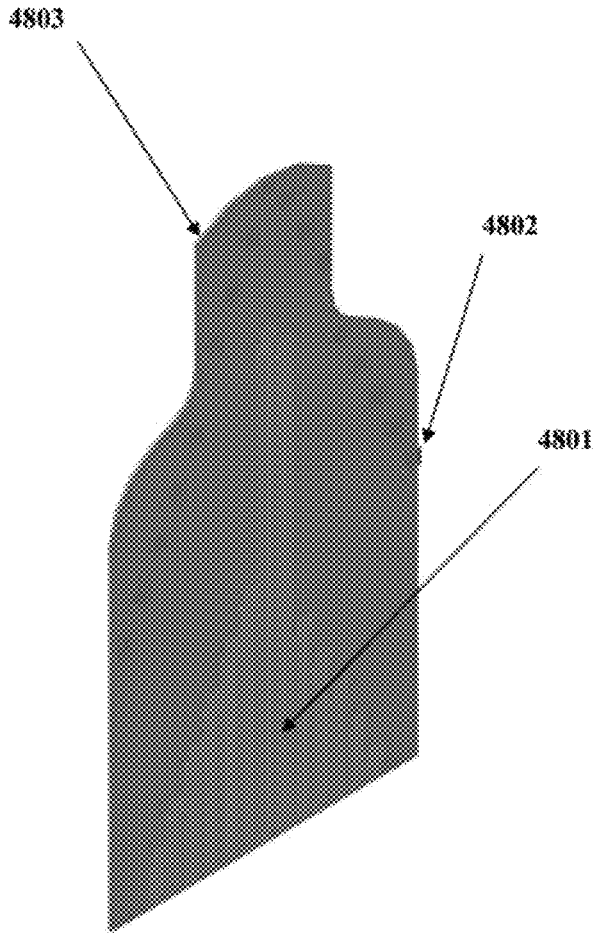
Figure 48: Short Circuit LOMAH Target Row Contact Pads 2nd Layer Isometric View

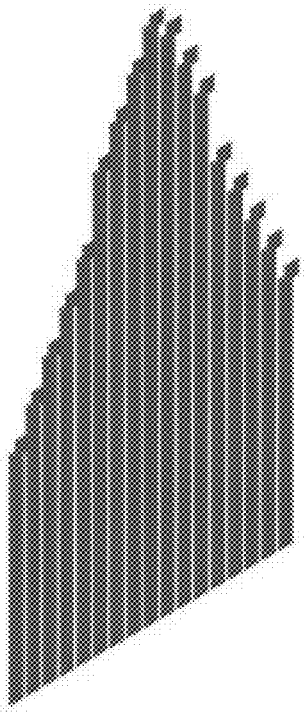
Figure 49: Short Circuit LOMAH Target Row Contact Pads 3rd Layer Isometric View

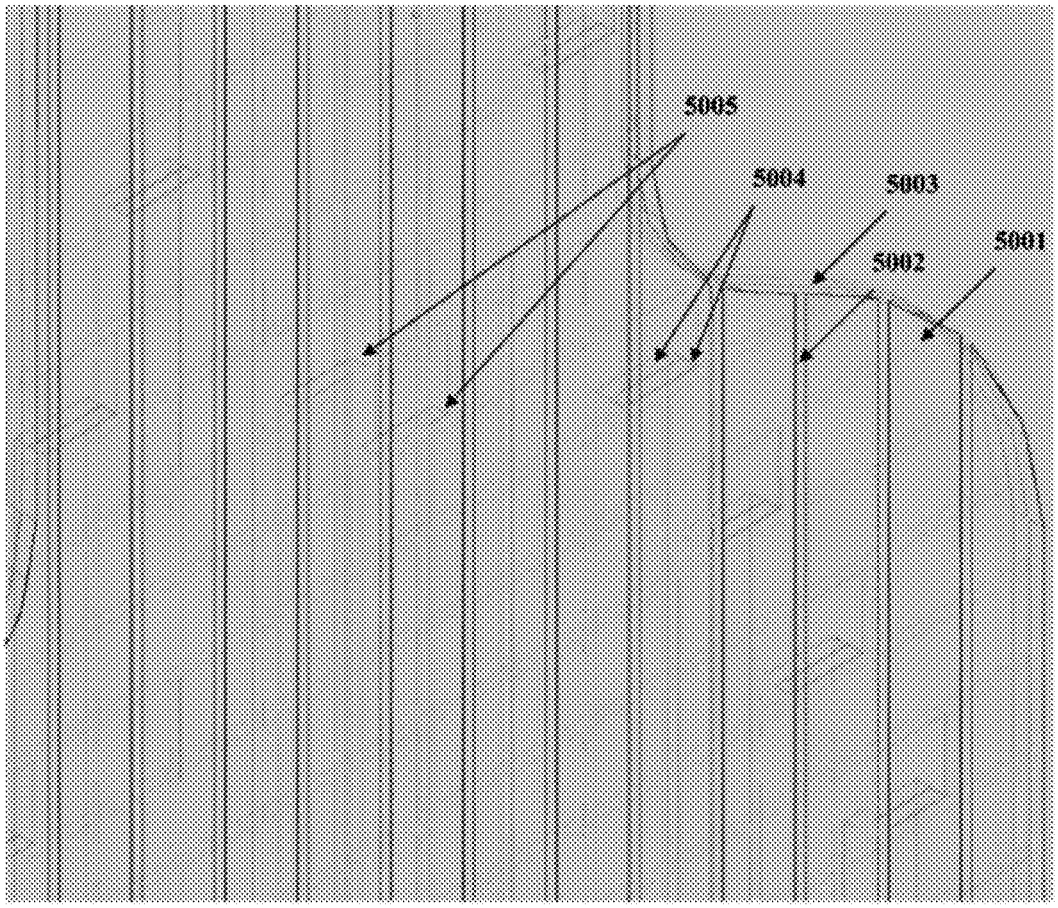
Figure 50: Short Circuit LOMAH Target Row Contact Pads 3rd Layer Isometric 2D Wire View

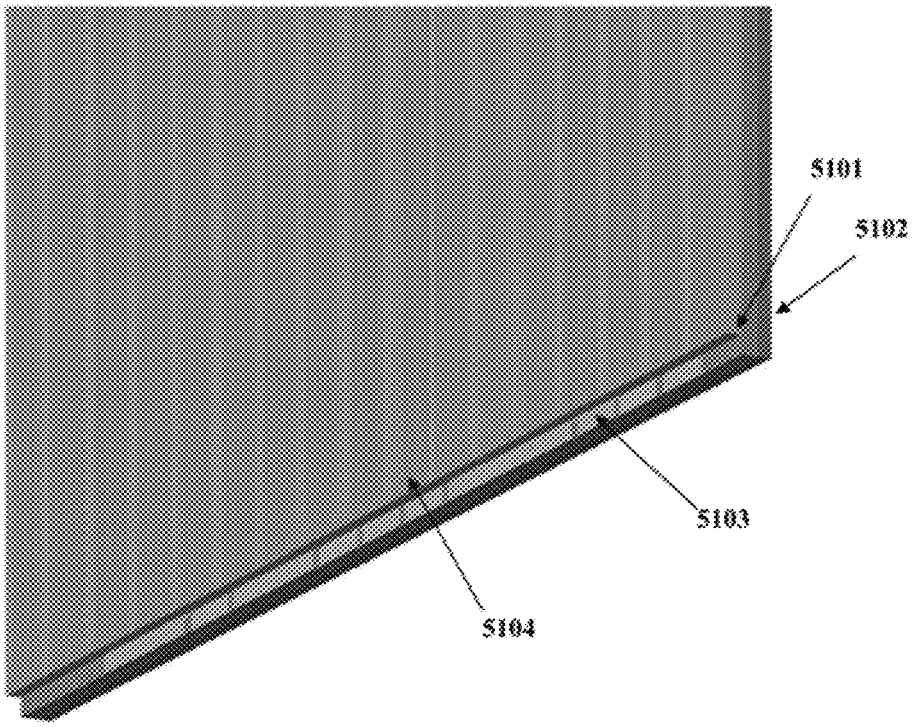
Figure 51: Short Circuit LOMAH Target Row Bottom Contact Pads Isometric View

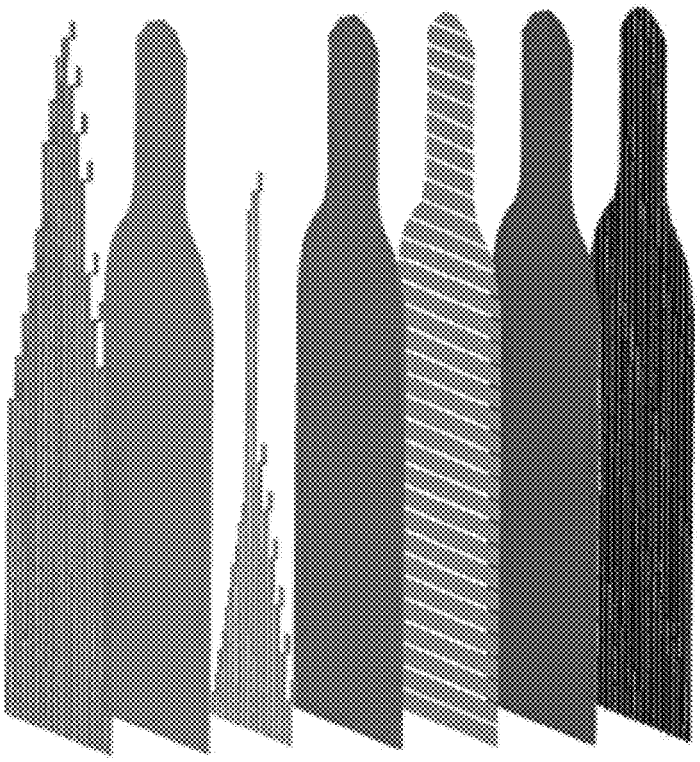
Figure 52: Short Circuit LOMAH Target Exploded Diagram Isometric View

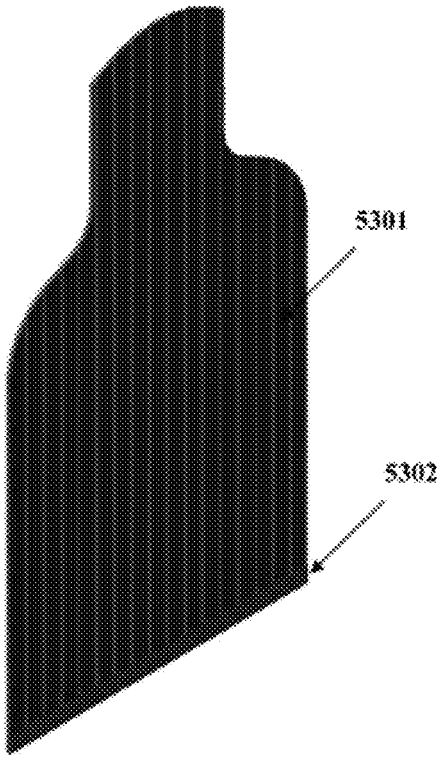
Figure 53: Short Circuit LOMAH Target Front Columns with Resistive Rubber Isometric View

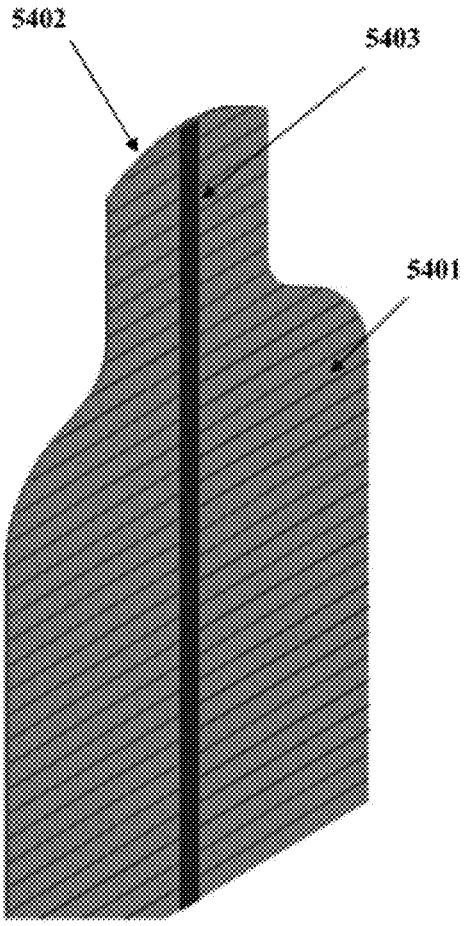
Figure 54: Short Circuit LOMAH Target Back Rows with Resistive Rubber Isometric View

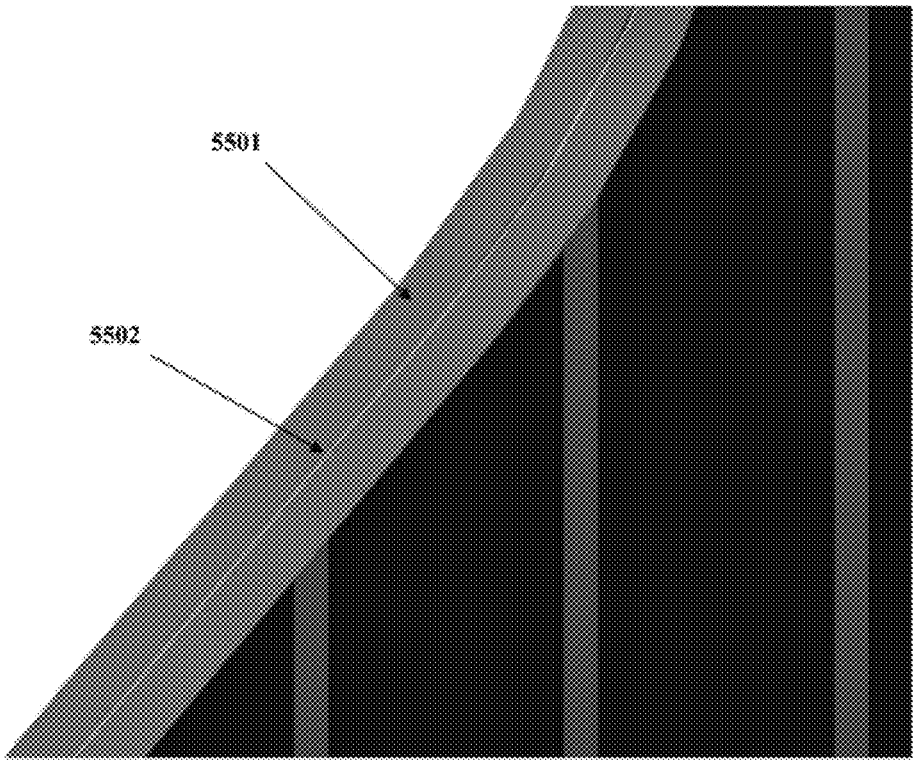
Figure 55: Short Circuit LOMAH Target with Resistive Rubber & Center Foil Layer Isometric View

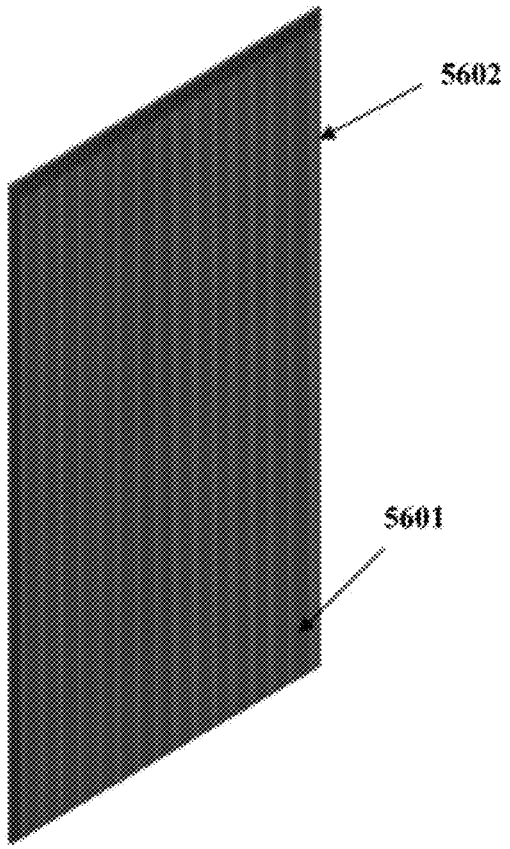
Figure 56: Resistive Trace LOMAH Target Front Columns Isometric View

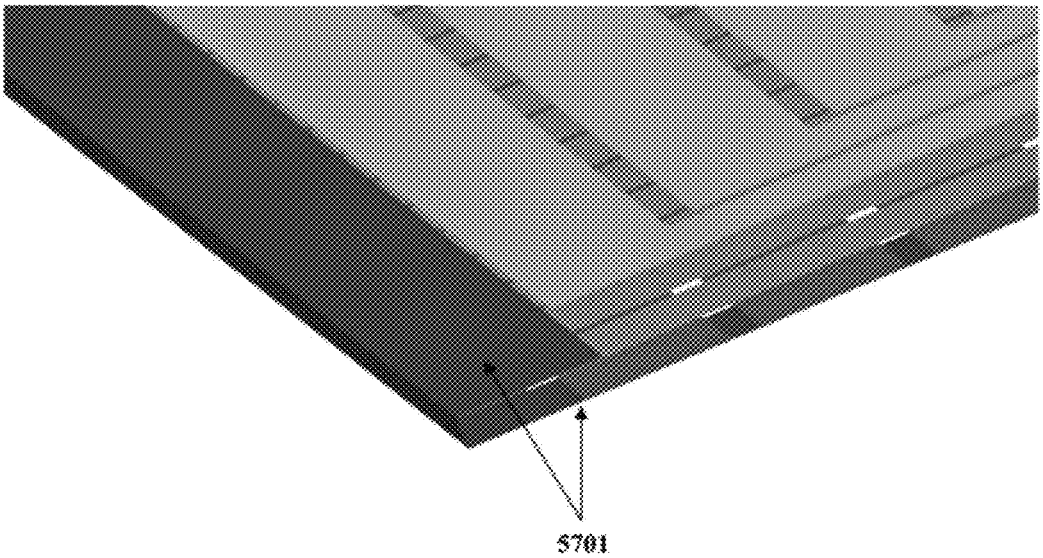
Figure 57: Resistive Trace LOMAH Target Single Power Buss Close-up Isometric View

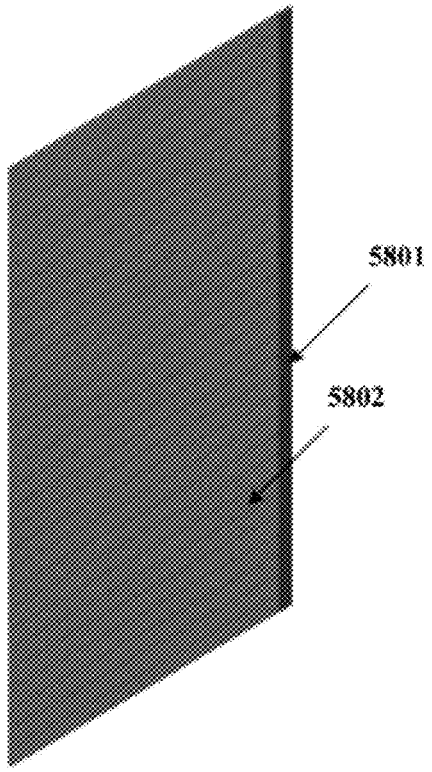
Figure 58: Resistive Trace LOMAH Target Back Rows Isometric View

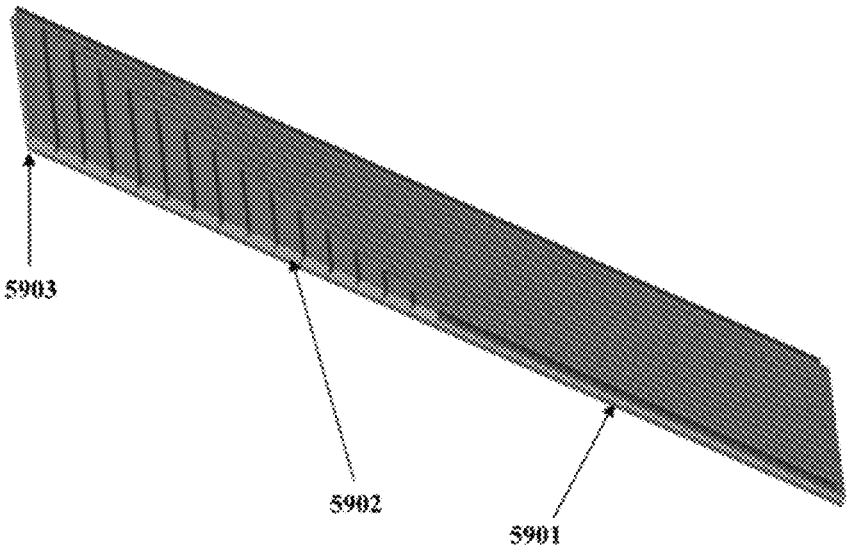
Figure 59: Resistive Trace LOMAH Target Right Side Isometric View

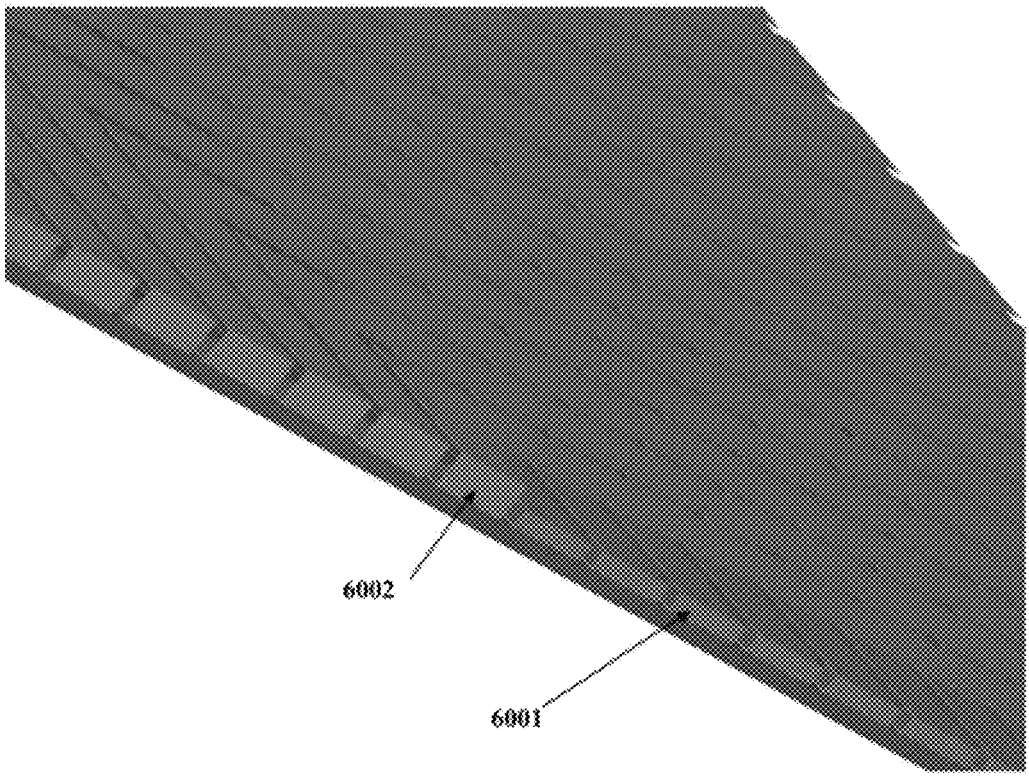
Figure 60: Resistive Trace LOMAH Target Close-up of Row Traces Isometric View

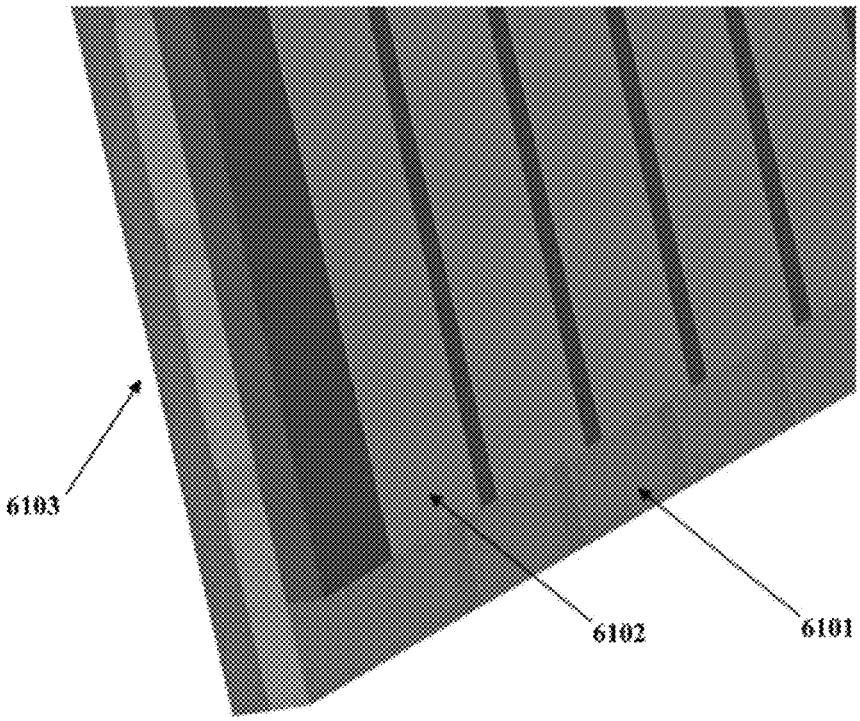
Figure 61: Resistive Trace LOMAH Target Close-up of Bottom Connection Isometric View

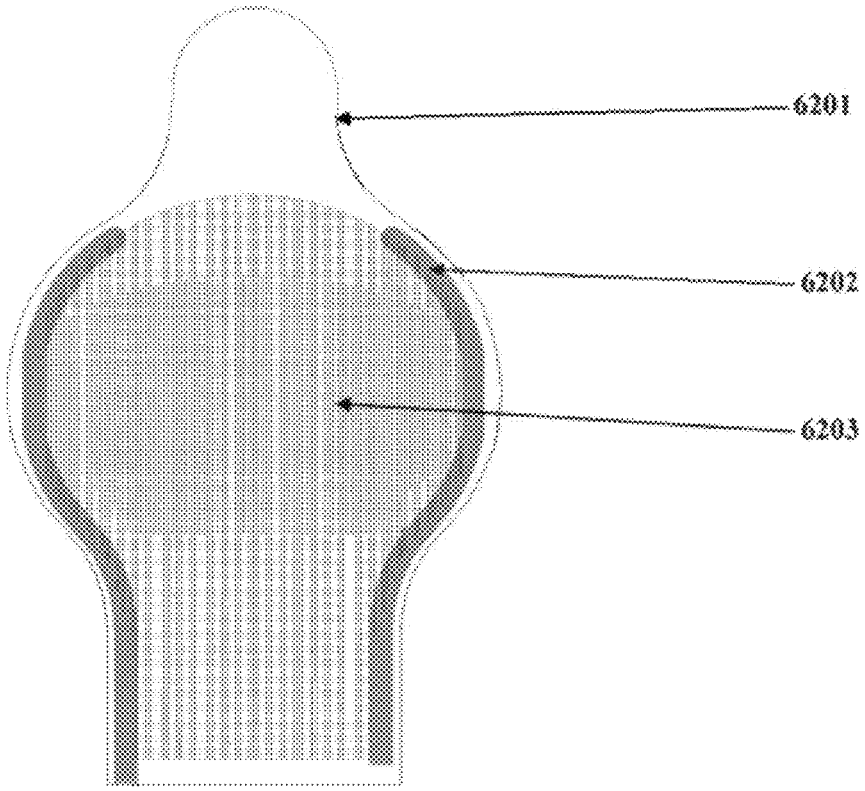
Figure 62: LOMA11 Resistive Sensor on Thin Plastic Non-Kill Zone Front View

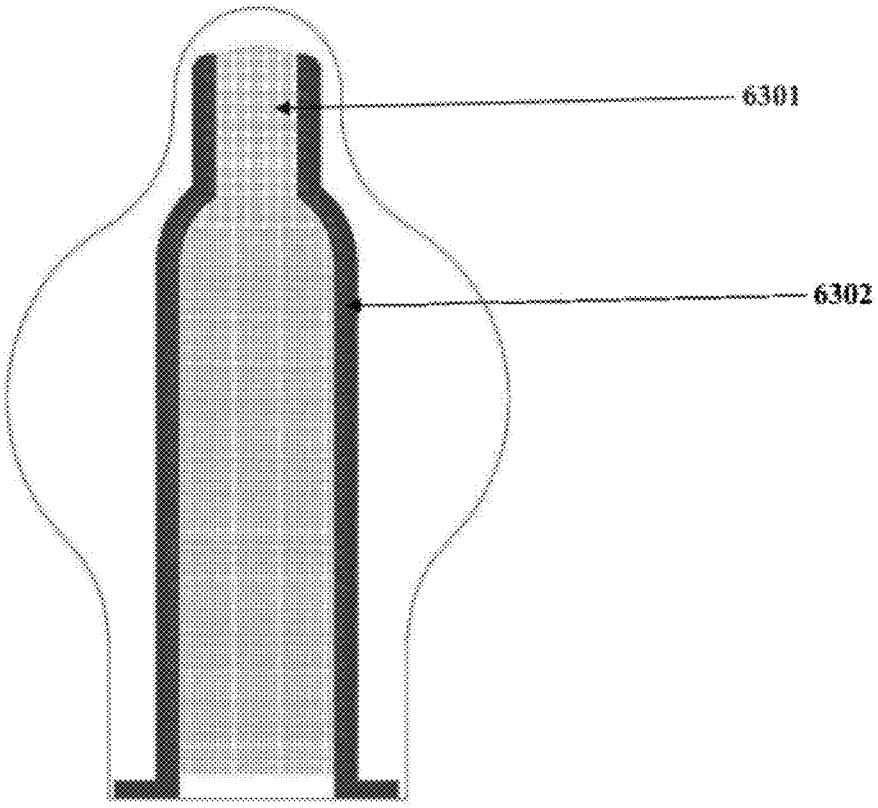
Figure 63: LOMAH Resistive Sensor on Thin Plastic Kill Zone Front View

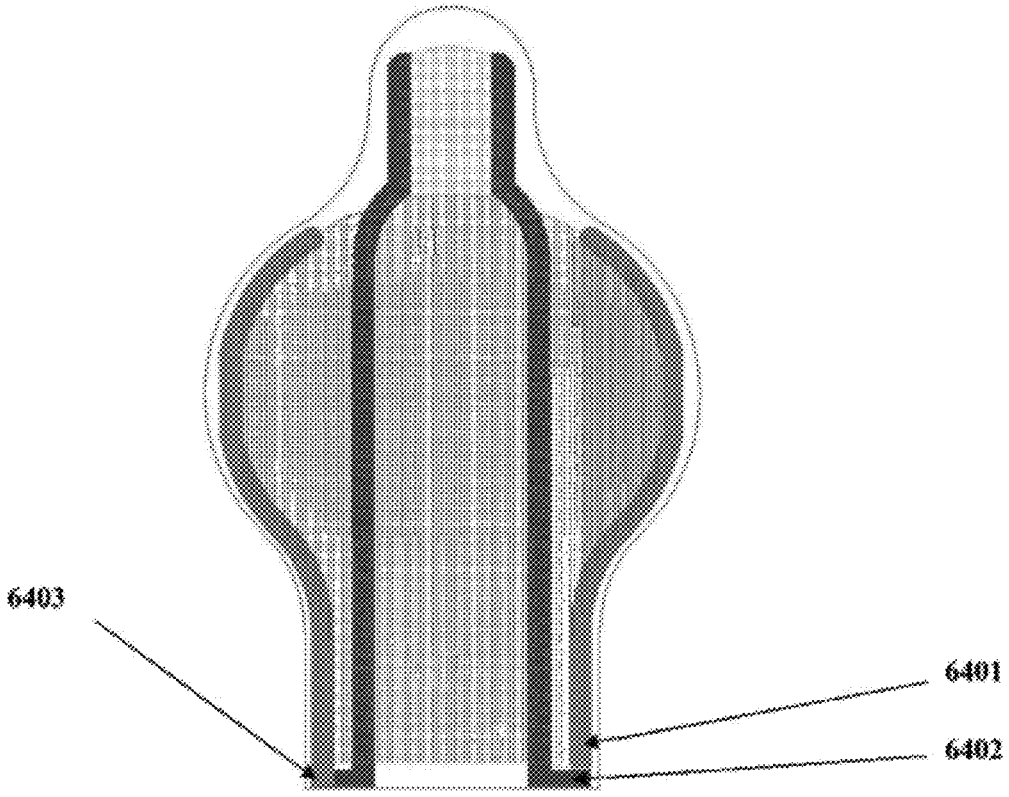
Figure 64: LOMAH Resistive Sensor on Thin Plastic Kill & Non-Kill Zone Front View

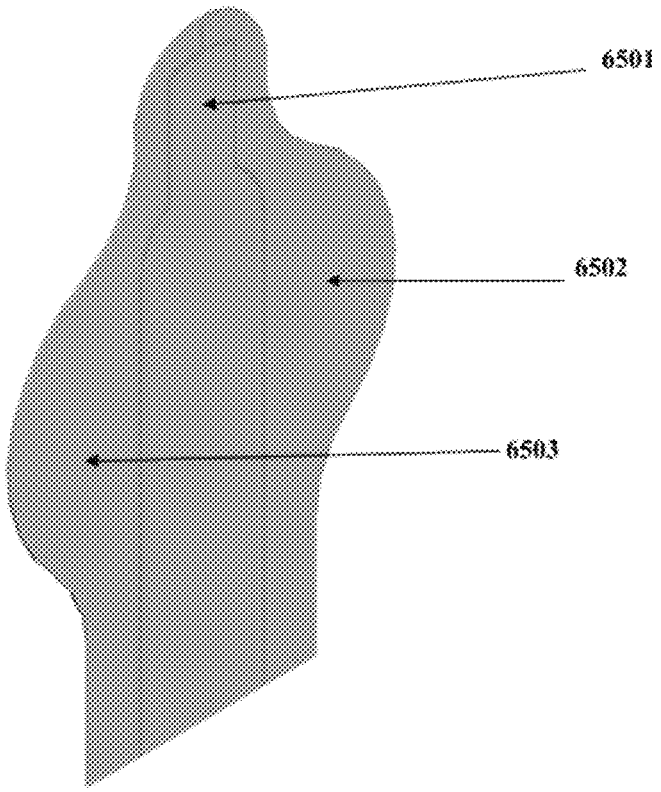
Figure 65: LOMAH Short Circuit Kill & Left/Right Non-Kill Zone Isometric View

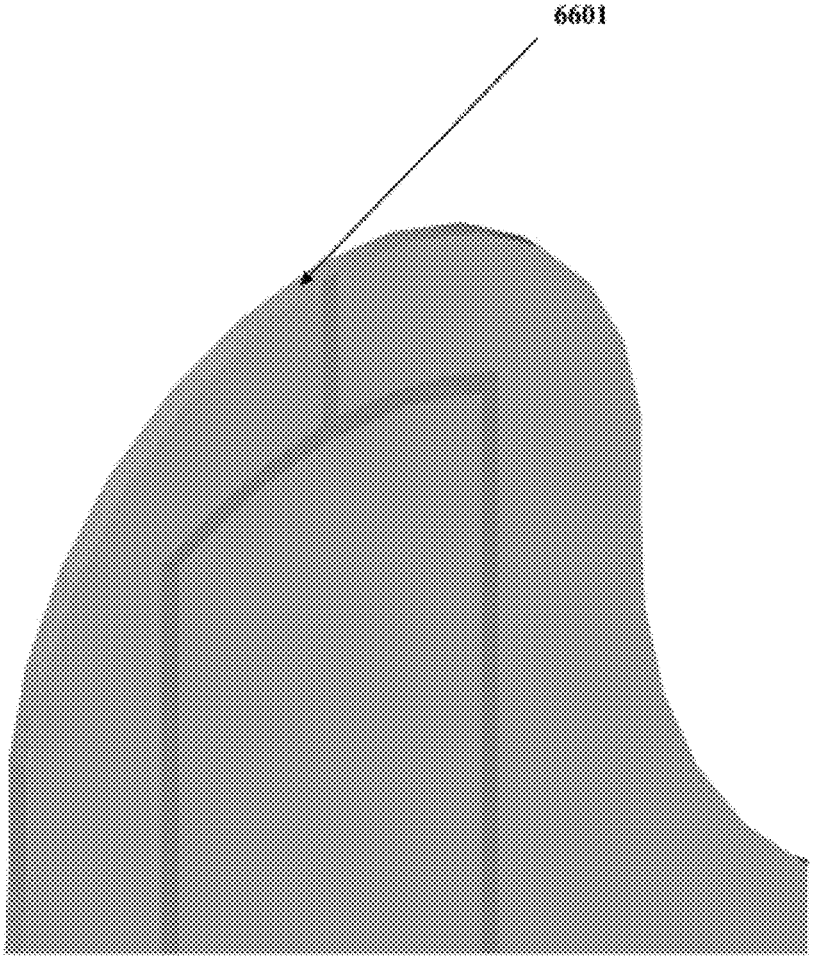
Figure 66: LOMAH Short Circuit Kill & Left/Right Non-Kill Zone Close Up Isometric View

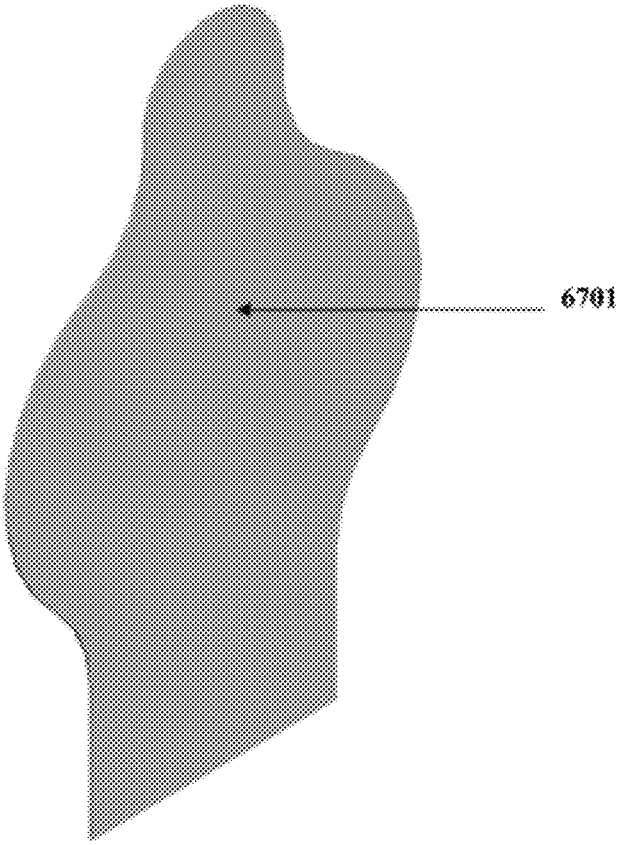
Figure 67: LOMAH Short Circuit Back Side Isometric View

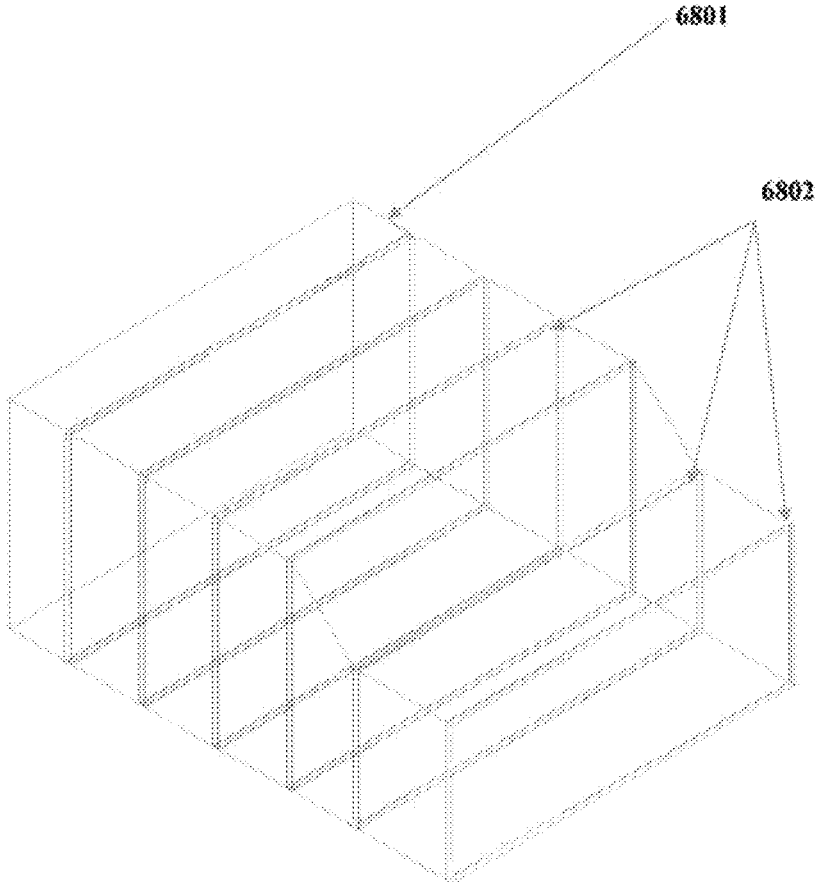
Figure 68: LOMAH Short Circuit Aerial or Escalation of Force Target 3D Wire Isometric View

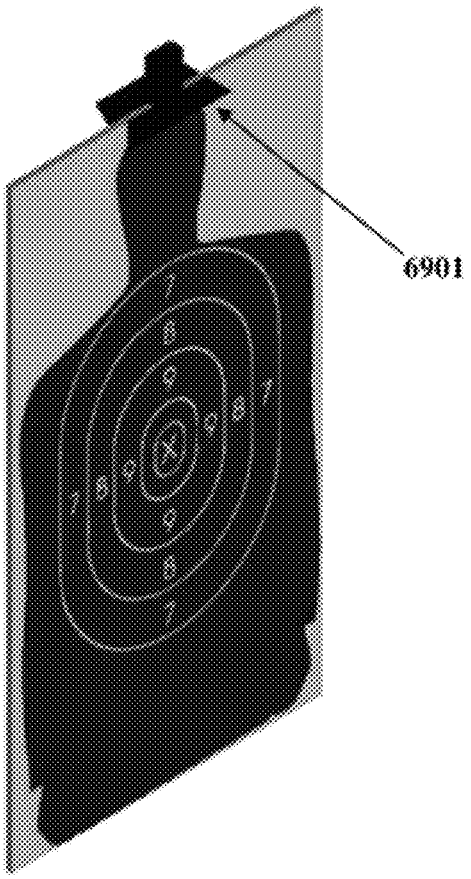
Figure 69: B27 Target on Lane Runner Clamp Isometric View

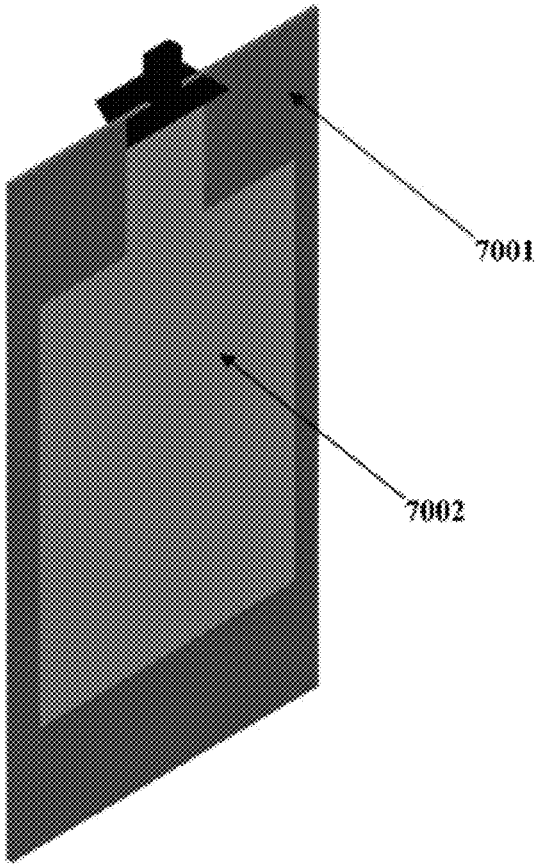
Figure 70: B27 Target Foil Faceplate Isometric View

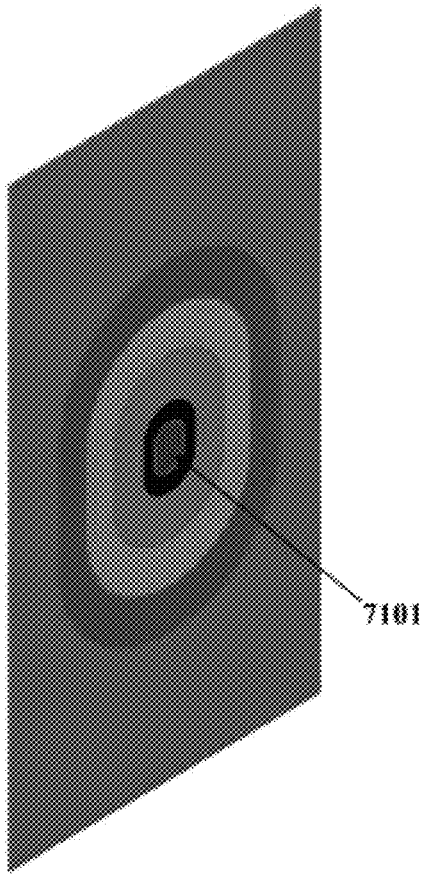
Figure 71: B27 Target Middle Layer Foil Rings Isometric View

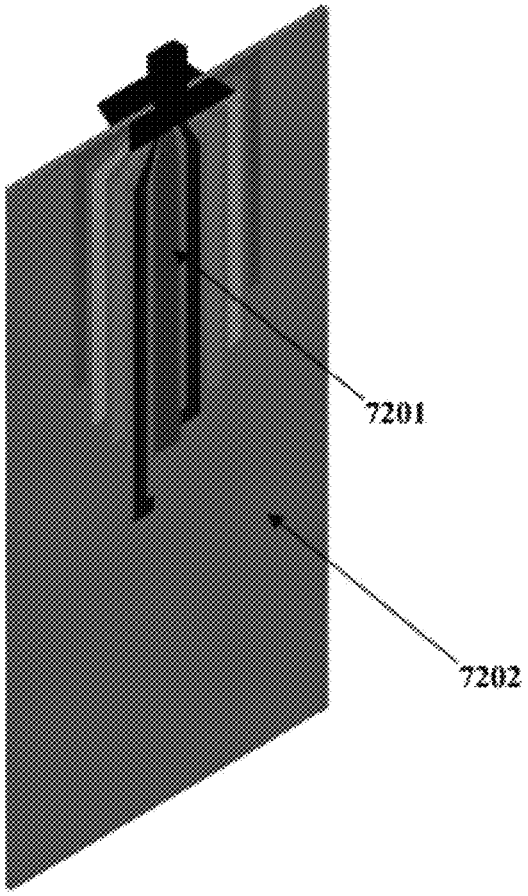
Figure 72: B27 Target Back Foil Pickup Traces Isometric View

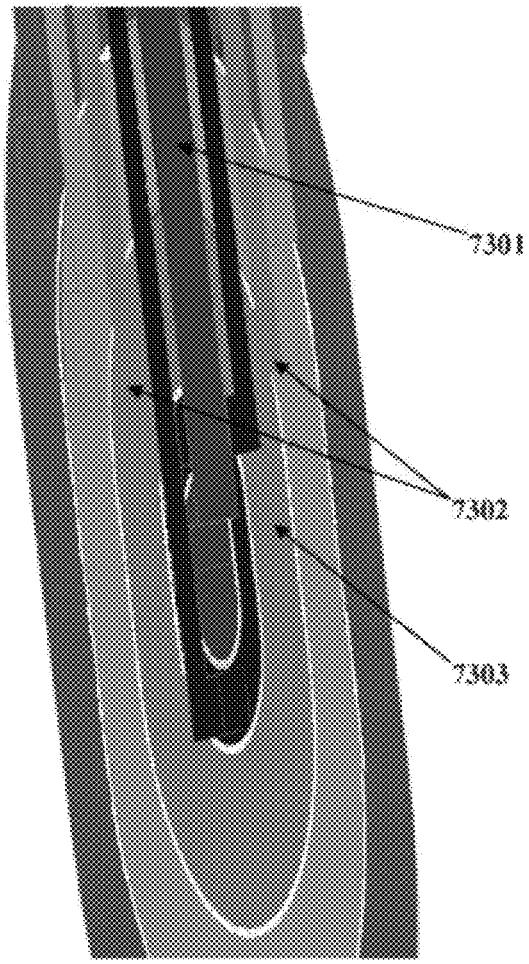
Figure 73: B27 Target Pickup Traces & Foil Rings Close-up Isometric View

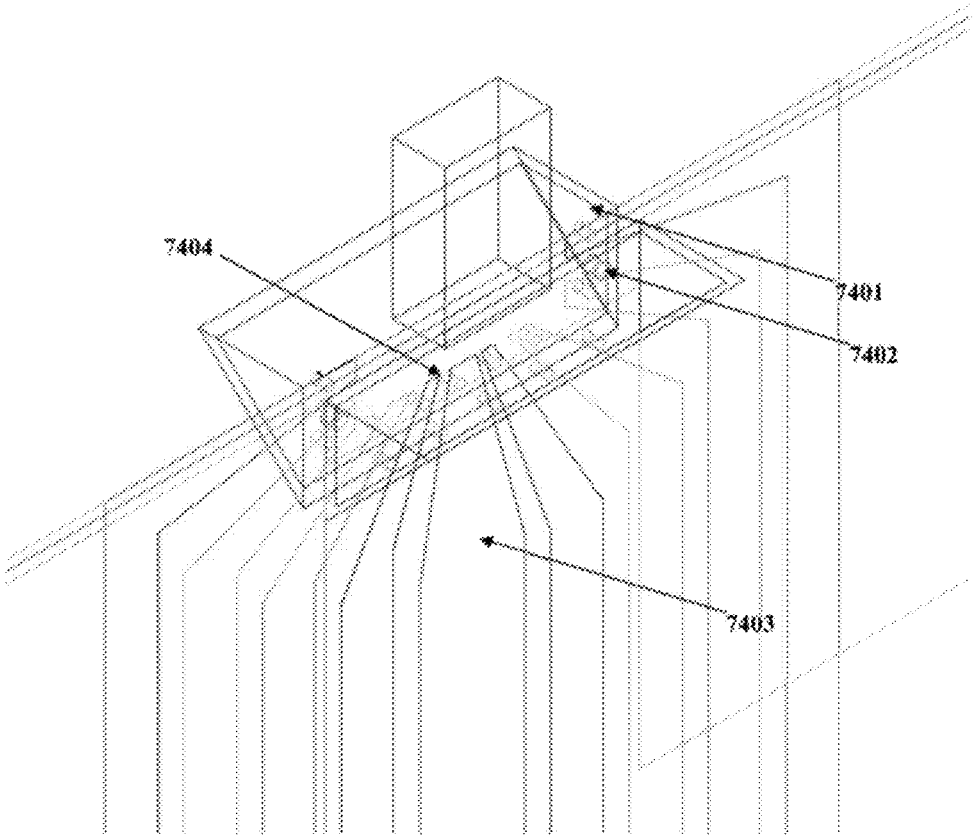
Figure 74: B27 Target Clamp, Pickup Pins & Traces Close-up 2D Wire Isometric View

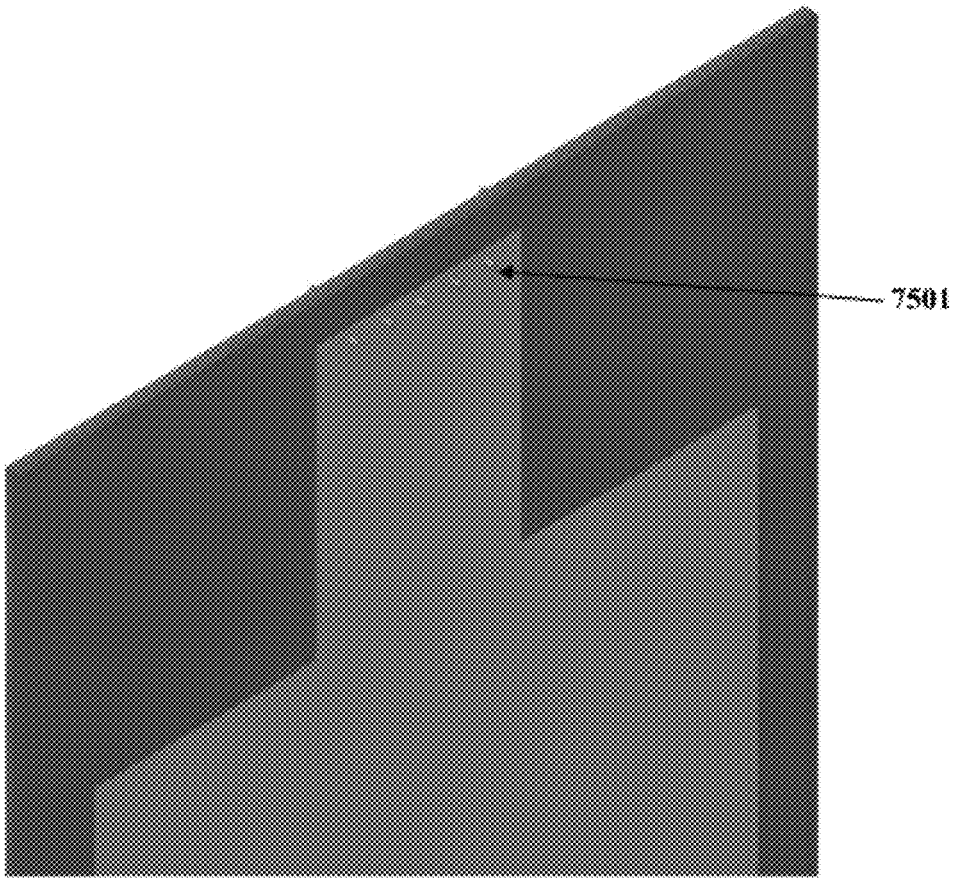
Figure 75: B27 Target Foil Faceplate Pickups Isometric View

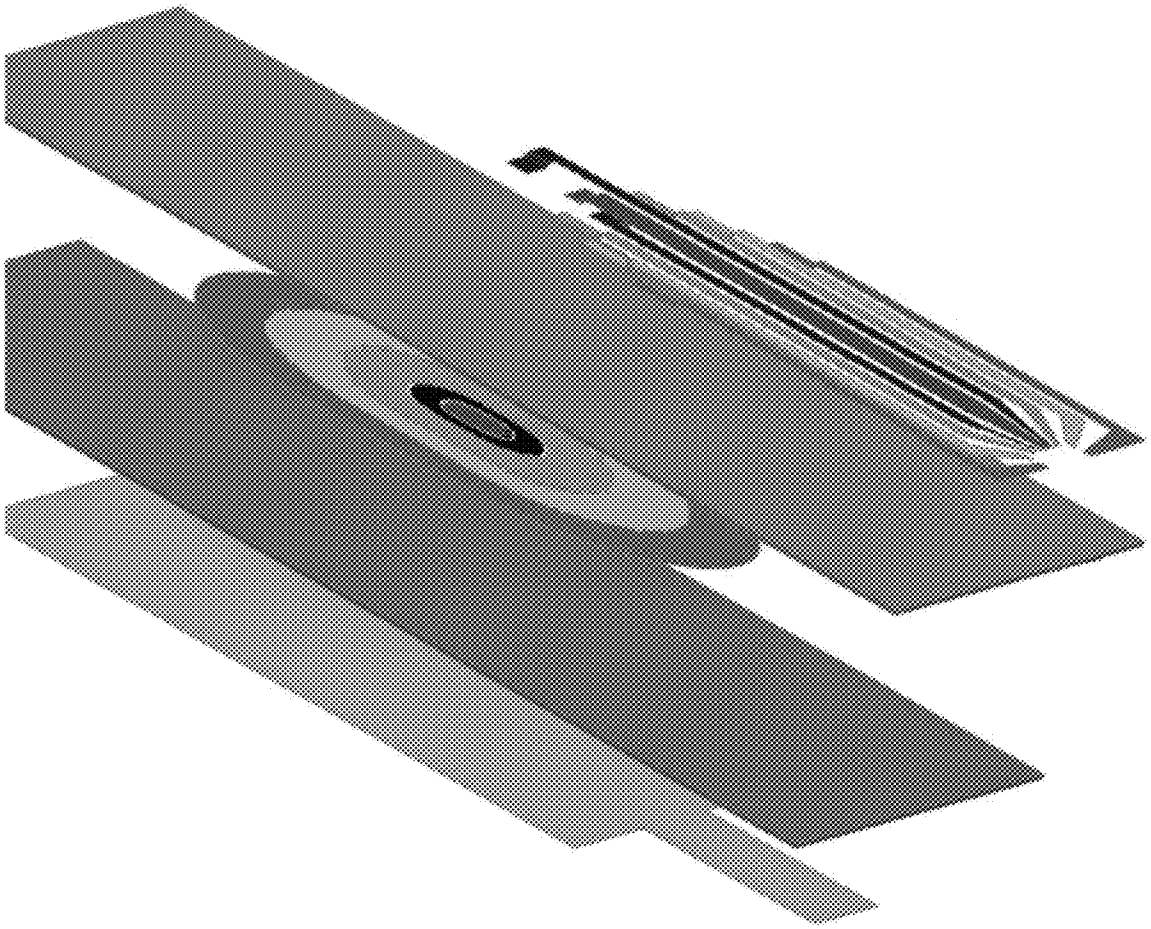
Figure 76: B27 Target Exploded Diagram Isometric View

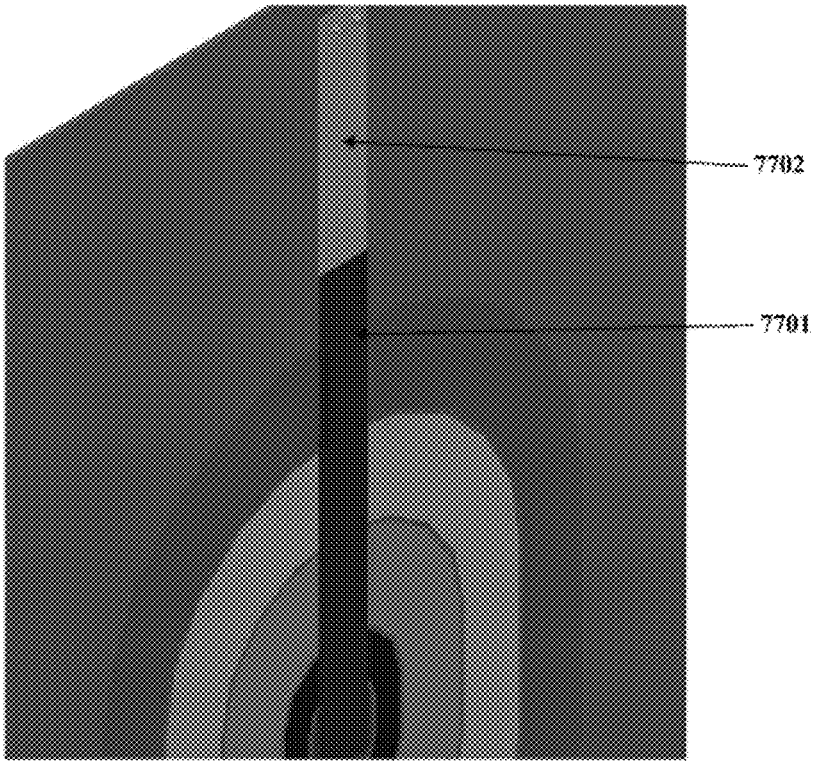
Figure 77: B27 Target Foil Rings Single Wire Pickup using Resistive Rubber Isometric View

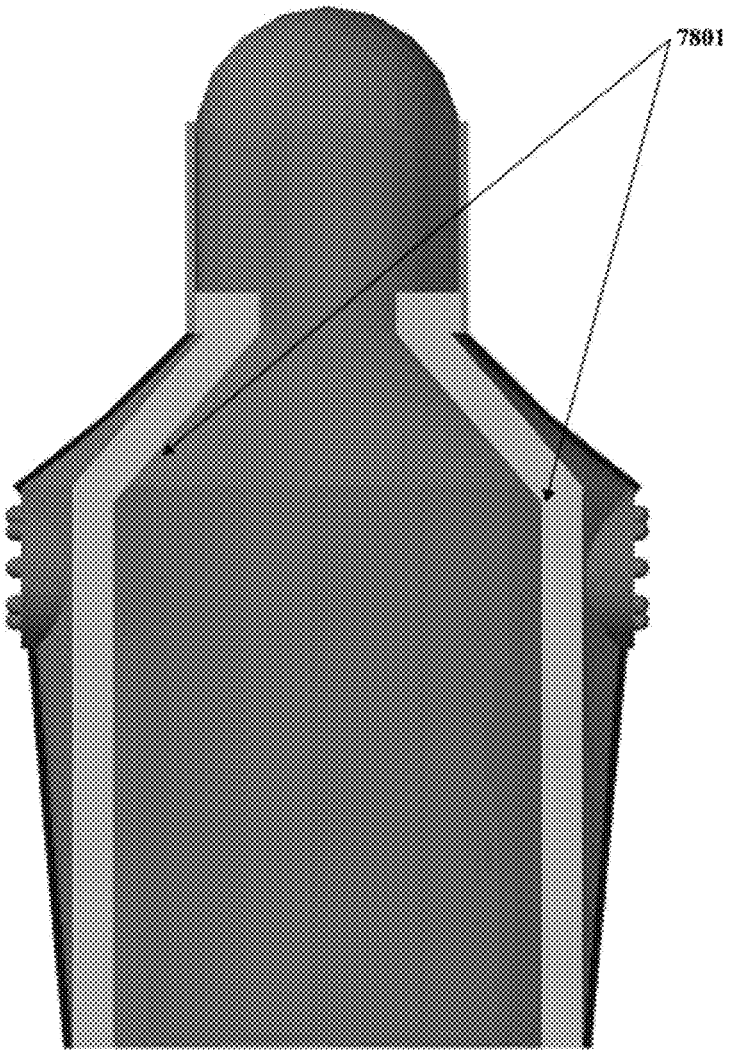
Figure 78: Backside of a mannequin torso with foil power buss strips for thermal heater membrane and/or impact detection sensors

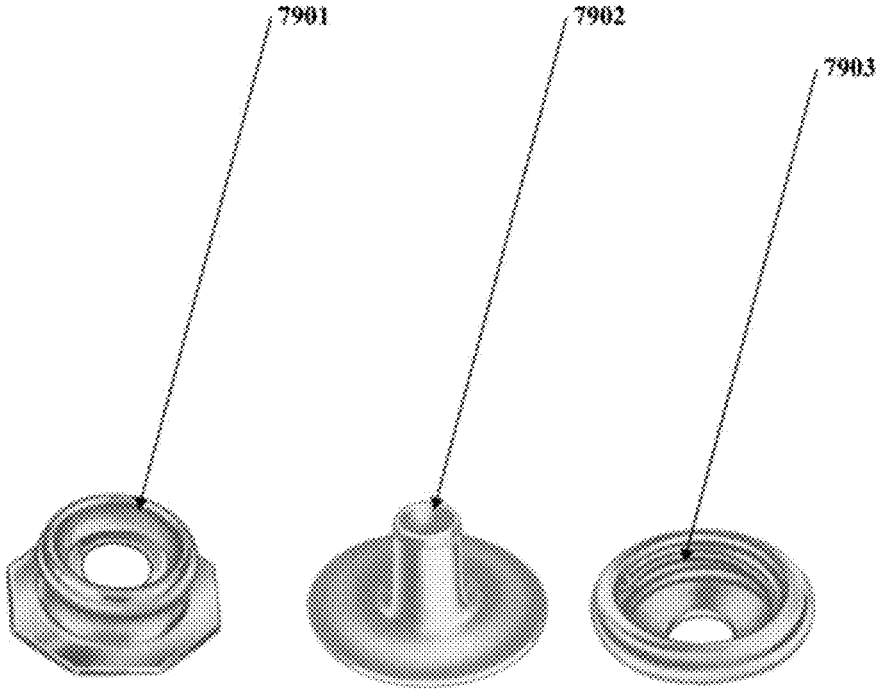
Figure 79: Picture of electrical snap connectors for conductive ink/foil base wiring harness

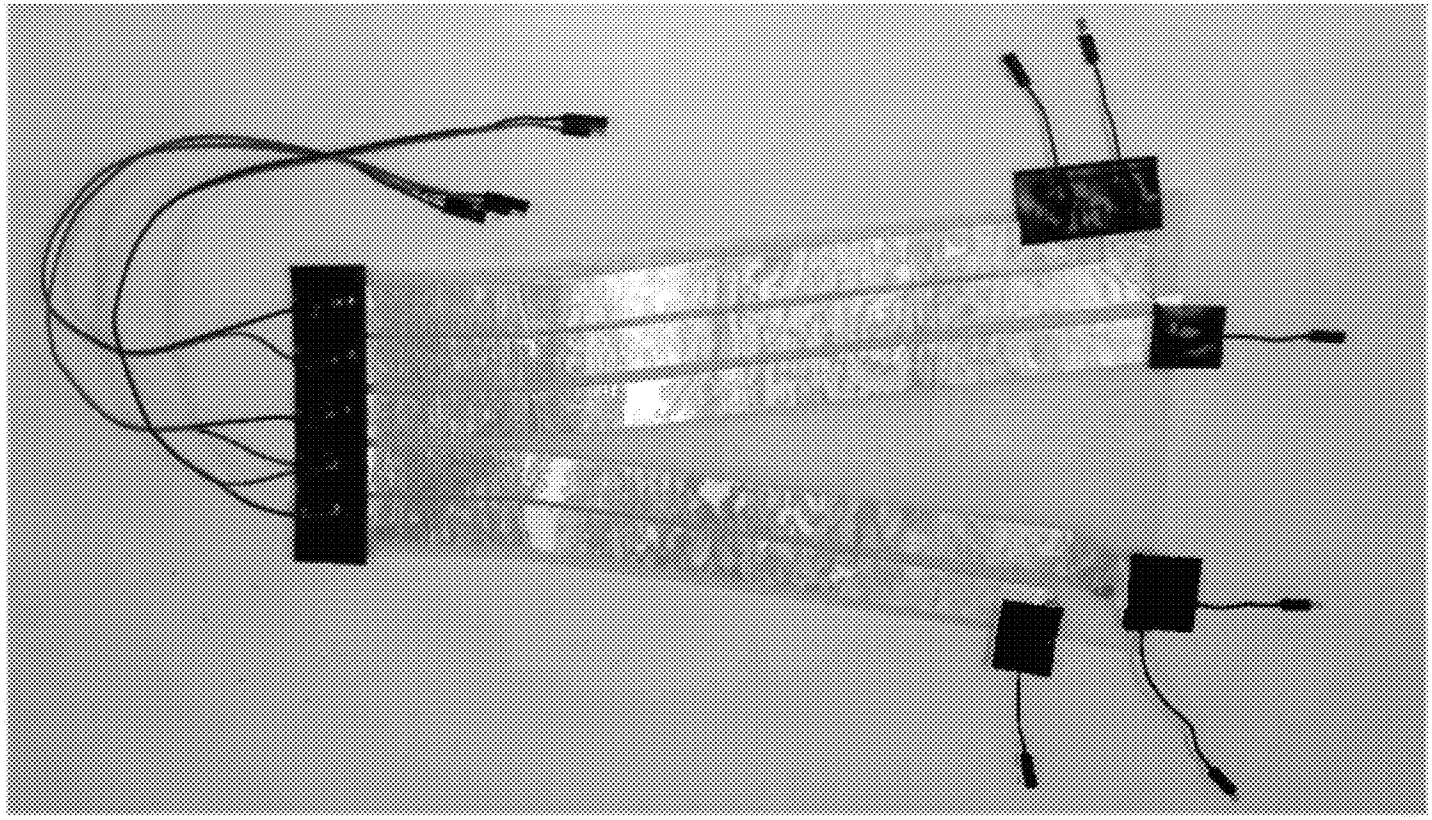
Figure 80: Picture of a foil base wiring harness

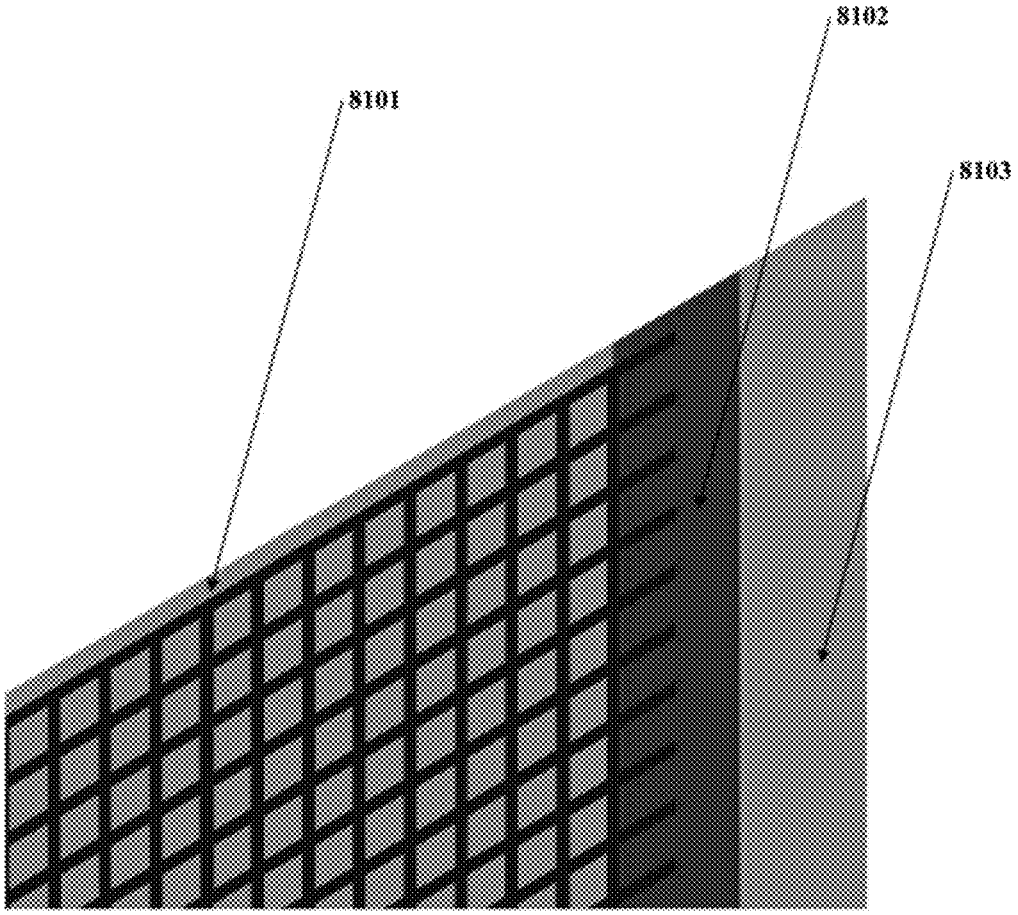
Figure 81: Resistive matrix thermal panel with solid conductive power busses

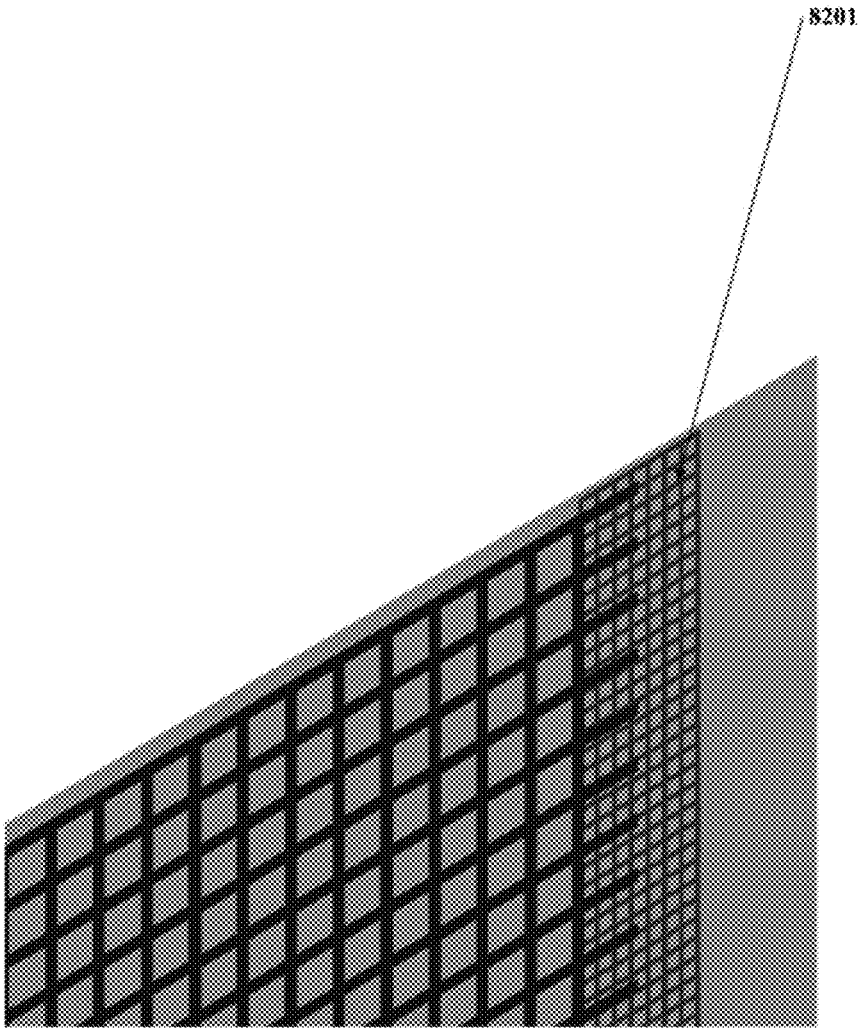
Figure 82: Resistive matrix thermal panel with matrix shaped conductive power busses

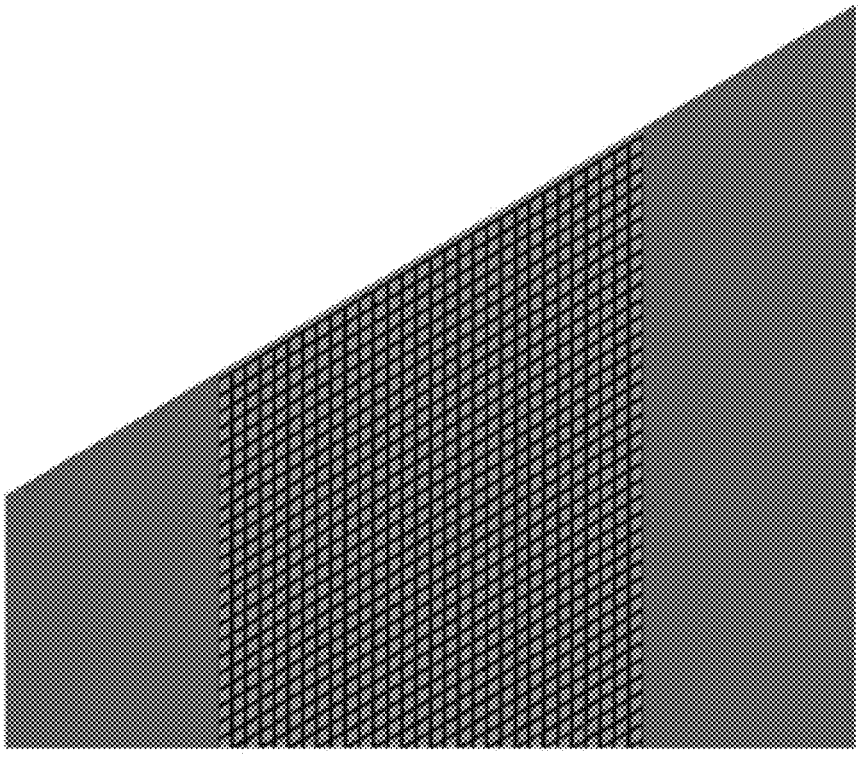
Figure 83: Resistive matrix thermal panel with foil strip power busses folded over back substrate

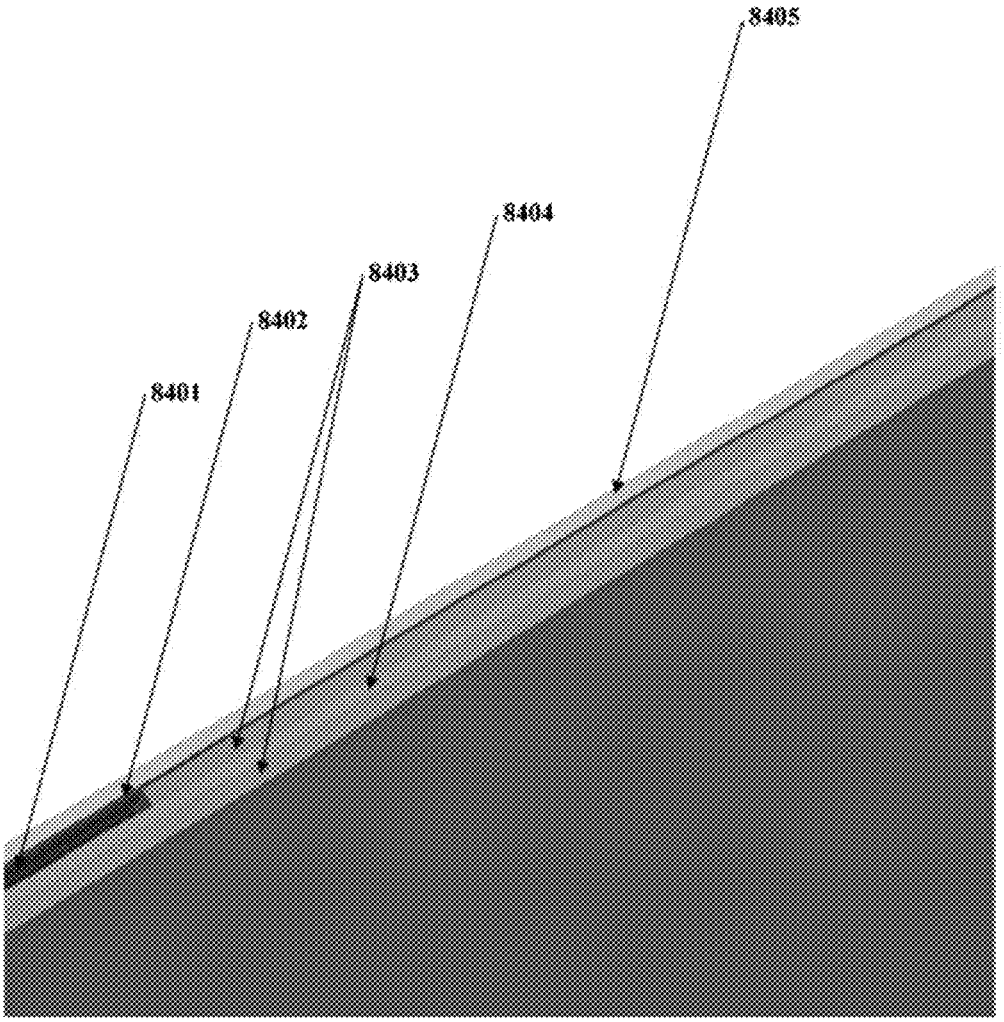
Figure 84: Close-up picture of a resistive matrix thermal panel with foil strips folded over

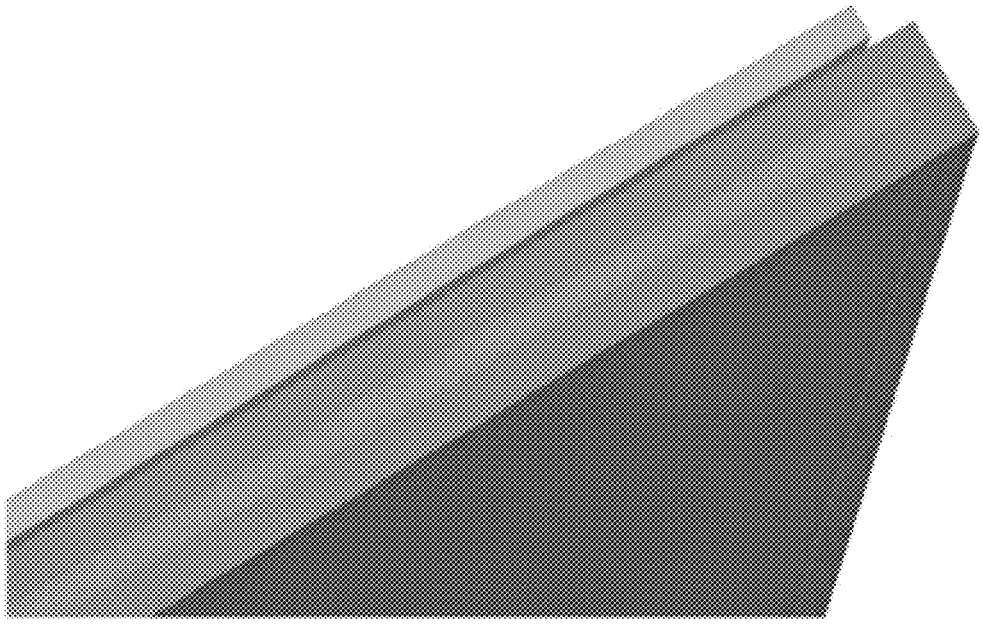
Figure 85: Close-up picture of the edge of a resistive matrix thermal panel with foil strips

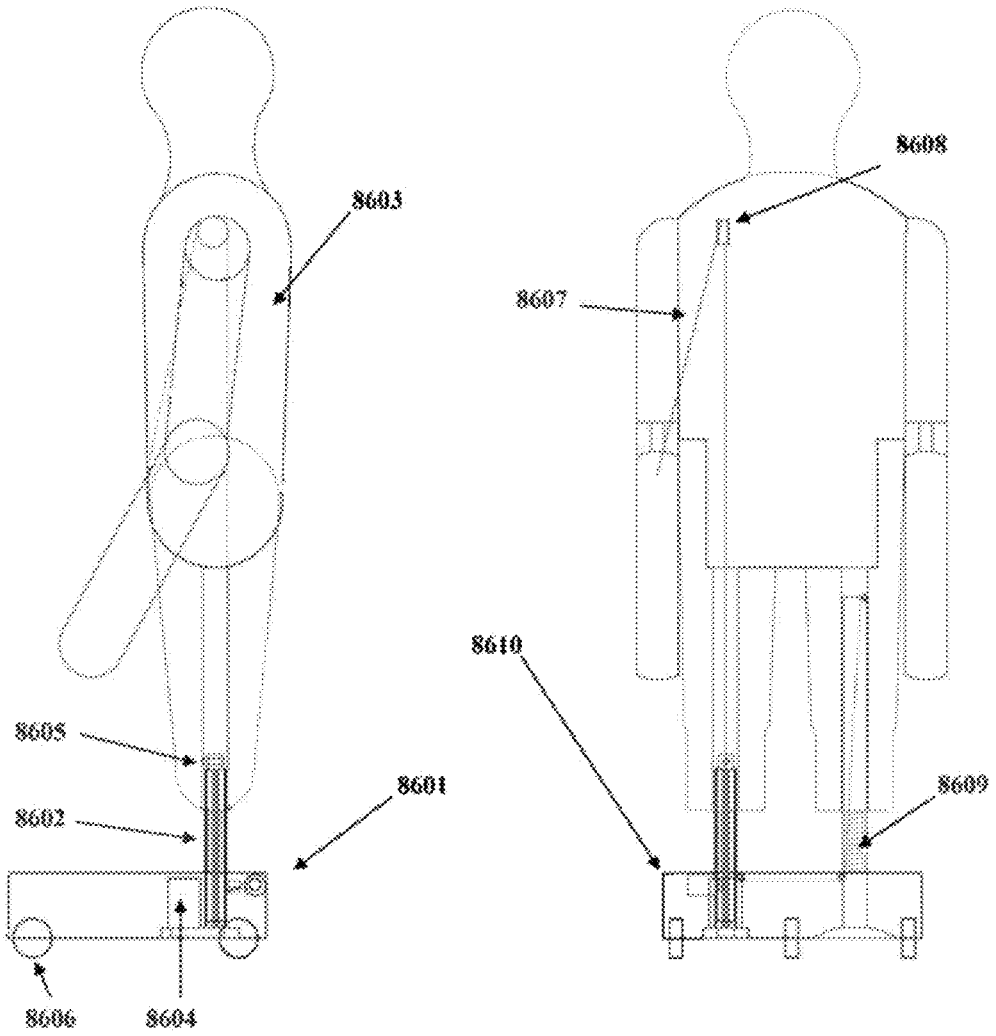
Figure 86: Side and front cross-sectional view of a retracted/lowered mannequin target system

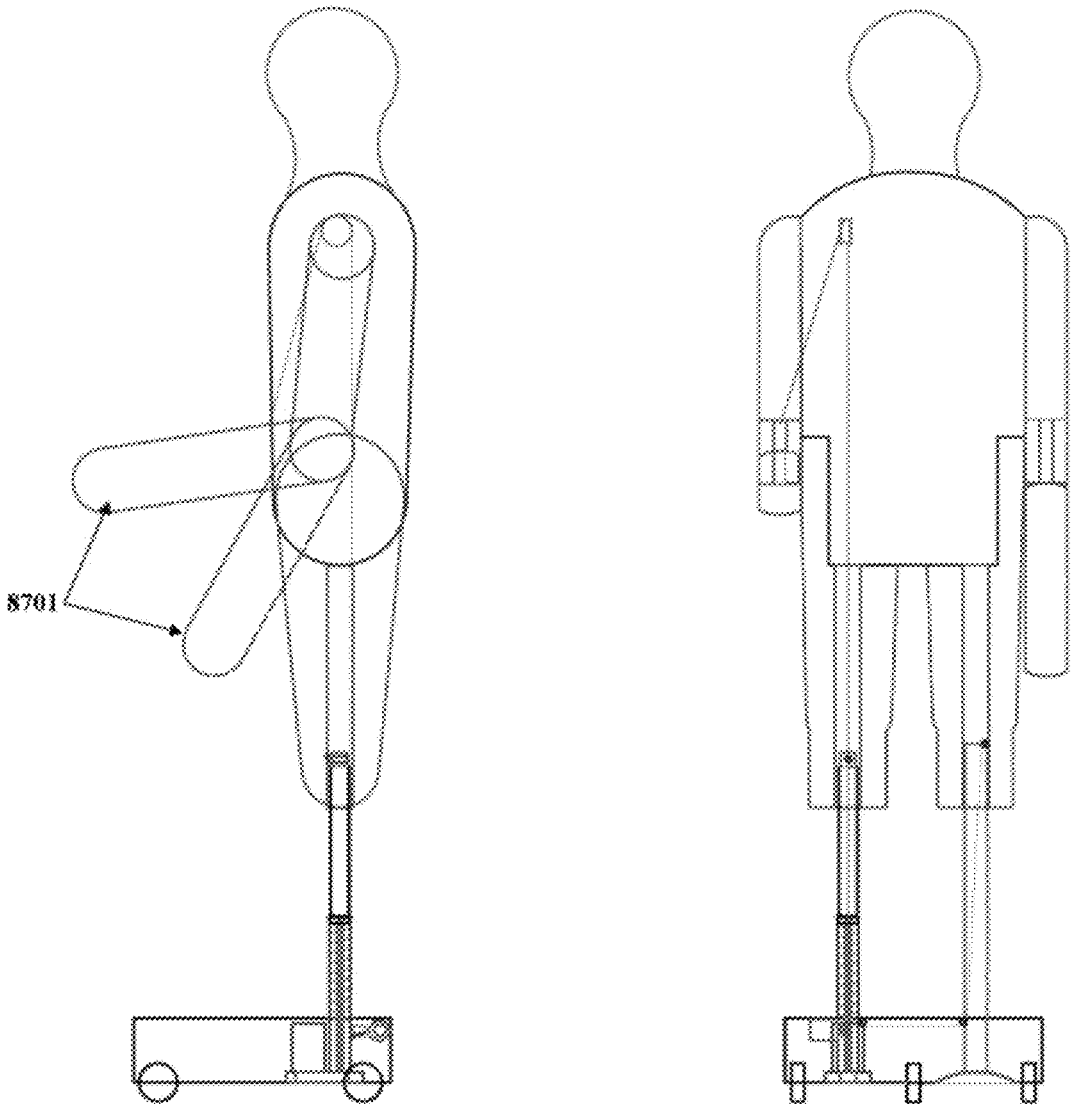
Figure 87: Side and front cross-sectional view of a raised mannequin target system

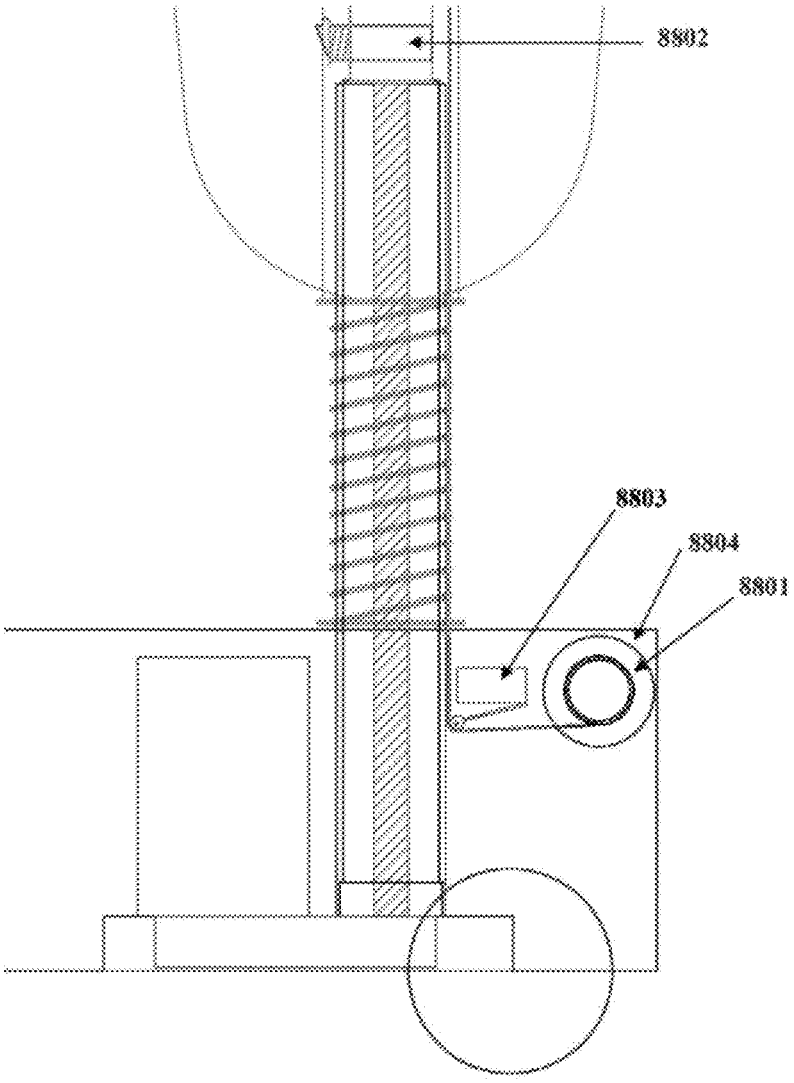
Figure 88: Side cross-sectional view of a lowered mannequin target system with arm and movement control.

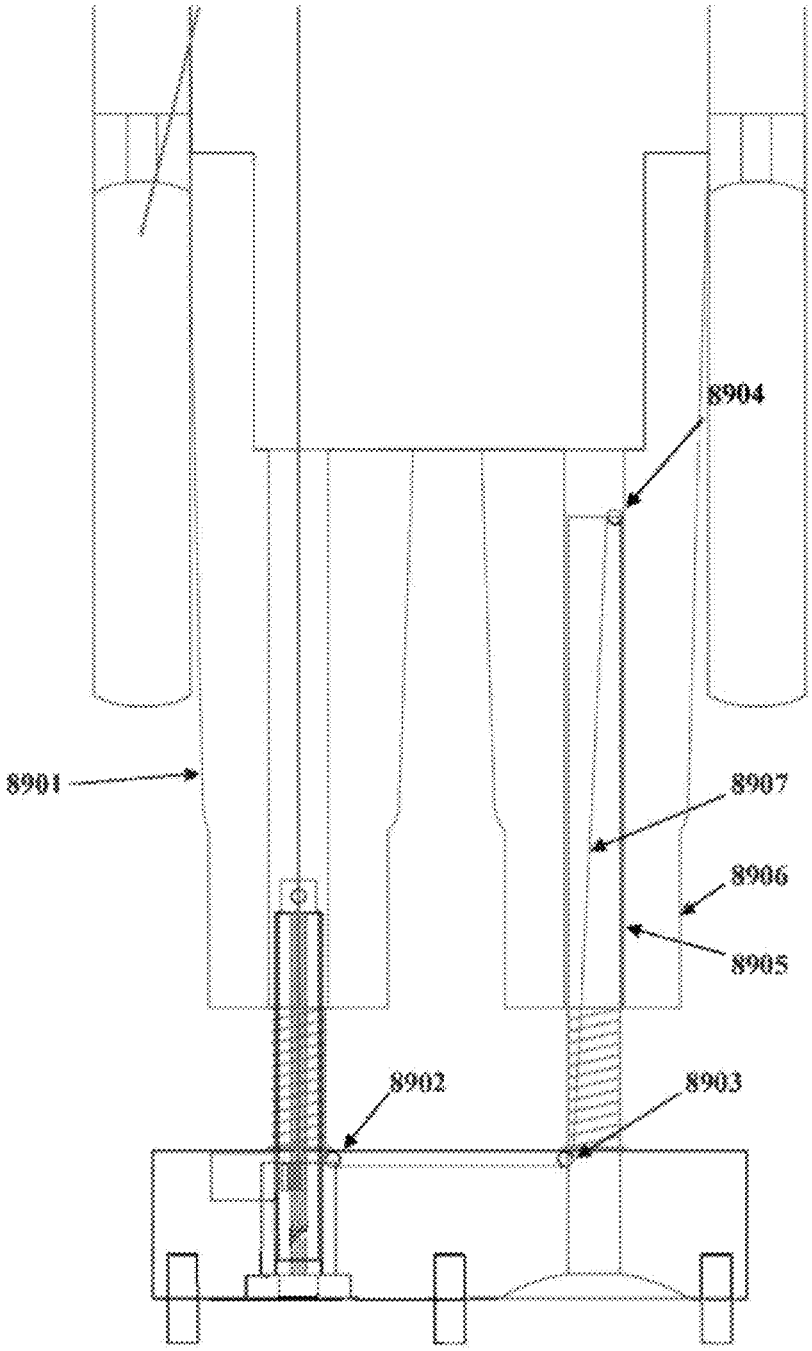
Figure 89: Front cross-sectional view of a lowered mobile mannequin target system

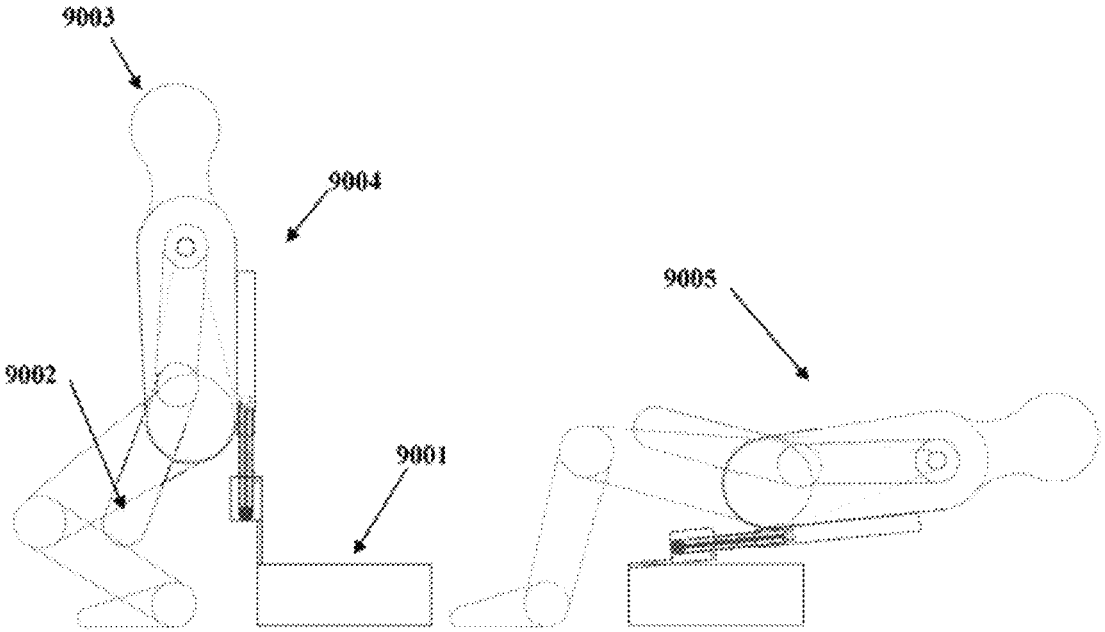
Figure 90: Side cross-sectional view of a sitting & concealed mannequin attached to a pop up target lifter

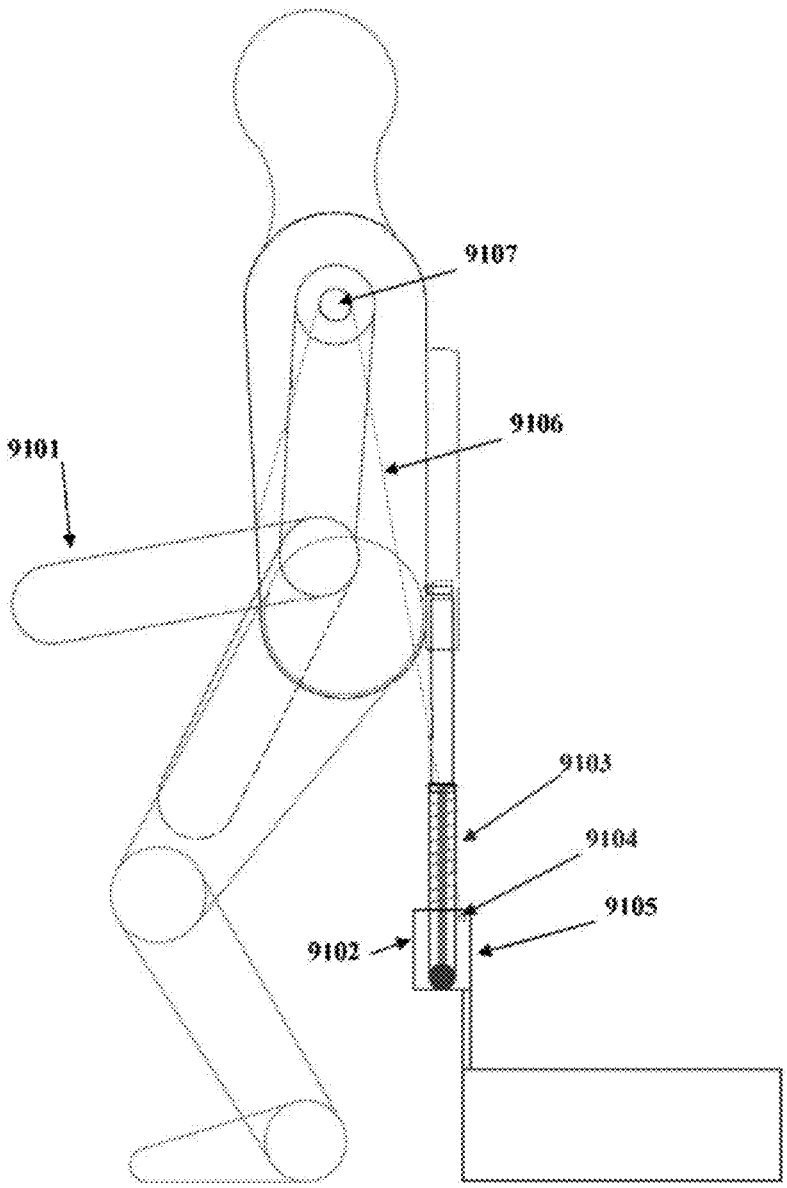
Figure 91: Side cross-sectional view of a raised/standing mannequin pop-up target system

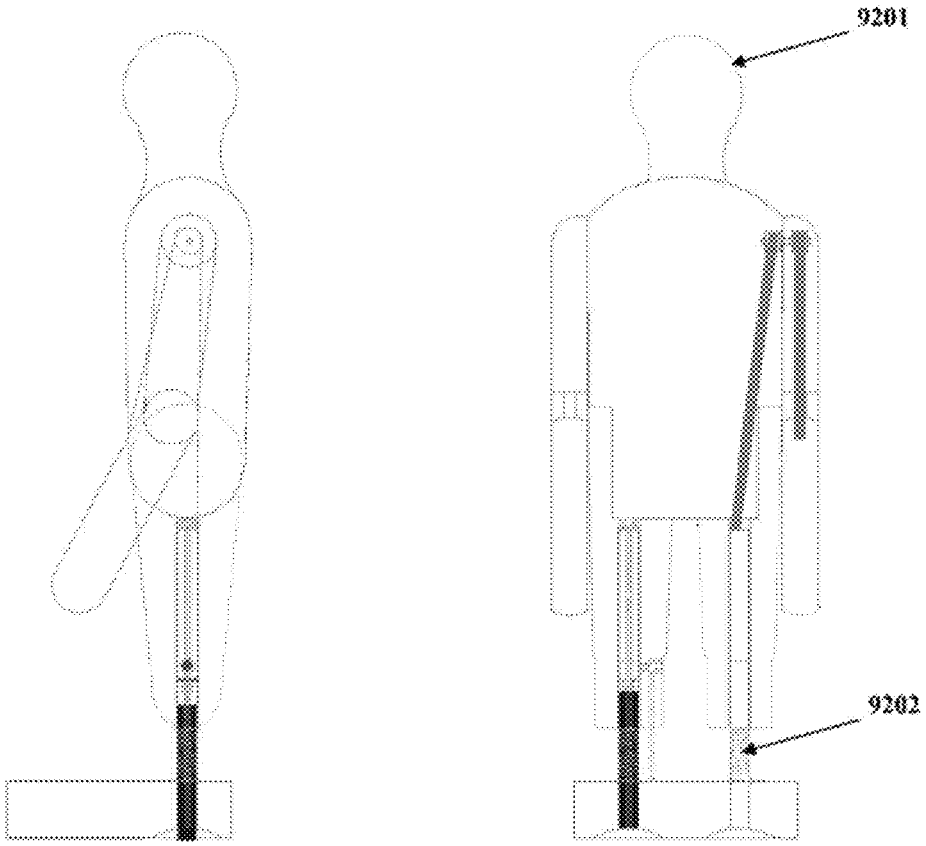
Figure 92: Side and front cross-sectional view of a lowered screw driven mannequin target system

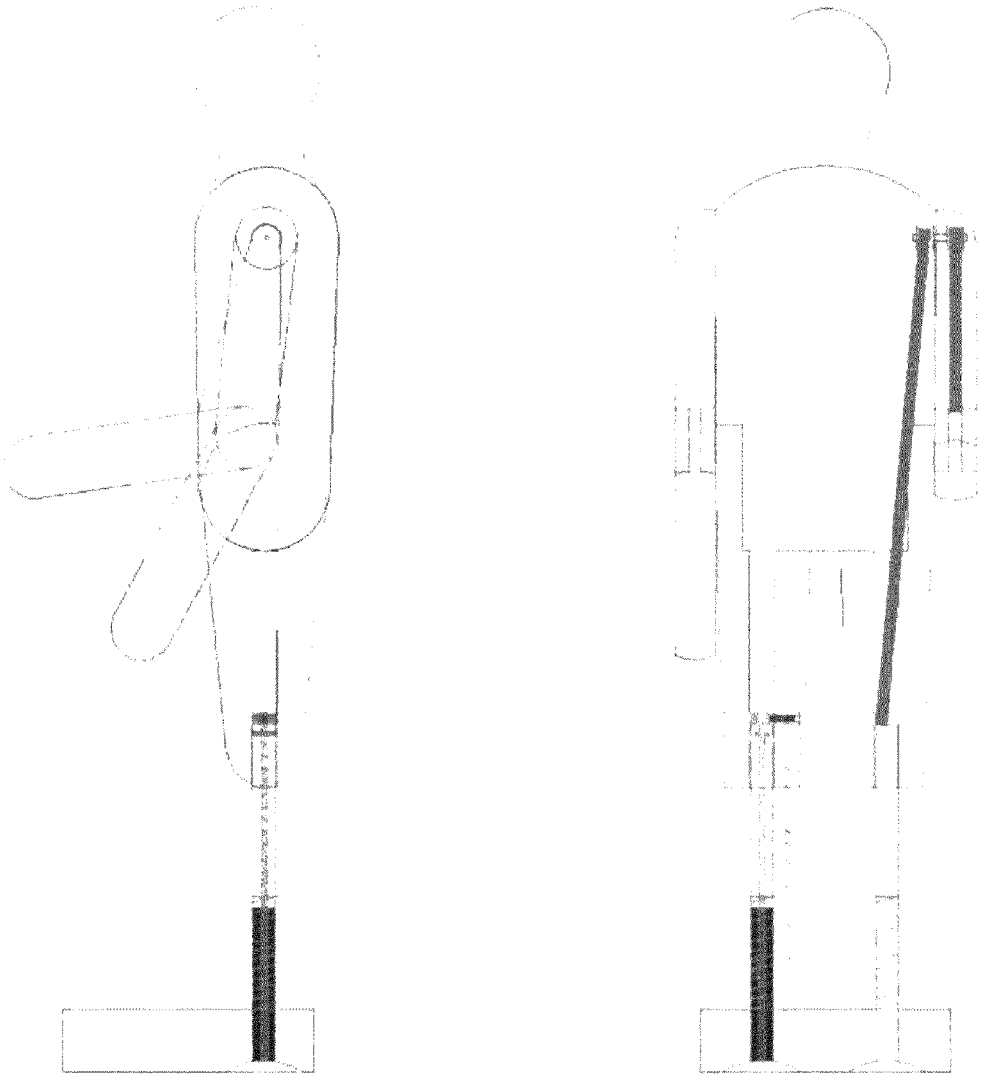
Figure 93: Side and front cross-sectional view of a raised screw driven mannequin target system

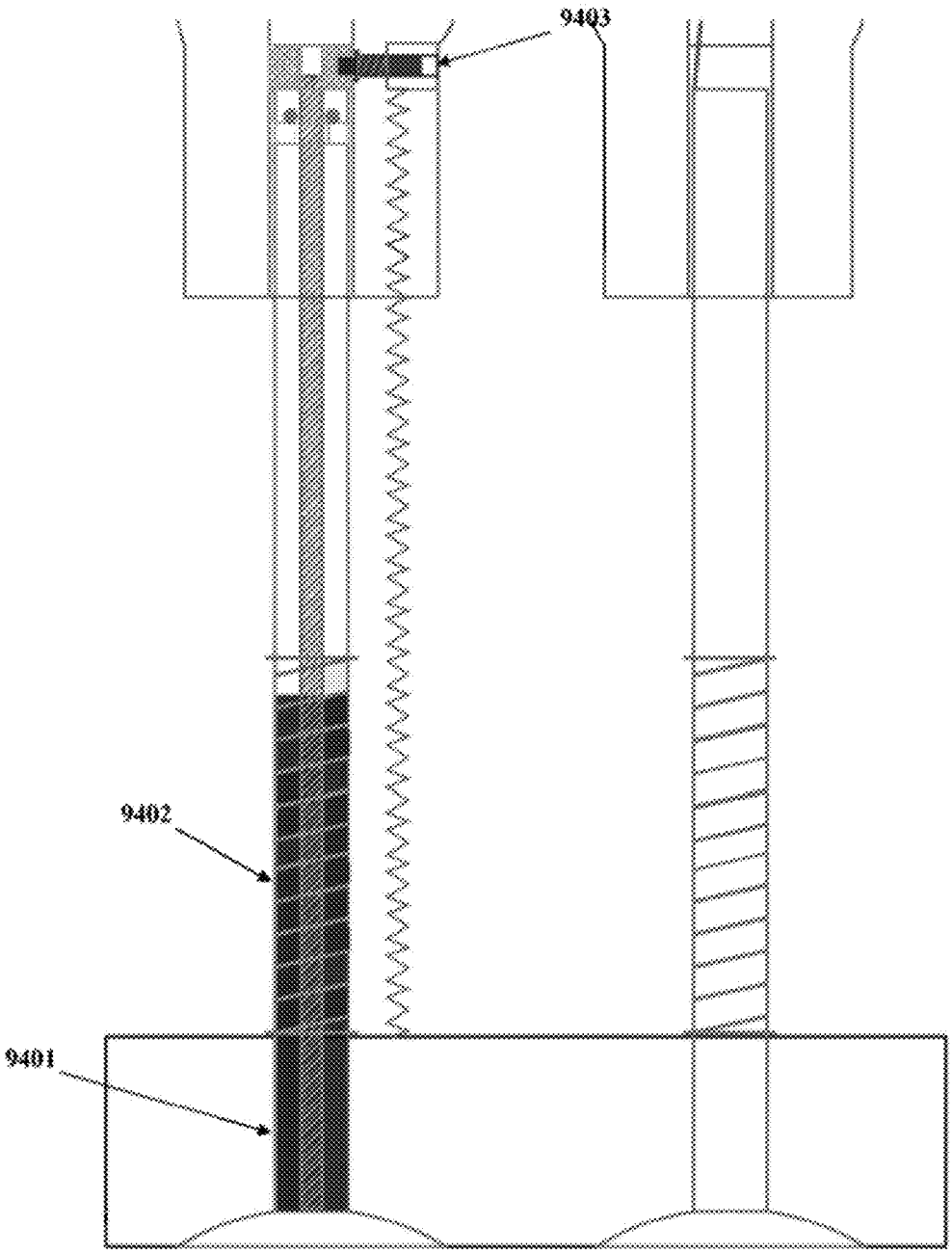
Figure 94: Side and front cross-sectional view of a raised screw driven mannequin target system

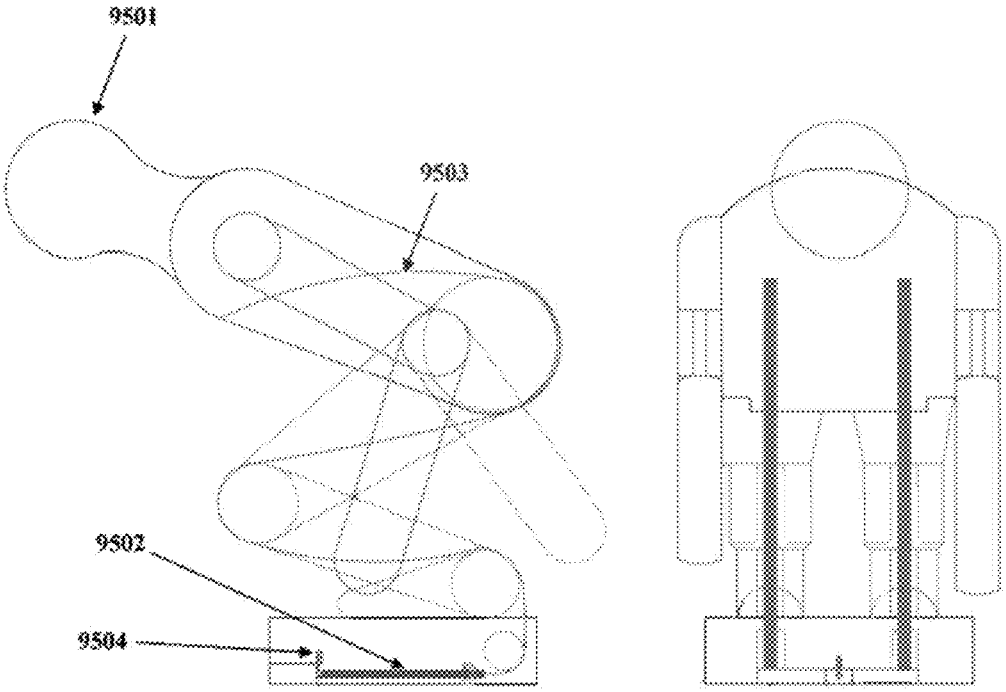
Figure 95: Side and front cross-sectional view of a lowered cable/strap driven mannequin target system

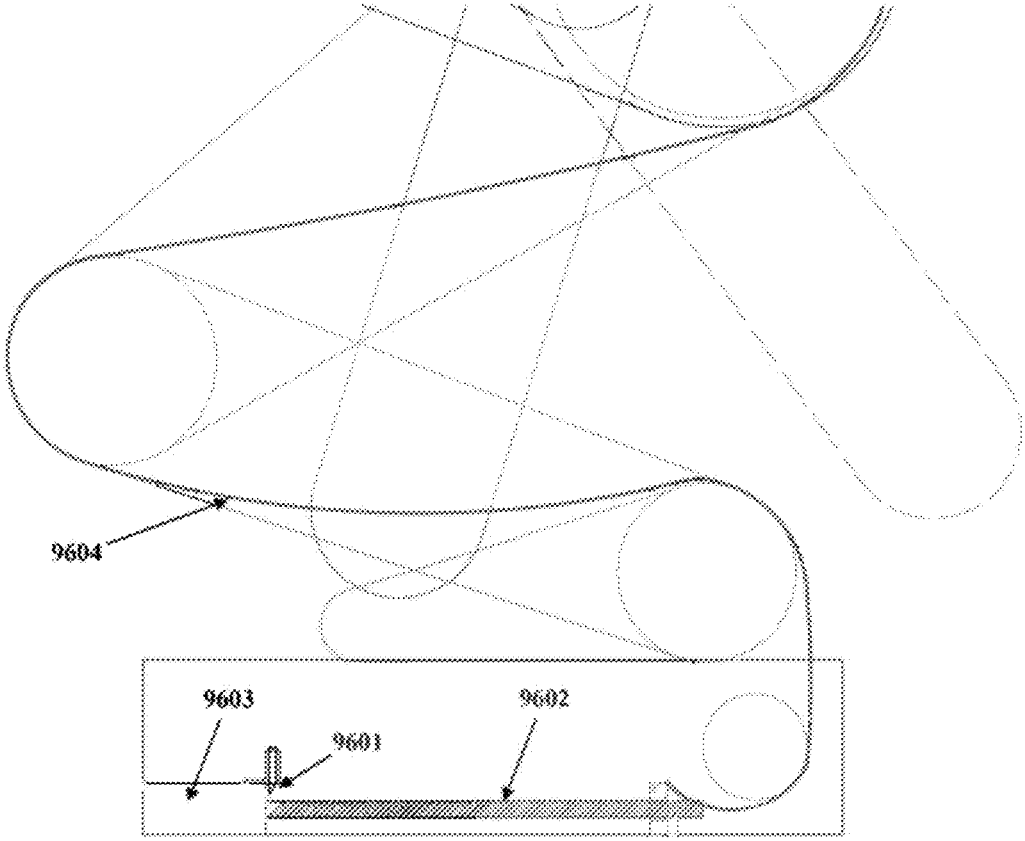
Figure 96: Side close up cross-sectional view of a lowered cable/strap driven mannequin target system

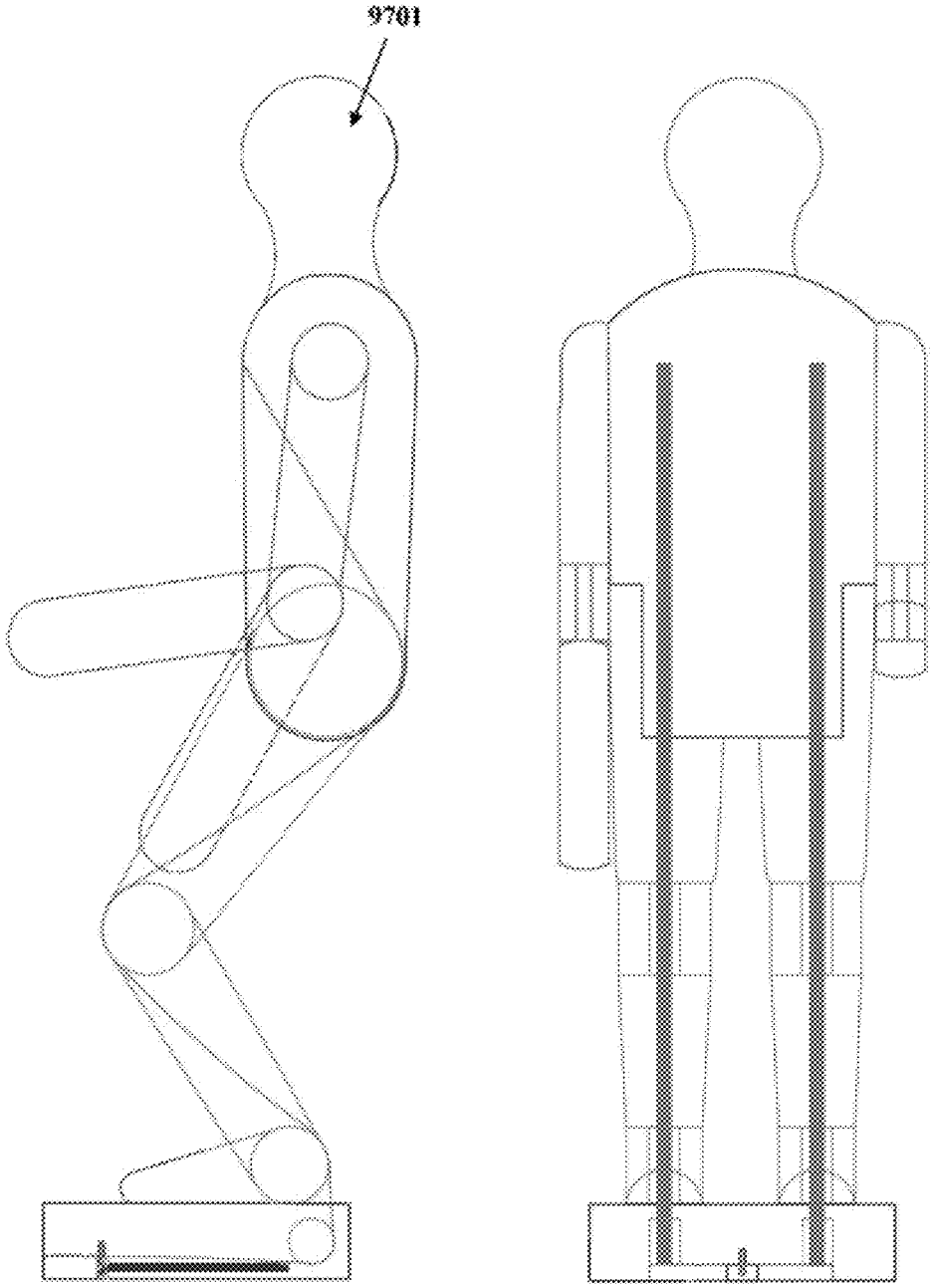
Figure 97: Side and front cross-sectional view of a raised cable/strap driven mannequin target system

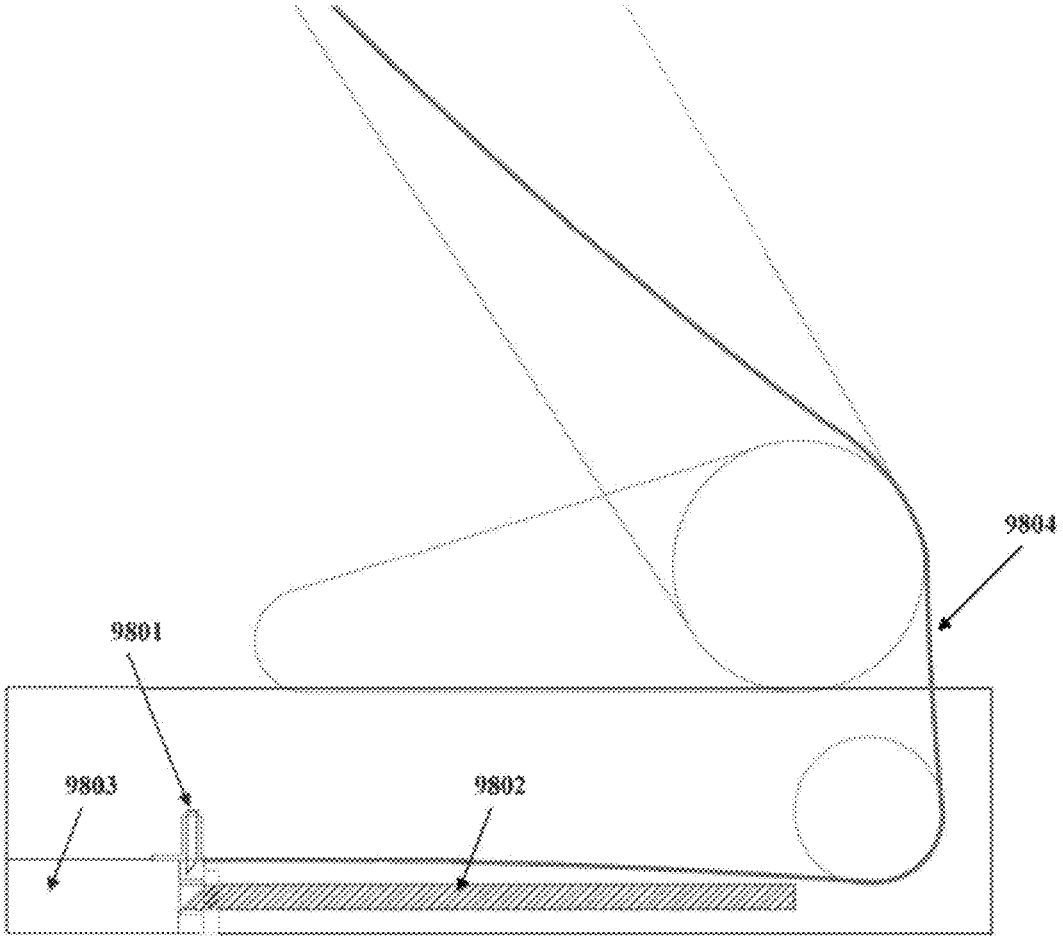
Figure 98: Side closet up cross-sectional view of a raised cable/strap driven mannequin target system

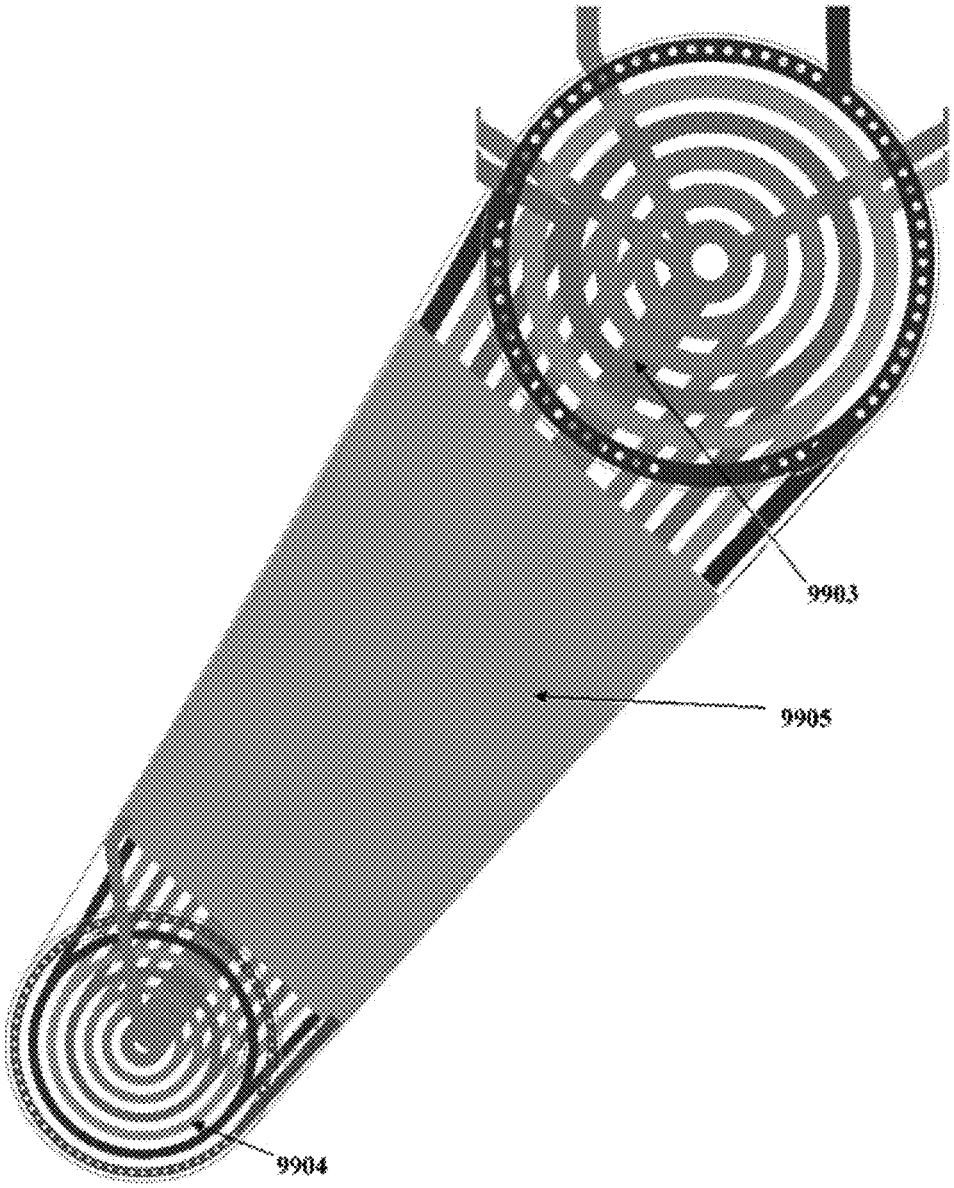
Figure 99: Side cross-sectional view of a mannequin target electrical interconnect system

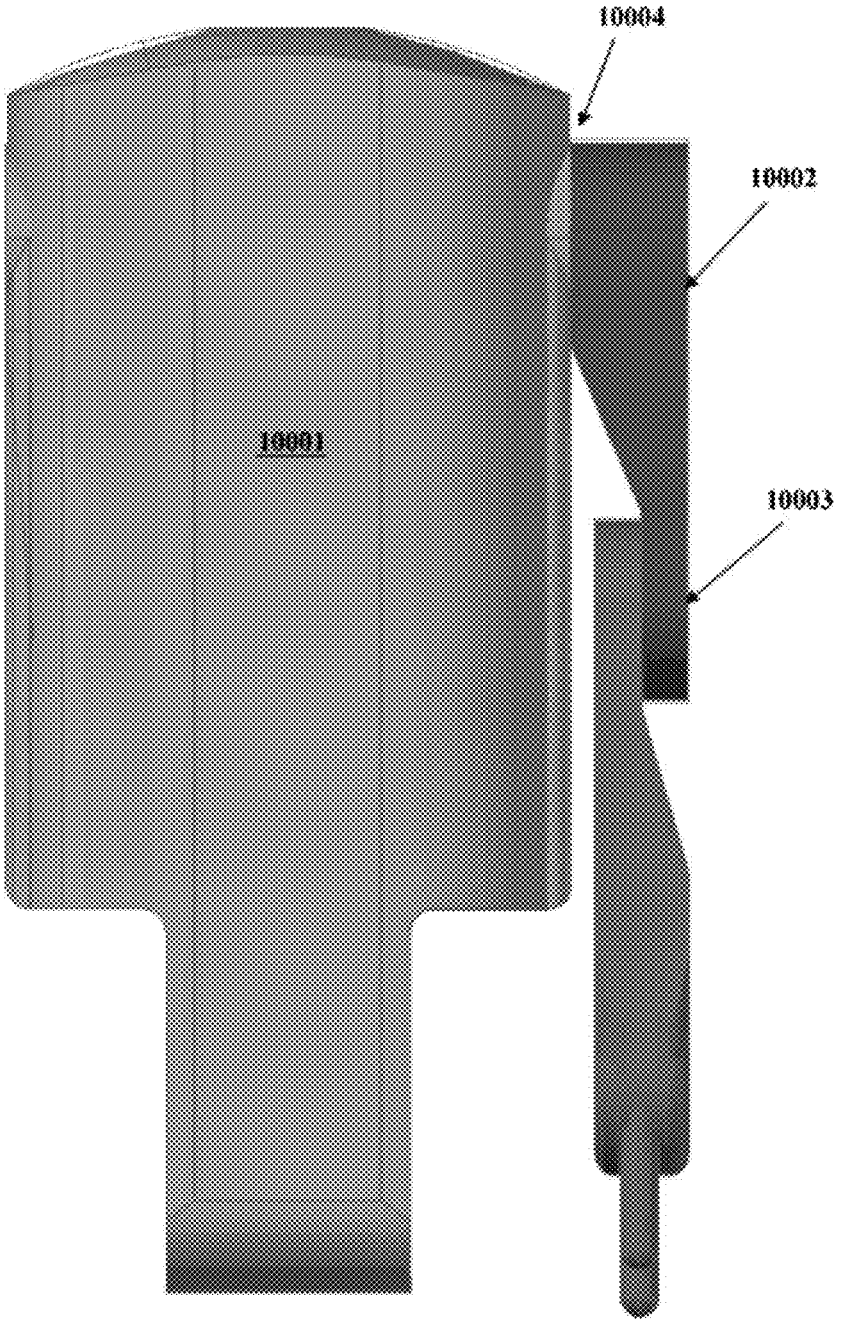
Figure 100: Front cross-sectional view of a mannequin target with conductive ink/foil interconnection system

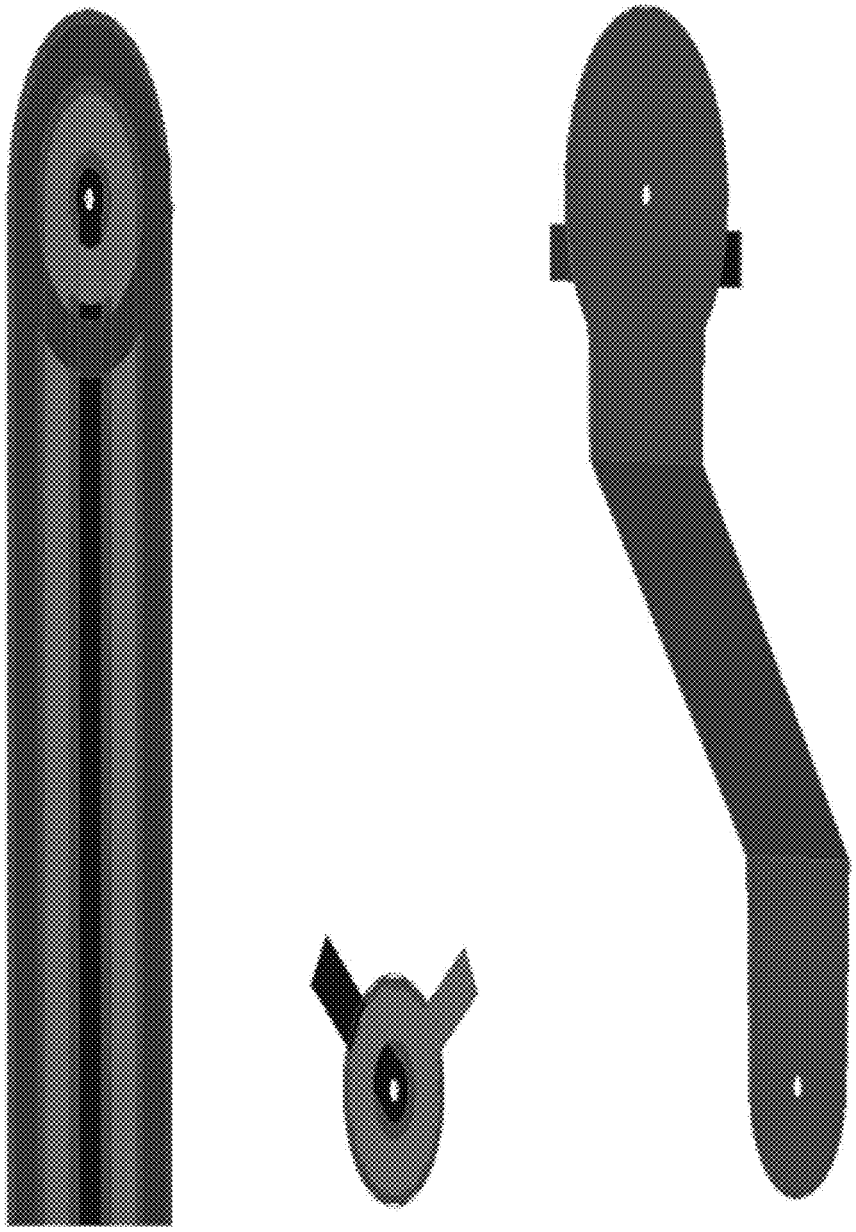
Figure 101: Exploded view of a mannequin interconnection system

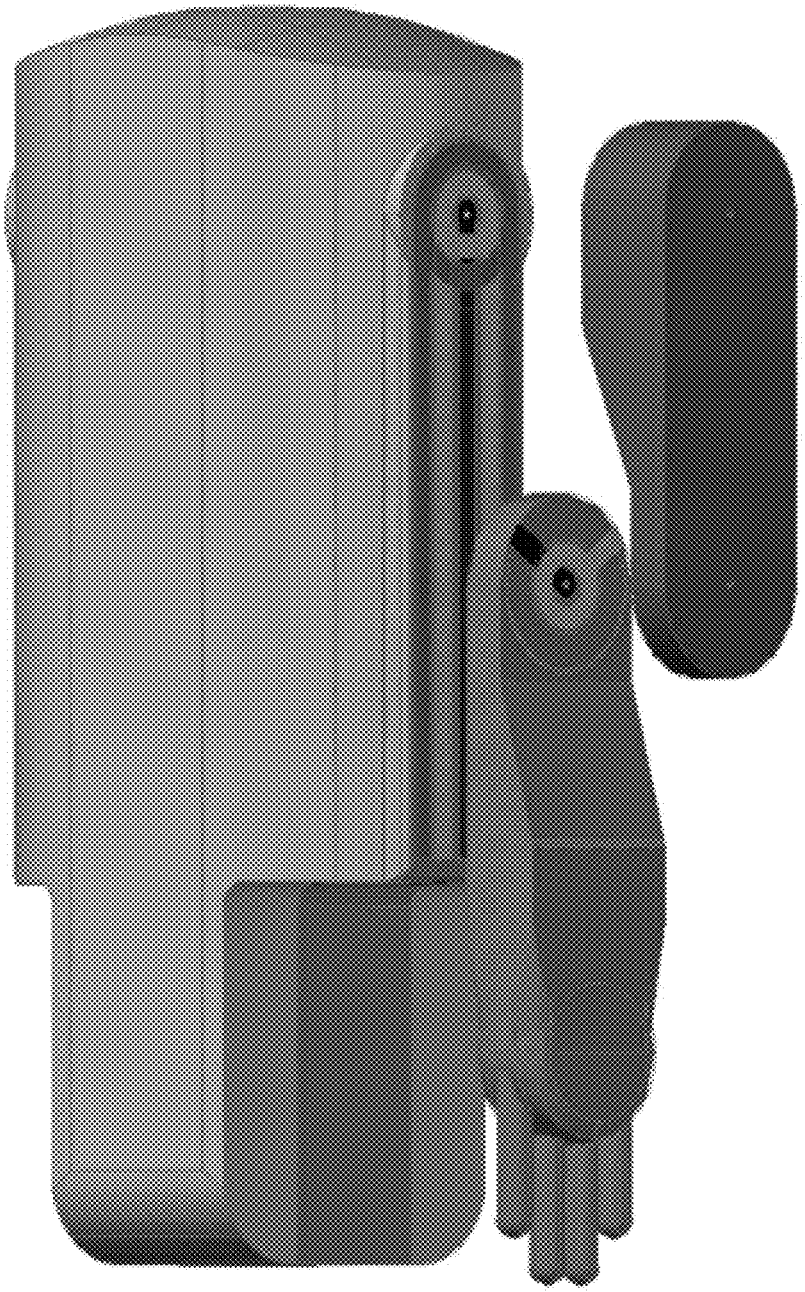
Figure 102: Isometric view of a mannequin sensor/heater interconnection system

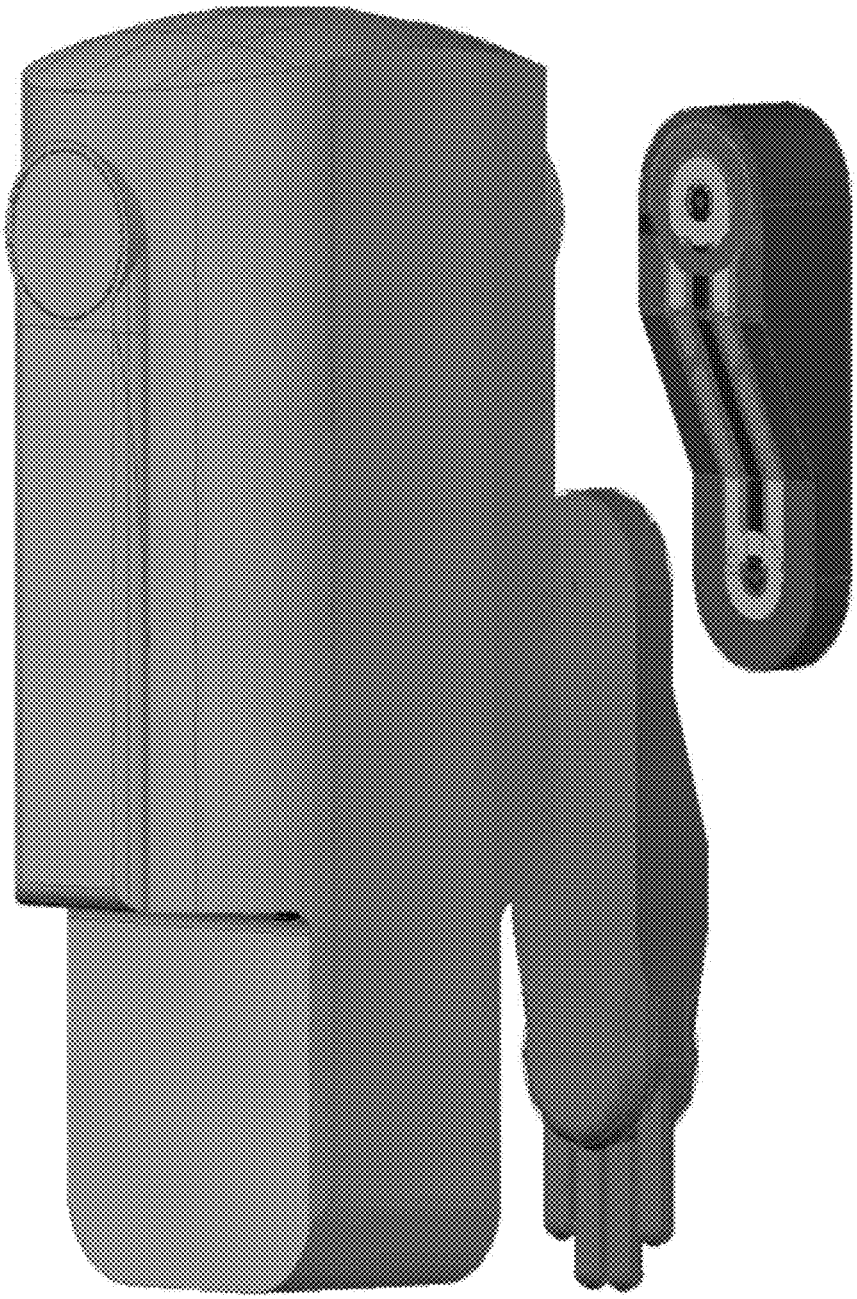
Figure 103: Cross-sectional view of a mannequin sensor/heater interconnection system

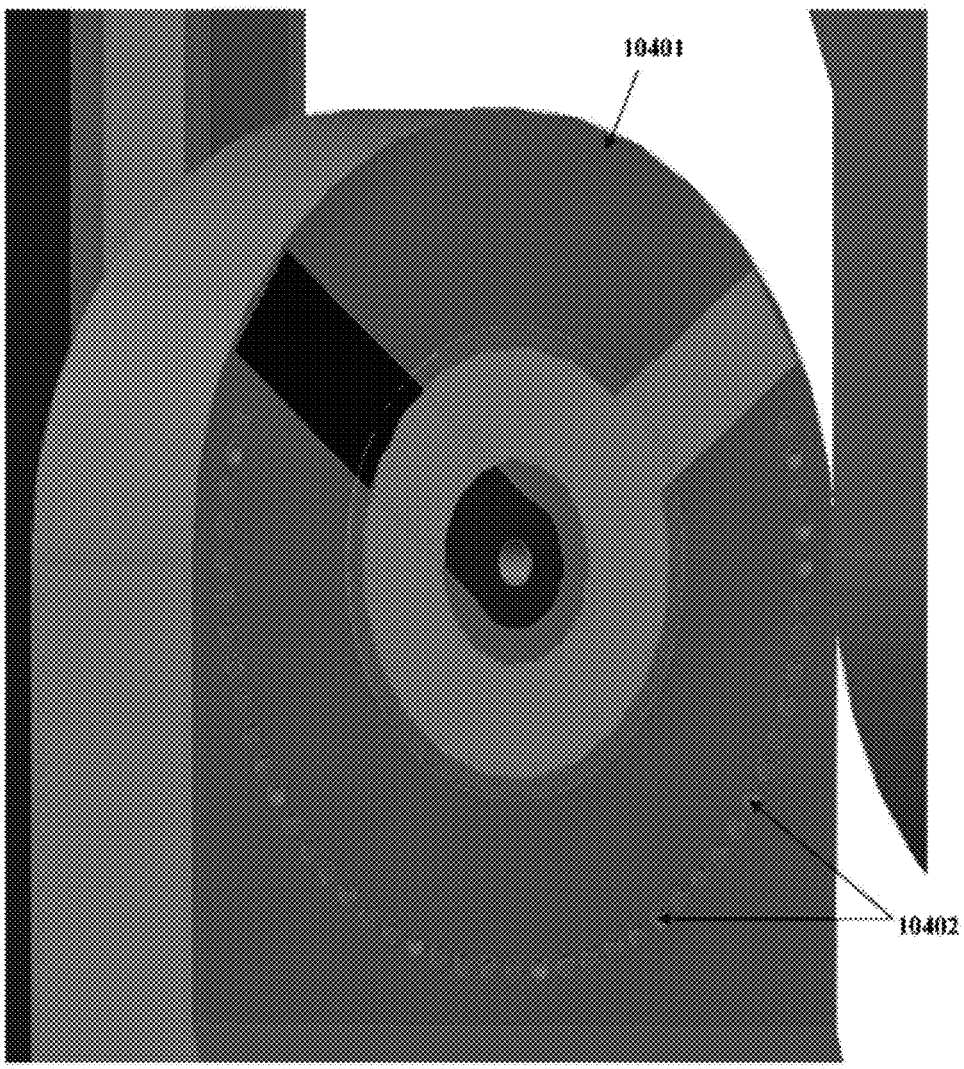
Figure 104: Cross-sectional close up view of a mannequin arm interconnection system

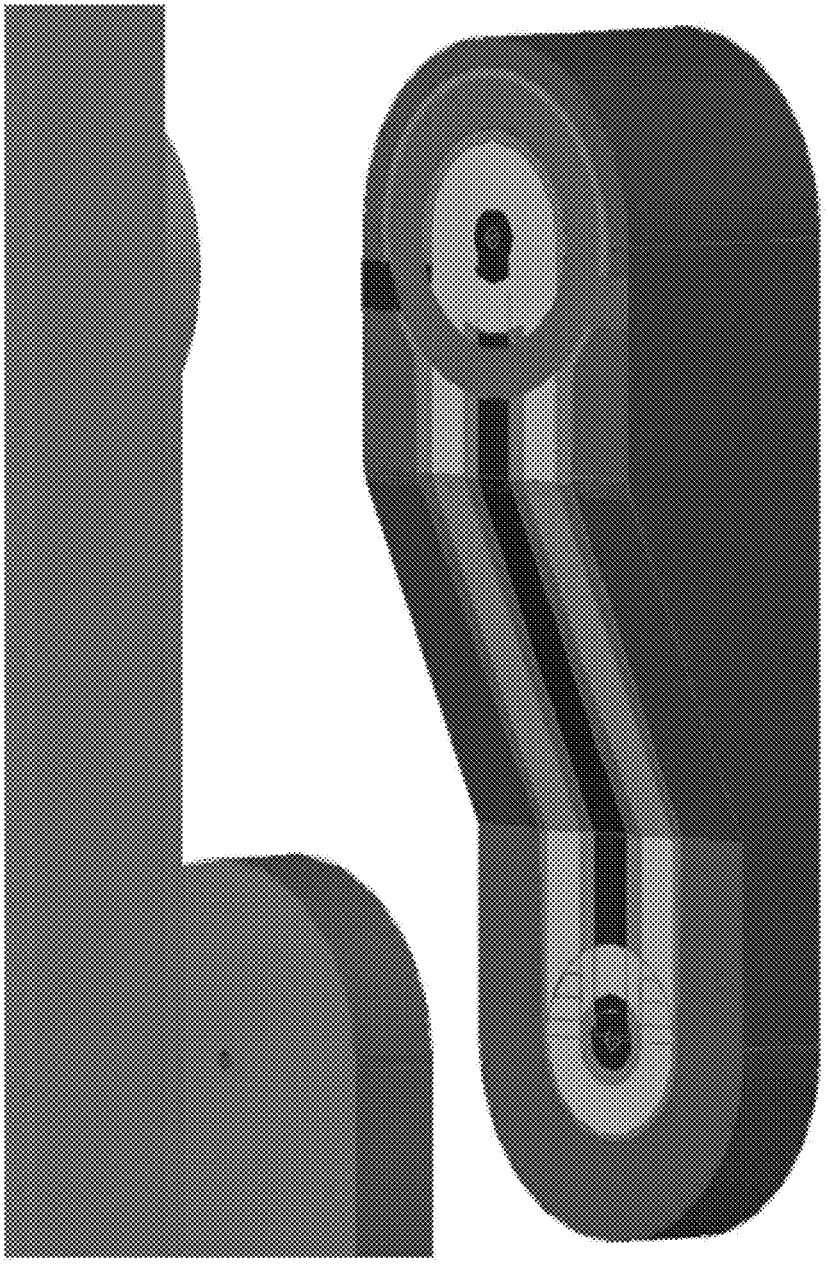
Figure 105: Cross-sectional view of a mannequin conductive ink/foil interconnection system

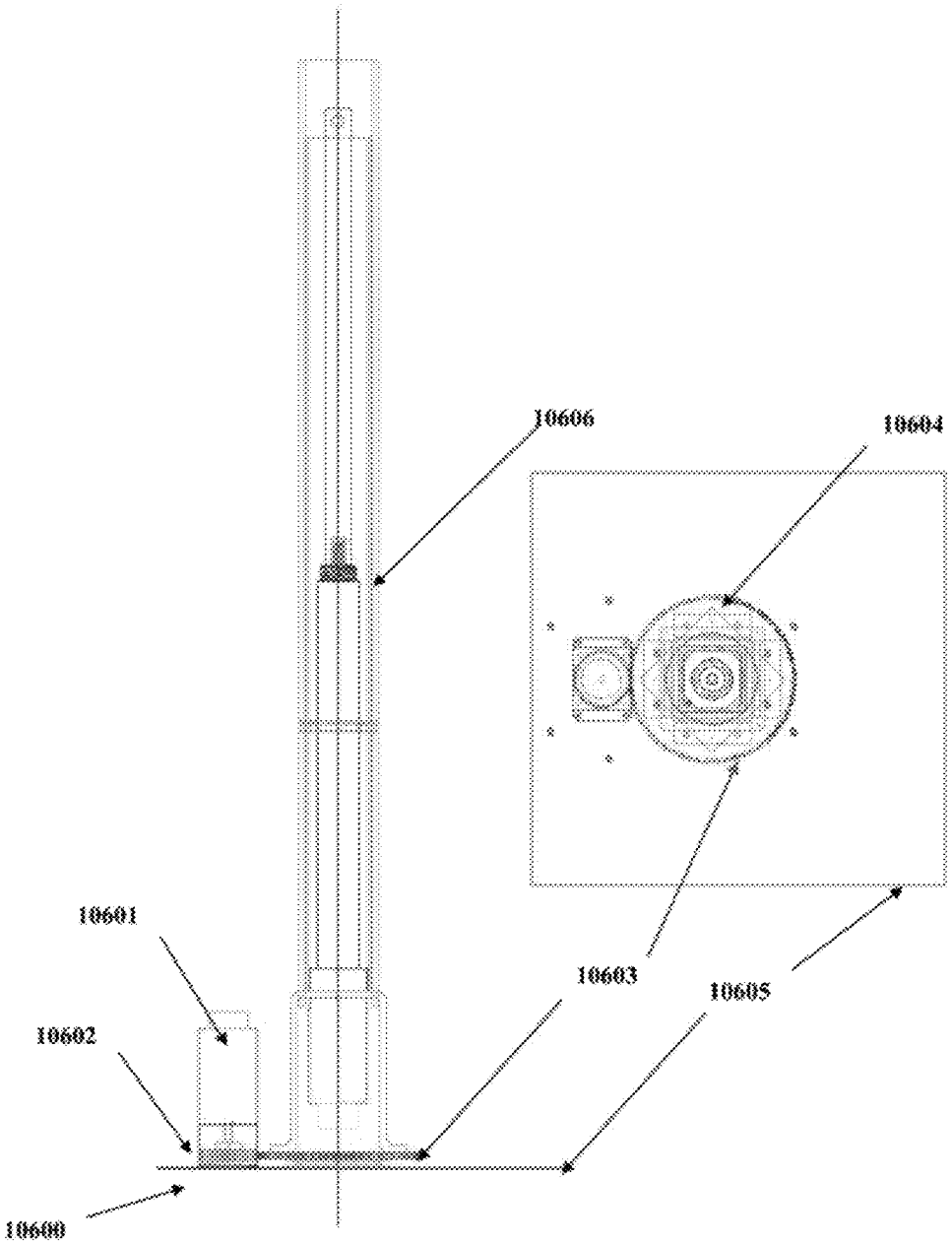
Figure 106: Side and top cross-sectional view of a mannequin rotation system

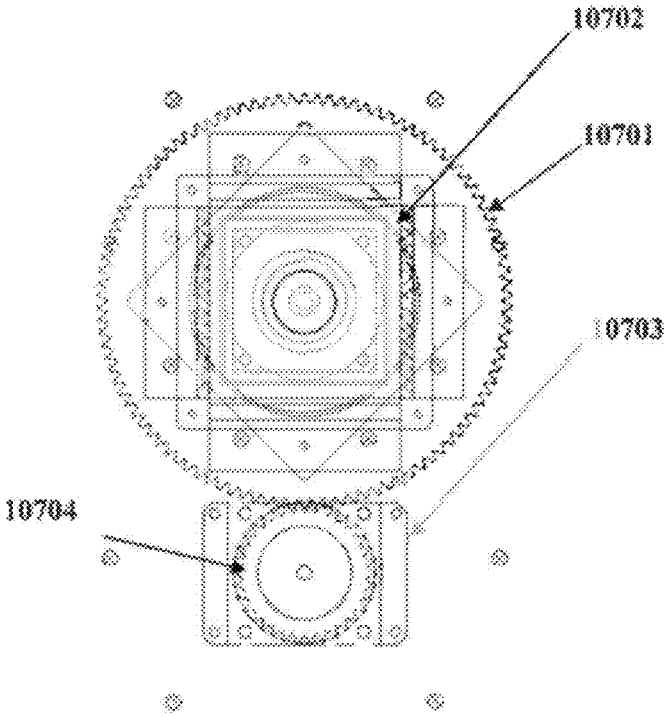
Figure 107: Cross-sectional close up view of a mannequin rotation system
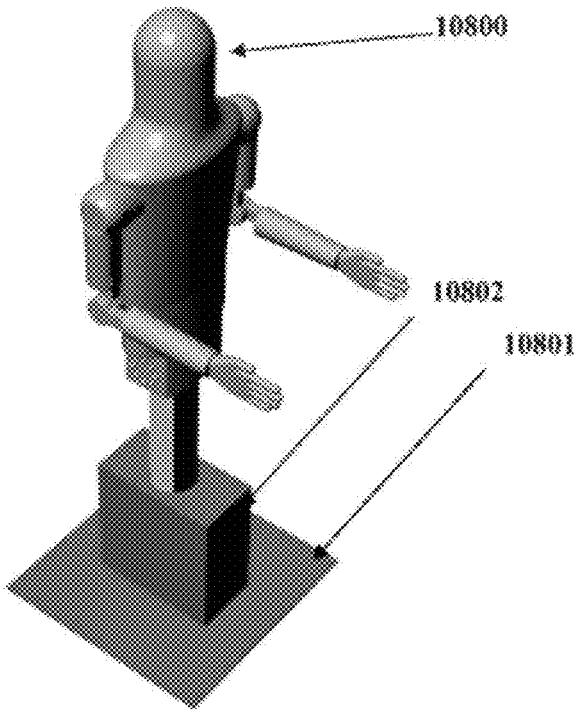
Figure 108: Isometric view of a raised mannequin target system

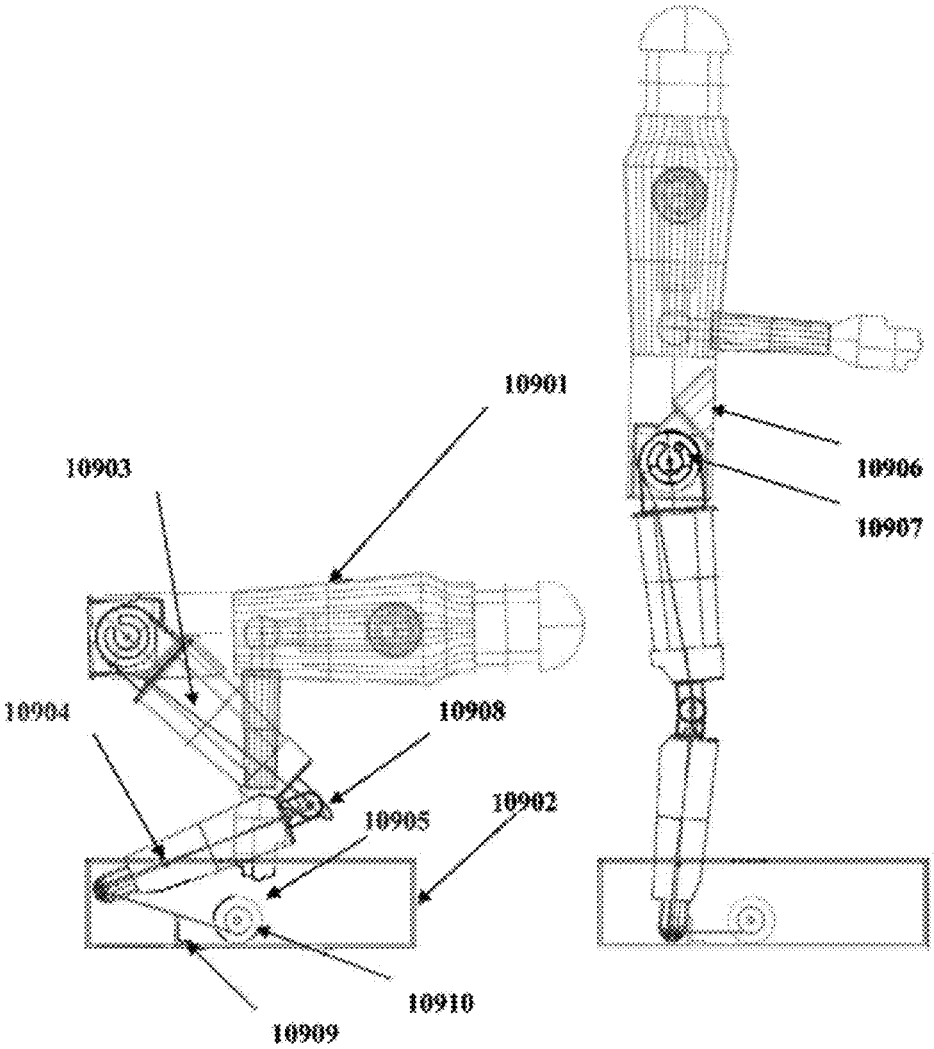
Figure 109: Raised and Lowered cross-sectional view of a cable/strap driven mannequin target system

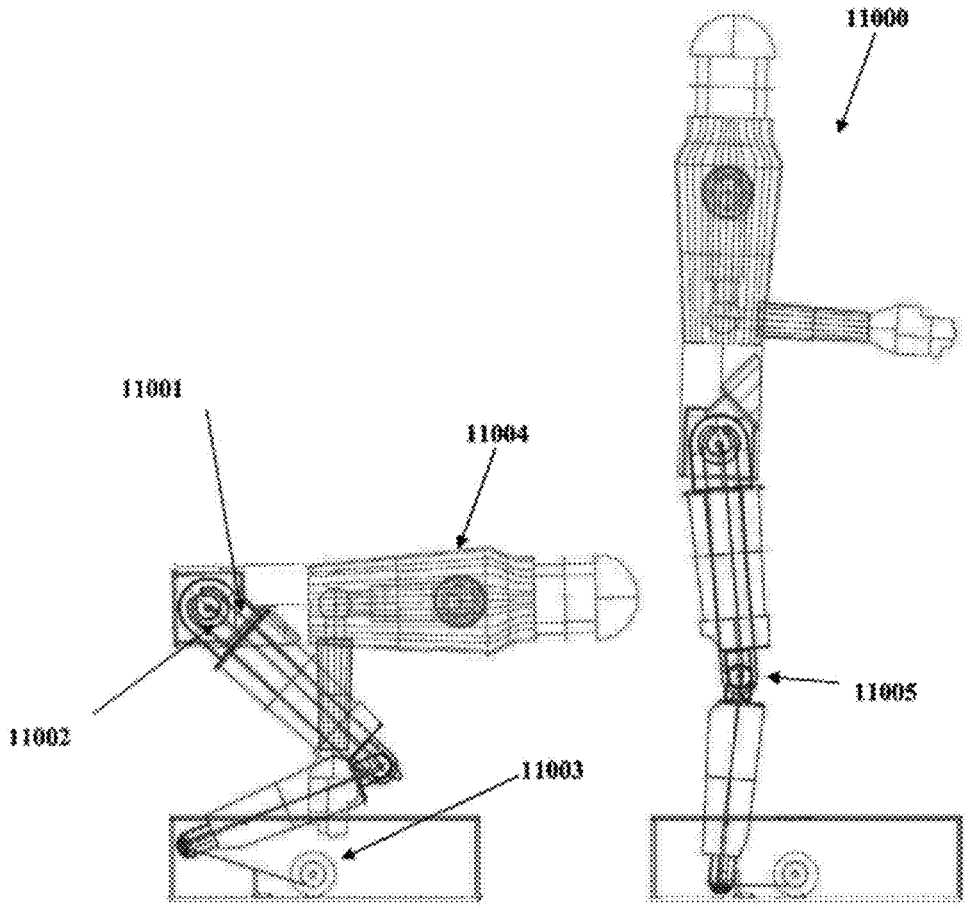
Figure 110: Raised and Lowered cross-sectional view of a strap & synchronous belt driven mannequin system

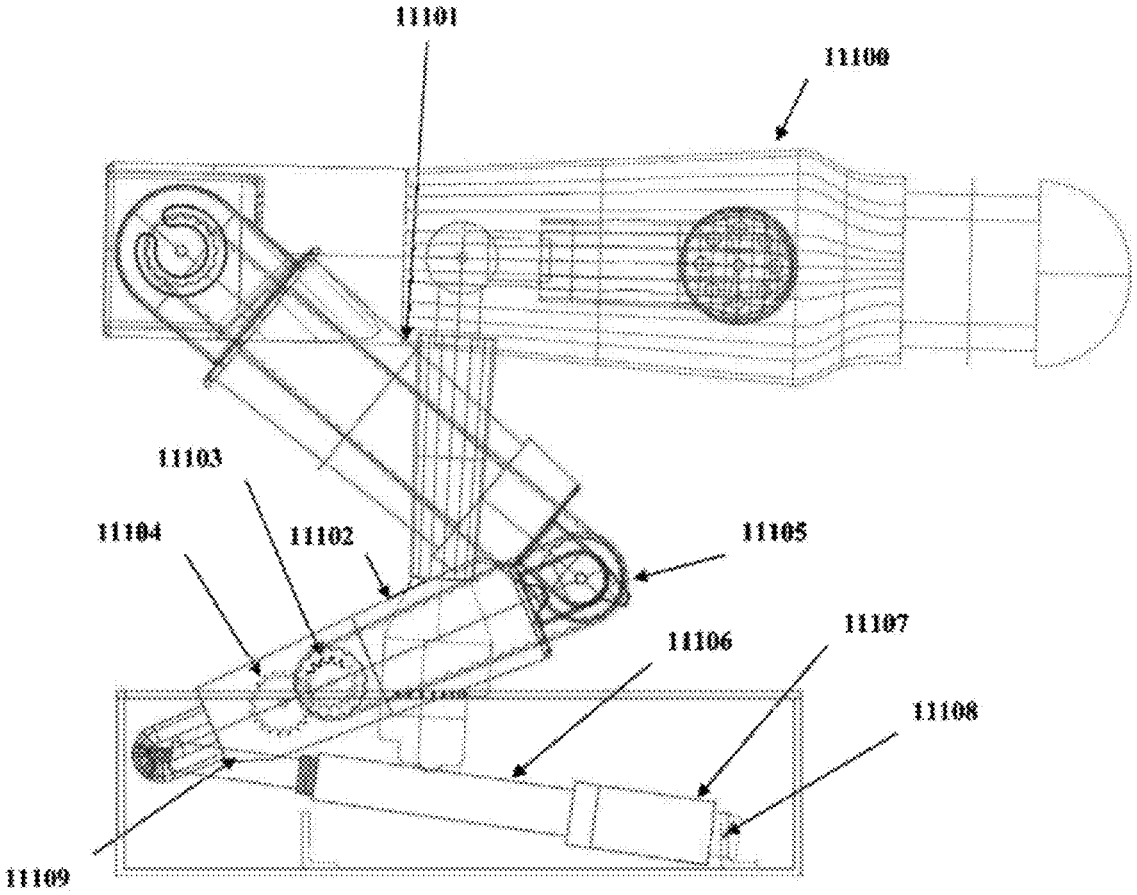
Figure 111: Side Lowered cross-sectional view of a synchronous belt driven mannequin system

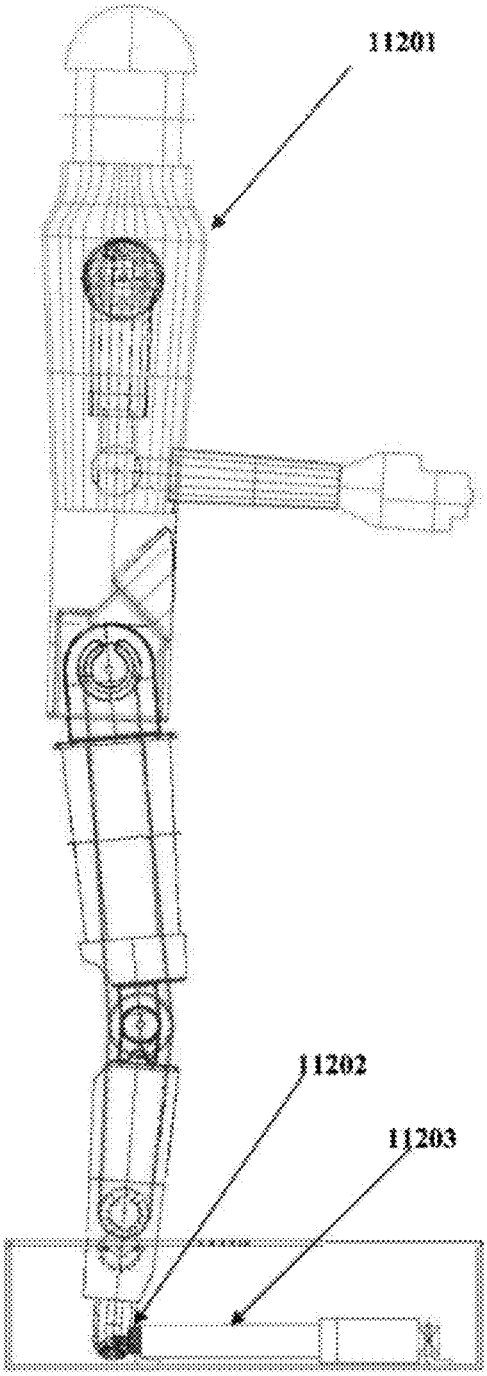
Figure 112: Raised cross-sectional view of a synchronous belt driven mannequin system

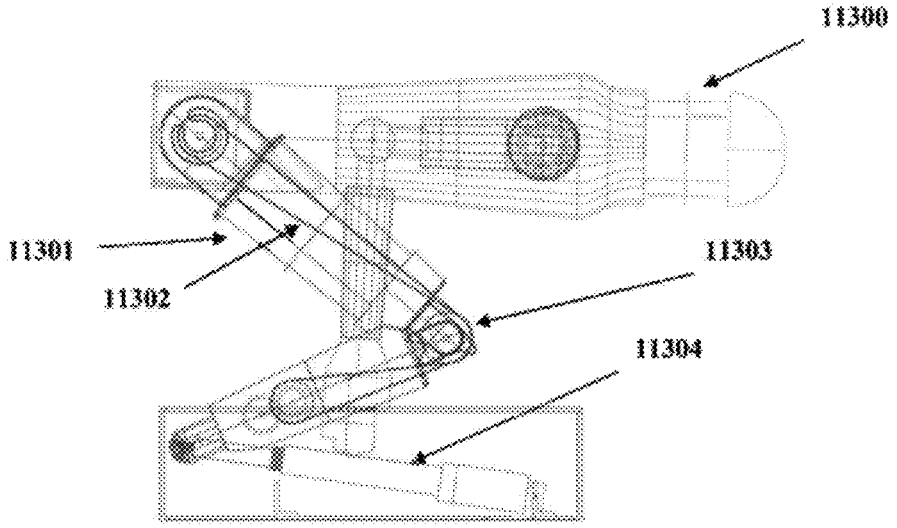
Figure 113: Lowered cross-sectional view of a single synchronous belt driven mannequin system
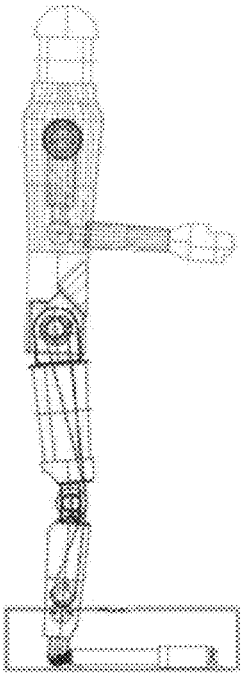
Figure 114: Raised cross-sectional view of a single synchronous belt driven mannequin system

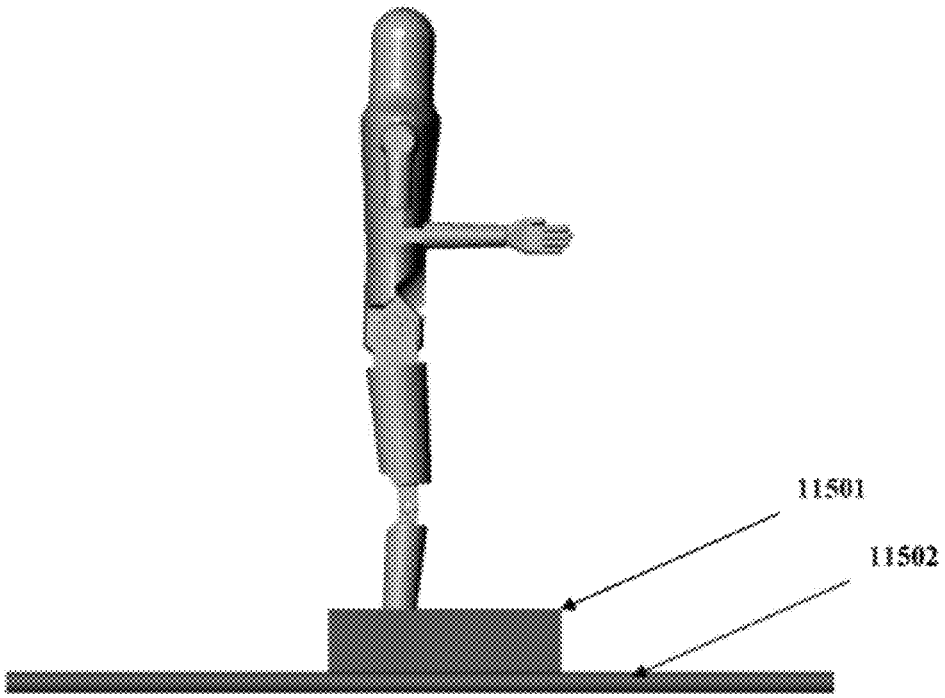
Figure 115: Raised cross-sectional view of a mannequin target running on MIT system
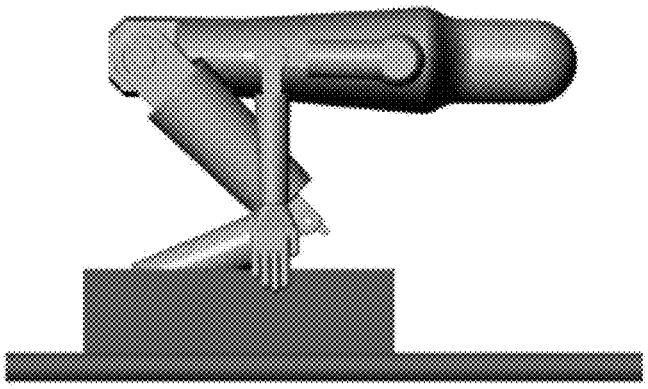
Figure 116: Lowered cross-sectional view of a mannequin target running on MIT system

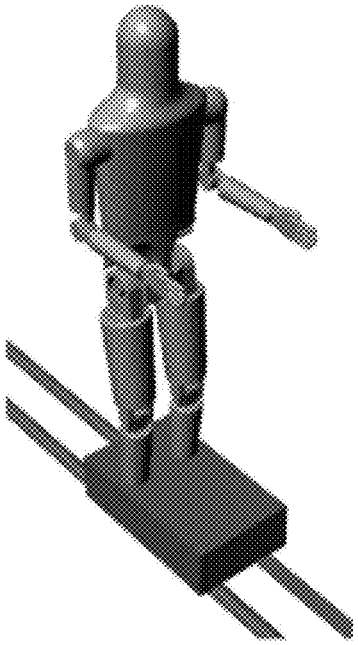
Figure 117: Raised Isometric view of a mannequin target running on MIT system
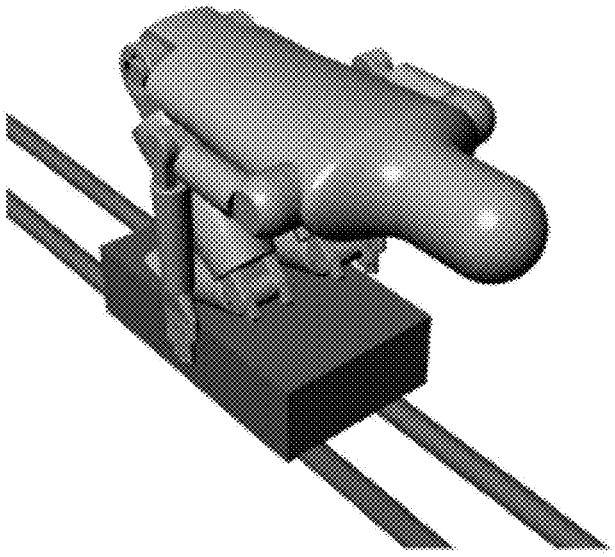
Figure 118: Lowered Isometric view of a mannequin target running on MIT system

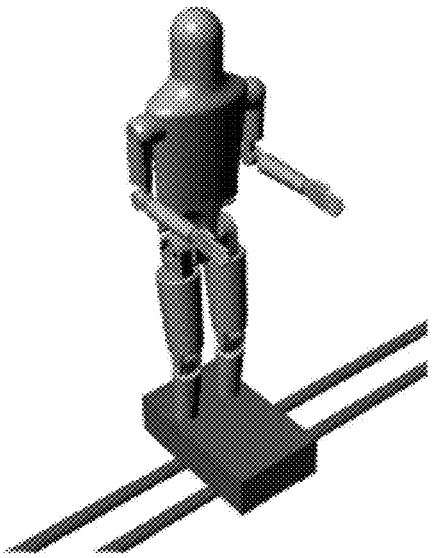
Figure 119: Raised Isometric view of a mannequin target running on MIT system rotated toward shooter
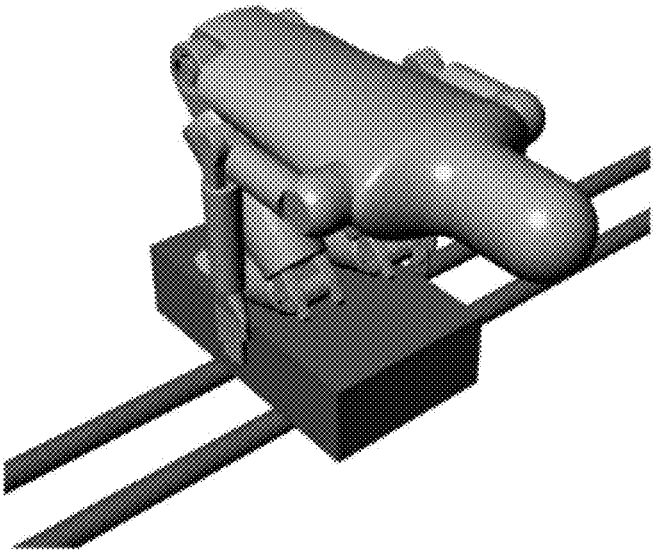
Figure 120: Lowered Isometric view of a mannequin target running on MIT system rotated toward shooter

TARGET SYSTEM METHODS AND APPARATUS

CROSS REFERENCE TO RELATED APPLICATIONS

This application claims priority to U.S. Provisional Application No. 61/310,936 filed on Mar. 5, 2010, entitled "Mannequin Lifter", U.S. Provisional Application No. 61/356,394 filed Jun. 18, 2010, entitled "Method and Apparatus for Mannequin Lifter and Interconnection", U.S. Provisional Application No. 61/442,612 filed Feb. 14, 2011, entitled "Target Systems and Methods", and U.S. Provisional Application No. 61/444,863 filed Feb. 21, 2011, entitled "Method and Apparatus for Mannequin Lifter and Interconnection". This application is also related to U.S. Pat. Nos. 5,516,113, 7,207,566 and 7,862,045, and U.S. patent application Ser. No. 11/853,574, filed Sep. 11, 2007, and entitled "Thermal Target System" the entire contents of which are incorporated herein by referenced.

REFERENCED PRIOR ART

In 1892 Carl Vogel was awarded U.S. Pat. No. 474,109 Self Marking and Indicating Target. In that patent he describes a short circuit target that uses 2 conductive plates insulated by a non-conducting medium spaced in such a way that a bullet passing through the target will for a moment in time create a short between the 2 plates. By applying a voltage potential across those plates a short caused by a bullet passing through can be easily be detected.

In 1971 U.S. Pat. No. 3,580,579 Electric Target Apparatus for Indicating Hit Points was issued describing a technique of determining the x-y impact location using short circuit target plates that are tilted in both the X and Y direction. By analyzing the time between impacts of each plate the projectile X-Y entry point can be determined. This patent technology will only work if the shooter is shooting perpendicular to the target plates. What my invention describes is a way to sense X-Y impact location from 360 degrees around a target such as a mannequin.

U.S. Pat. Nos. 6,133,989 & 6,414,746 describe a 3D laser sensing system that can detect objects using a diffused pulsed laser beam and an optic sensor. The current embodiment of the non-contact X-Y impact locator is based on this technology. Using 3D laser technology round impact from land, air or sea can be determined. An interactive mannequin can utilize this technology to not only detect round impact X-Y and trajectories it can also be used to gain situation awareness and have the mannequin respond accordingly.

COPYRIGHT NOTICE

A portion of the disclosure of this patent document contains material which is subject to copyright protection. The copyright owner has no objection to facsimile reproduction by anyone of the patent document or the patent disclosure, as it appears in the Patent & Trademark Office patent file or records, but otherwise reserves all copyright rights whatsoever.

TECHNICAL FIELD

The present application relates to methods and apparatus for target systems that can detect impact location and produce life like reactions in response to the impacts as well as present a realistic thermal signature.

BACKGROUND OF THE INVENTION

There is a need to produce mannequin targets that could determine location of impact for both penetrating and non-penetrating rounds and generate a human like thermal signature. Kill and non-kill zones need to be established to determine the lethality of impact or penetration. Current live fire mannequin target systems have no moving arms or legs and utilize knock sensors attached to High Density Polyethylene plastic target to determine if a target has been hit. When the mannequin is hit, the entire mannequin falls to the ground in a non-realistic manner and has no thermal signature capability. Thus, a need exists for target systems and methods for controlling targets which provide a realistic response and thermal signature.

There is a need to produce a thermal target system having a realistic human thermal signature from an aerial view. There is also a need to improve existing thermal panels so that they can survive 120 mm rounds as well as multiple small arms rounds without having the power buss severed. With the cost of conductive inks rising due to the price of silver there is a need for an alternate way of creating robust power busses.

There is a need to determine the impact location of targets be it pop up, mannequin, or vehicle targets. Current target systems only allow engagement from the front of the target which is not realistic from a battle field point of view. Most targets are engaged from 360 degrees and therefore a 360 degree X-Y sensor is needed to properly assess the damage/lethality of the impact.

SUMMARY OF THE INVENTION

This invention shows how to create a mannequin target that falls more realistically and has a robust electrical interconnect for both sensors and thermal generators. In a first aspect, the present invention provides a target system which includes a mannequin target and a mechanism coupled to the target which is moveable to allow the mannequin target to move between a retracted (e.g., lowered) position and an upright (e.g., raised) position. A projectile impact detection system is coupled to the mannequin target to determine impact of a projectile onto the mannequin target. The projectile impact detection system is configured to produce a signal as a result of a projectile impacting the mannequin target to allow the mechanism to position the mannequin target in the retracted position wherein the mannequin falls into the retracted position upon impact of the projectile on the mannequin target to simulate a fallen target.

The description herein depicts multiple embodiments of systems and methods to thermalize targets. A method or apparatus for thermalizing a target includes a target having a heating surface which remains intact and functioning after impact by large projectiles. A method or apparatus to create a human thermal signature visible from an aerial viewpoint. A method or apparatus for creating robust power busses using alternative metals and application methods.

This invention also shows how to use both resistive and short circuit technology to create Omni-directional impact detectors that can locate the X-Y impact location of projectiles both entering a target system and exiting a target system.

Table 1: Segment Identifying Resistance for Projectile Entering 2 Wire Omni Directional Target Table 2: Segment Identifying Resistance for Projectile Exiting 2 Wire Omni Directional Target

BRIEF DESCRIPTION OF THE DRAWINGS

FIG. 1: Unidirectional Elliptical Target Isometric View

FIG. 2: Unidirectional Elliptical Target Top View

FIG. 3: Unidirectional Elliptical Target Timing Diagram

FIG. 4: Unidirectional Conic Target with Front & Back Sensors Isometric View FIG. 5: Unidirectional Conic Target with Front & Back Sensors Top View FIG. 6: Unidirectional Conic Target with Dual Front Sensors Isometric View FIG. 7: Unidirectional Conic Target with Dual Front Sensors Rear View FIG. 8: Omni Directional Cylindrical Target with Solid Inner/Outer Sensors Isometric View FIG. 9: Omni Directional Cylindrical Target with Solid Inner/Outer Sensors Top View FIG. 10: Omni Directional Cylindrical Target with Solid Inner/Outer Sensors Cutaway View FIG. 11: Omni Directional Cylindrical Target with Segmented Inner/Outer Sensors Isometric View FIG. 12: Omni Directional Cylindrical Target with Segmented Inner/Outer Sensors Top View FIG. 13: Omni Directional Cylindrical Target with Segmented Inner/Outer Sensors Cutaway View FIG. 14: Omni Directional Cylindrical Target with Resistive Rubber Interconnection Isometric View FIG. 15: Omni Directional Cylindrical Target with Resistive Rubber Inner Sensor Isometric View FIG. 16: Resistive Rubber Acquisition System Simulated using a Sense Resistor Circuit FIG. 17: Omni Directional Cylindrical/Spherical Target Isometric View FIG. 18: Omni Directional Cylindrical/Spherical Target Top View FIG. 19: Omni Directional Cylindrical/Spherical Target Spherical sensor Isometric View FIG. 20: Omni Directional Cylindrical/Spherical Target with segmented Sensors Isometric View FIG. 21: Omni Directional Cylindrical/Spherical Target with segmented Sensors Top View FIG. 22: Omni Directional Elliptical Target with segmented Sensors Isometric View FIG. 23: Omni Directional Elliptical Target with segmented Sensors Top View FIG. 24: Omni Directional Elliptical Target with segmented Sensors Vertical Cutaway View FIG. 25: Omni Directional Elliptical Target with segmented Sensors Horizontal Cutaway View FIG. 26: Mannequin HDPE Torso Isometric View FIG. 27: Mannequin HDPE Torso with Front Only Sensors/Heaters Isometric View FIG. 28: Mannequin HDPE Torso with Front Only Chest, Shoulder, & Head sensors Isometric View FIG. 29: Mannequin HDPE Torso with Front Only Chest, Shoulder, Head & Kill Zone Isometric View FIG. 30: Mannequin HDPE Torso with Enclosed Chest, Shoulder, & Head Isometric View FIG. 31: Mannequin HDPE Torso with Enclosed Chest, Shoulder, Head & Kill Zone Isometric View FIG. 32: Mannequin HDPE Torso with Segmented Chest, Shoulder, & Head Isometric View FIG. 33: Mannequin HDPE Torso with Segmented Chest, Shoulder, Head & Kill Zone Isometric View FIG. 34: Mannequin HDPE Torso with Segmented Chest & Kill Zone Isometric View FIG. 35: Mannequin HDPE Torso with Segmented Chest & Kill Zone Top View FIG. 36: Mannequin HDPE Torso with Segmented Head & Kill Zone Isometric View FIG. 37: Mannequin HDPE Torso with Segmented Head & Kill Zone Top View FIG. 38: Mannequin HDPE Torso with Segmented Sensors Cutaway View FIG. 39: Mannequin Non Contact LIDAR Based System Isometric View FIG. 40: Mannequin Non Contact LIDAR Based System Top View FIG. 41: Mannequin Non Contact LIDAR SA/HD Sensors Isometric View FIG. 42: Mannequin Non Contact LIDAR HD Sensors Isometric View FIG. 43: Mannequin Non Contact LIDAR HD Sensors Top View FIG. 44: Mannequin Non Contact LIDAR SA & HD Sensors Isometric View FIG. 45: Short Circuit LOMAH Target Front Isometric View FIG. 46: Short Circuit LOMAH Target Back Isometric View FIG. 47: Short Circuit LOMAH Target Row Contact Pads Isometric View FIG. 48: Short Circuit LOMAH Target Row Contact Pads $2^{nd}$ Layer Isometric View FIG. 49: Short Circuit LOMAH Target Row Contact Pads $3^{rd}$ Layer Isometric View FIG. 50: Short Circuit LOMAH Target Row Contact Pads $3^{rd}$ Layer Isometric 2D Wire View FIG. 51: Short Circuit LOMAH Target Row Bottom Contact Pads Isometric View FIG. 52: Short Circuit LOMAH Target Exploded Diagram Isometric View FIG. 53: Short Circuit LOMAH Target Front Columns with Resistive Rubber Isometric View FIG. 54: Short Circuit LOMAH Target Back Rows with Resistive Rubber Isometric View FIG. 55: Short Circuit LOMAH Target with Resistive Rubber & Center Foil Layer Isometric View FIG. 56: Resistive Trace LOMAH Target Front Columns Isometric View FIG. 57: Resistive Trace LOMAH Target Single Power Buss Close-up Isometric View FIG. 58: Resistive Trace LOMAH Target Back Rows Isometric View FIG. 59: Resistive Trace LOMAH Target Right Side Isometric View FIG. 60: Resistive Trace LOMAH Target Close-up of Row Traces Isometric View FIG. 61: Resistive Trace LOMAH Target Close-up of Bottom Connection Isometric View FIG. 62: LOMAH Resistive Sensor on Thin Plastic Non-Kill Zone Front View FIG. 63: LOMAH Resistive Sensor on Thin Plastic Kill Zone Front View FIG. 64: LOMAH Resistive Sensor on Thin Plastic Kill & Non-Kill Zone Front View FIG. 65: LOMAH Short Circuit Kill & Left/Right Non-Kill Zone Isometric View FIG. 66: LOMAH Short Circuit Kill & Left/Right Non-Kill Zone Close Up Isometric View FIG. 67: LOMAH Short Circuit Back Side Isometric View FIG. 68: LOMAH Short Circuit Aerial or Escalation of Force Target 3D Wire Isometric View FIG. 69: B27 Target on Lane Runner Clamp Isometric View FIG. 70: B27 Target Foil Faceplate Isometric View FIG. 71: B27 Target Middle Layer Foil Rings Isometric View FIG. 72: B27 Target Back Foil Pickup Traces Isometric View FIG. 73: B27 Target Pickup Traces & Foil Rings Close-up Isometric View FIG. 74: B27 Target Clamp, Pickup Pins & Traces Close-up 2D Wire Isometric View FIG. 75: B27 Target Foil Faceplate Pickups Isometric View FIG. 76: B27 Target Exploded Diagram Isometric View FIG. 77: B27 Target Foil Rings Single Wire Pickup using Resistive Rubber Isometric View FIG. 78: Backside of a mannequin torso with foil power buss strips for thermal heater membrane and/or impact detection sensors FIG. 79: Picture of electrical snap connectors for conductive ink/foil base wiring harness FIG. 80: Picture of a foil base wiring harness FIG. 81: Resistive matrix thermal panel with solid conductive power busses FIG. 82: Resistive matrix thermal panel with matrix shaped conductive power busses FIG. 83: Resistive matrix thermal panel with foil strip power busses folded over back substrate FIG. 84: Close-up picture of a resistive matrix thermal panel with foil strips folded over FIG. 85: Close-up picture of the edge of a resistive matrix thermal panel with foil strips FIG. 86: Side and front cross-sectional view of a retracted/lowered mannequin target system FIG. 87: Side and front cross-sectional view of a raised mannequin target system FIG. 88: Side cross-sectional view of a lowered mannequin target system with arm and movement control FIG. 89: Front cross-sectional view of a lowered mobile mannequin target system FIG. 90: Side cross-sectional view of a sitting & concealed mannequin attached to a pop up target lifter FIG. 91: Side cross-sectional view of a raised/standing mannequin pop-up target system FIG. 92: Side and front cross-sectional view of a lowered screw driven mannequin target system FIG. 93: Side and front cross-sectional view of a raised screw driven mannequin target system FIG. 94: Side and front cross-sectional view of a raised screw driven mannequin target system FIG. 95: Side and front cross-sectional view of a lowered cable/strap driven mannequin target system FIG. 96: Side close up cross-sectional view of a lowered cable/strap driven mannequin target system FIG. 97: Side and front cross-sectional view of a raised cable/strap driven mannequin target system FIG. 98: Side closet up cross-sectional view of a raised cable/strap driven mannequin target system FIG. 99: Side cross-sectional view of a mannequin target electrical interconnect system FIG. 100: Front cross-sectional view of a mannequin target with conductive ink/foil interconnection system FIG. 101: Exploded view of a mannequin interconnection system FIG. 102: Isometric view of a mannequin sensor/heater interconnection system FIG. 103: Cross-sectional view of a mannequin sensor/heater interconnection system FIG. 104: Cross-sectional close up view of a mannequin arm interconnection system FIG. 105: Cross-sectional view of a mannequin conductive ink/foil interconnection system FIG. 106: Side and top cross-sectional view of a mannequin rotation system FIG. 107: Cross-sectional close up view of a mannequin rotation system FIG. 108: Isometric view of a raised mannequin target system FIG. 109: Raised and Lowered cross-sectional view of a cable/strap driven mannequin target system FIG. 110: Raised and Lowered cross-sectional view of a strap & synchronous belt driven mannequin system FIG. 111: Side Lowered cross-sectional view of a synchronous belt driven mannequin system FIG. 112: Raised cross-sectional view of a synchronous belt driven mannequin system FIG. 113: Lowered cross-sectional view of a single synchronous belt driven mannequin system FIG. 114: Raised cross-sectional view of a single synchronous belt driven mannequin system FIG. 115: Raised cross-sectional view of a mannequin target running on MIT system FIG. 116: Lowered cross-sectional view of a mannequin target running on MIT system FIG. 117: Raised Isometric view of a mannequin target running on MIT system FIG. 118: Lowered Isometric view of a mannequin target running on MIT system FIG. 119: Raised Isometric view of a mannequin target running on MIT system rotated toward shooter FIG. 120: Lowered Isometric view of a mannequin target running on MIT system rotated toward shooter

DETAILED DESCRIPTION

FIG. 1 shows a unidirectional elliptical target that is created using concentric elliptical rings with a diagonal plate inside. Each of these rings and plates are comprised of two conductive sheets/foil/ink or metallic coating with a non-conducting medium. The distance between the plates is less than the expected projectile length ensuring an electrical short upon impact. The outer elliptical cylinder 101 is contiguous and is used to generate the first short circuit pulse need in determining the initial starting point of impact. The Inner elliptical cylinder 102 is spaced at a known distance and is used to generate a second pulse needed to determine the projectiles velocity at that instance i.e. distance/time=velocity. This inner elliptical cylinder is separated into 2 short circuit sensors by a distance that is less than the expected projectiles diameter. Each half of the inner elliptical cylinders are used to, in this orientation, determine the X location of impact. This is determined by looking at the time between the first and second impact of the inner elliptical cylinder. If the impact occurs in the center both halves of the inner elliptical cylinder will short simultaneously indicating an exact known X location. If the impact occurs between the outside of the inner elliptical sensor and inside the outer elliptical sensor then no pulses will be generated and the X position is either side of the target. By halving the outer elliptical cylinder similar to the inner elliptical cylinder the X position can be exactly determined. If the impact location is somewhere between the center and outer edge of the inner elliptical sensor then its X location can be determined by examining the time difference between the first and second pulse generated by the inner elliptical sensor. The diagonal plate 103 is placed in such a way to generate a pulse needed to determine the Y location of impact. This is done by comparing the time difference between the first or second elliptical sensor pulse and comparing the predetermined velocity described above. FIG. 2 shows the top view of the unidirectional elliptical target. The outer elliptical cylinder 201 and the inner elliptical cylinder 202 are spaced at a known distance. The diagonal plate sensor 203 travels diagonally from the front side of the inner elliptical sensor to the back side of the inner elliptical sensor at the opposite end. FIG. 3 shows a timing diagram of how the pulses are used to derive the X-Y impact point. The leading edge of the Outer Elliptical Sensor 301 and the leading edge of the Inner Elliptical Sensor 302 are used to determine the projectile's velocity. The leading edge of the Diagonal Sensor 303 is used to determine the Y position of the impact. The leading edge of the second pulse 304 on the Inner Elliptical Sensor is used to determine the X position of the impact. If you were to divide both the Inner & Outer elliptical sensor into smaller segments a more accurate X position as well as azimuth could be determined.

FIG. 4 shows a Unidirectional target sensor system that is comprised of a front disk 401, a cone 402 segmented into four sections and a back disk 403. The front disk and the back disk are spaced at a known distance and are used to determine the projectile's velocity. The cone is used to determine both X and Y based on the time between the front disk pulse and the conic segment pulse. The segment generating the pulse determines which quadrant the bullet hit and the time between the front disk and the conic segment pulses determines where within that segment that the projectile hit. Again if you were to divide the cone into smaller segments a more accurate X-Y location can be determined. FIG. 5 shows a top view of the Unidirectional Conic Target system. As you can see the front disk 501 and the back disk 504 are placed at a known distance. The upper left quadrant 502 and upper right quadrant 503 are positioned so that the projectile will enter and exit at a known angle making it easy to calculate both X and Y impact zone. FIG. 6 shows another embodiment of the same invention. The front disk 601 has another disk 602 at a known distance behind it. The conic sensor 603 is behind the second disk and determines the X-Y as in the previous embodiment. FIG. 7 shows the back view of the conic target system with four short circuit sensor segments upper right quadrant 701, upper left quadrant 702, lower right quadrant 703, and lower left quadrant 704.

FIG. 8 shows an Omni-directional Cylindrical Target with contiguous outer 801 and inner 803 short circuit sensors placed at a known distance. Between both cylindrical sensors is a semi conic 802 short circuit sensor that is divided into two short circuit segments. FIG. 9 shows a top view of the Omni-directional Cylindrical Target. When a projectile penetrates the outer ring 901 a pulse is generated. When the bullet hits the inner semi conic ring 903 a second pulse is generated in one of the four segments unless it is hit between two adjacent segments in which case X is position is known exactly. Next the inner cylindrical ring 902 is hit generating a third pulse. Then as the projectile exits a fourth pulse is generated by the inner cylindrical ring short circuit sensor and the semi conic ring generates another pulse. Finally the projectile exits generating a pulse on the outer cylindrical ring. Knowing which semi conic sensor segment is hit in the path of the projectile is used along with the time between pulses to approximate the X position and projectile azimuth. Correction factors are used to better approximate the trajectory path of the projectile. Azimuth approximation algorithms can be used to closely approximate both the velocity and X position. FIG. 10 shows a cutaway view of the Omni-directional Cylindrical Target. Between the outer cylindrical short circuit sensor 1001 and the inner cylindrical short circuit sensor 1003 is the semi conic short circuit sensor 1002. The slope of the sensor is calculated by measuring the distance across the top divided into the length vertically of the sensor. This sensor is used to determine the Y position of impact. As you can see when a projectile enters the target that has a trajectory path through the top of the target 1004 it will generate pulses, when comparing outer ring sensor to semi conic secondary ring, closer together then a projectile traveling through the bottom of the target 1005. FIG. 11 shows a multi segmented embodiment of the previous invention. The outer cylindrical short circuit sensor 1101 and inner cylindrical short circuit sensor 1103 are again placed at a known distance needed to calculate projectile velocity. The semi conic short circuit 1102 sensor is placed between the outer and inner cylindrical sensors and is used to determine the Y position of the projectile. FIG. 12 shows a top view of the segmented Omni-directional cylindrical target. The outer cylindrical short circuit sensor 1201, semi conic short circuit sensor 1202 and inner cylindrical short circuit sensor 1203 have all been divided into four segments and offset by 30 degrees. This target has the ability to more accurately determine the X position than the previous embodiment. When a projectile hits the outer ring which ever segment is hit determines the first X position approximation of entry. When the semi conic sensor is hit the second X approximation is determined and finally when the inner ring is hit the third X approximation can be easily determined. Then when the projectile starts to exit an even more exact X approximation occurs. Not only can the X-Y be readily determined the azimuth is also easily determined. The Y position of impact can also more accurately be determined due to the fact that an accurate azimuth can be calculated. FIG. 13 shows a cutaway view of the current invention. The outer cylindrical short circuit sensor 1301, semi conic short circuit sensor 1302, and outer cylindrical short circuit sensor 1303 are all segmented and shifted by 30 degrees. More than four segments can be used to achieve a more accurate position location of impact without deviating from the current invention.

To try and reduce the amount of interconnections to the segmented Omni-directional cylindrical target each of the inner side of each sensor can be manufactured as a single contiguous sheet of conductive material/foil or tied to each other so that only 1 wire is needed to power/sense all 3 sensors on the inner side. FIG. 14 shows another embodiment used to reduce the amount of wires needed to sense the segmented Omni-directional cylindrical target. A resistive rubber strip 1401 is bonded with conductive adhesive to the outer conductive sheet/foil/ink of each sensor. The outer cylindrical short circuit sensor 1403 is bonded to all segments and has a gap 1402 between 2 adjacent segments. The resistive rubber strap does not have to be contiguous. It can be segmented into smaller strips that just jumper three of the four gaps. Now only one wire needs to be attached to each outer conductive sheet/foil/ink. The resistive rubber would take a projectile impact and only change its resistance by a small amount, if any, due to it's self healing properties. FIG. 15 shows the inner cylindrical short circuit sensor with the resistive rubber strip encompassing all but one gap 1501. Notice the opposite gap 1502 is bridged with the resistive rubber. When the projectile shorts the conductive sheets/foil/ink a short is detected across only the segment that the sense wire is attached to. All other segments show up as a resistance increasing as you move away from the segment with the sense wire attached. If the segments where wired so that the left most segment 1503 was directly attached to the sense wire and the next clockwise segments, 1504, 1505, 1506 were bridged across each gap with the resistive rubber, the resistance would increase as you move clockwise away from the left most segment. For example say that the resistive rubber was 1k ohms at each gap then the sense wire would see 0 ohms for the first left most short circuit sensor segment, 1k ohms if the next clockwise segment 1504 was hit, 2k ohms if the next segment 1505 was hit and finally 3k ohms if the last segment 1506 was hit. By using an analog sensing circuit both the time and resistance could be used to determine impact location. FIG. 16 show a simulated circuit that displays the response of such a system. Notice that the pulse edges on the oscilloscope 1601 are well defined and can easily be used to determine velocity and Y position. Also notice that the voltage drop across the sense resistor 1605 is unique for the short circuit that occurs across each of the four segments. The relays 1602 and capacitors 1603 emulate the sensor conductive sheets/foil/ink and insulator. The digital word generator 1604 fires the relays in successive order and the oscilloscope show each pulse maximum voltage level is increasing as you move toward the sensor wired to the sense wire that is connected to the sense resistor 1605. A sense resistor is used to create a resistive divider network that can detect the change in resistance of the short circuit sensor. Therefore it is obvious to see that both the time of impact, from the leading edge of the pulse, and sensor segment impacted, from the amplitude of the pulse, can be determined from such a circuit. If different resistive rubber was used for each sensor a target could be produced that requires only two wires. For example: if, in FIG. 14, the outer resistive rubber strap had a gap resistance of 100 ohms with a 100 ohm resistive rubber strap connected to the next inner semi conic ring and the semi conic ring had a gap resistive rubber strap of 1k ohms with a 1k ohm resistive rubber strap connected to the inner most cylindrical segmented short circuit sensor which in turn had a resistive rubber strap with a gap resistance of 5k ohms a two wire target could be created. As a projectile passes through each layer a unique resistance would appear across the sense resistor 1605 shown in FIG. 16 and using the leading pulse edge as well as voltage amplitude both the time and identification of which ring and which segment within that ring was shorted by the projectile passing through. In FIG. 14 the outer ring would present a 0, 100, 200 and 300 ohm resistance depending on which segment 1403, 1404, 1405, 1406 is hit starting from the segment 1403 directly attached to the sense wire and moving clockwise. When the projectile proceeds into the next semi conic ring segments 1407, 1408, 1409, 1410 a resistance of 400, 1.4k, 2.4k, 3.4k will be sensed by the two wire target respectively. Finally as the projectile enters the inner most ring segment 1411, 1412, 1413, 1414 a resistance of 4.4k, 9.4k, 14.4k, and 19.4k respectively. As an example a projectile entering the target from the front will hit outer Ring segment 4 and present a sense resistance of 300 ohm. Then Semi Conic ring segment 4 will be hit and present a sense resistance of 3.4k ohms. Next the Inner ring segment 1 will be hit presenting a sense resistance of 4.4k ohms as shown in Table 1. Upon exiting the target the Inner ring segment 3 would be hit presenting a sense resistance of 14.4k ohms. Next the Semi Conic ring segment 2 would be hit presenting a sense resistance of 14k ohms. Finally as it exits the Outer Ring segment 2 a sense resistance of 100 ohms would be presented on the sense wire. So the projectile trajectory can easily be reconstructed simply by looking at the analog voltage levels combined with the leading edges of the pulses generated by each segment.

TABLE 1

Segment Identifying Resistance for Projectile Entering 2 Wire Omni Directional Target

| | Outer Cylindrical Ring Sensor | Semi Conic Ring Sensor Resistance | Inner Cylindrical Ring Sensor |
|---|---|---|---|
| Segment Id | 100 | 1000 | 5000 |
| 1 | 0 | 0 | 1 |
| 2 | 0 | 0 | 0 |
| 3 | 0 | 0 | 0 |
| 4 | 1 | 1 | 0 |
| Sense Resistance | 300 | 3400 | 4400 |

TABLE 2

Segment Identifying Resistance for Projectile Exiting 2 Wire Omni Directional Target

| | Inner Cylindrical Ring Sensor | Semi Conic Ring Sensor Resistance | Outer Cylindrical Ring Sensor |
|---|---|---|---|
| Segment Id | 5000 | 1000 | 100 |
| 1 | 0 | 0 | 0 |
| 2 | 0 | 1 | 1 |
| 3 | 1 | 0 | 0 |
| 4 | 0 | 0 | 0 |
| Sense Resistance | 14400 | 1400 | 100 |

FIG. 17 shows an Omni directional target that has the ability to not only determine X-Y but azimuth and elevation as well. The target is comprised of an outer cylindrical short circuit sensor 1701, inner cylindrical short circuit sensor 1702 and a multi segmented sphere 1703. The sphere short circuit sensor gives the ability to detect X-Y entry and exit points and it can be used to determine both azimuth and elevation of projectile trajectory path. FIG. 18 shows the top view with the outer cylindrical short circuit sensor 1801 and the inner cylindrical short circuit sensor 1802 being spaced at a known distance. The inner sphere 1803 is segmented in both four quadrants and in half creating an eight segmented sensor as shown in FIG. 19. Resistive rubber interconnections could be used to allow you to attach only one sense wire attached to only one of the segments. For example: the upper leftmost segment 1901 was directly wired to the sense wire and the resistive rubber strip traversed clockwise across the entire upper half 1902, 1903, 1904 then dropped down to the lower half 1905 and traverse counter clockwise ending on the front lower segment 1906. When this target is hit from an elevated angle one of the upper segments will be hit upon entry and a lower segment will be hit upon exiting. Just by determining the order of which segments generate pulses, due to short circuiting, the elevation and azimuth can be determined. FIG. 20 shows another embodiment of this Omni directional target. The outer cylindrical short circuit sensor 2001 and inner cylindrical short circuit sensor 2002 are divided into four segments and the spherical sensor 2003 is divided into eight segments. FIG. 21 shows the top view of this target. The outer cylindrical short circuit sensor 2101 is offset by 45 degrees with the inner cylindrical short circuit sensor 2102 thereby increasing the accuracy of the X position. The Y position is calculated using spherical equations based on the time the pulse is generated from the inner ring and the sphere segment as well as the sphere exit time.

FIG. 22 shows an Omni directional elliptical target using segmented sensors. The outer elliptical cylinder short circuit sensor 2201, semi conic elliptical cylinder 2202 and the inner elliptical cylinder short circuit sensor 2203 are divided into four segments. FIG. 23 shows the top view of this invention. Each elliptic ring is offset by 30 degrees 2301, 2302, 2303 significantly improving the ability to detect the X location of impact. FIG. 24 shows a cutaway for the Omni directional elliptical target cut along the Y axis and FIG. 25 shows a cutaway view of the Omni directional elliptical target cut along the X axis. Notice that the slope of the conic elliptical sensor 2401 and 2501, is the same for both cutaways.

FIG. 26 shows a high density polyethylene mannequin torso. This mannequin torso can be instrumented with the Omni directional elliptical target sensors as shown in FIG. 27. In this embodiment the chest and shoulder is one short circuit sensor 2701 and the head is another short circuit sensor 2702. Now the sensor can also be a purely resistive ink/foil sensor that has two conductive busses running up the outer sides vertically and when hit the resistance will change. That change can be detected by the sense resistor circuit show in FIG. 16. The same configuration can be used for thermal heaters to produce a thermal signature. The chest heater can be configured to produce a temperature 10 degrees above ambient while the head heater can be designed to produce a temperature of 20 degrees above ambient generating a human thermal signature. FIG. 28 shows another embodiment where the chest sensor 2801, either short circuit or resistive based, shoulder sensor 2802 and the head sensor 2803 are individually sensed. This target can be hit from slightly less than 180 degrees and each zone can be detected. FIG. 29 shows another embodiment of the invention with a cylindrical kill zone sensor 2901 running down the center of the target. If a short circuit is detected on this sensor a kill shot can be scored by the target acquisition system. FIG. 30 shows another embodiment of this invention having the short circuit or resistive sensor wrapped around the entire torso. Each sensor chest 3001, shoulder 3002, and head 3003 are wrapped entirely around the torso to allow for 360 degrees of impact detection. A thermal heater could be produced in this configuration as well to give a 360 degree human thermal signature. FIG. 31 shows an embodiment with a kill zone sensor in the center 3101. FIG. 32 shows a multi segmented embodiment of the invention. The chest sensor 3201, shoulder sensor 3202, and head sensor 3203 are divided into 4 segments allowing the target to detect which quadrant was hit. Also by examining the projectile exit pulse generated by the change in resistance, for a resistive based sensor, or pulse generated by a short circuit sensor or even a piezoelectric film sensor the azimuth of the projectile trajectory can be determined. FIG. 33 shows another embodiment with a kill zone sensor 3301 running down the center of the mannequin torso.

The draw back from the previous embodiments of the mannequin target is that the X-Y impact location cannot be determined from the sensor configuration. Only an approximation of the azimuth of the projectile can be calculated. FIG. 34 show an Omni Directional segmented mannequin chest and kill zone configuration. This target utilizes all of the primitive embodiments described earlier to detect X-Y impact location from 360 degrees. This embodiment utilized a torso that has a uniformly tapered torso creating a semi conic elliptical shape. By bonding a segmented short circuit/resistive/piezoelectric sensor to both the outer 3401 and inner wall 3403 of the HDPE plastic 3402 and embedding an elliptical cylindrical sensor in the center 3404 along with a segmented kill zone cylinder 3405 in the center a 360 X-Y target with kill/no-kill detection can be created. This target utilizes the fact that both the inner 3403 and outer semi conic sensors 3401 are parallel to each other and at a know distance needed to accurately calculate the projectile velocity. A thermal heater could also be placed inside the inner wall 3403 of the mannequin chest cavity to produce a human thermal signature. FIG. 35 shows the top view of this invention. The outer semi conic elliptical sensor 3501, inner semi conic elliptical sensor 3502, inner elliptical cylinder sensor 3503, and cylindrical kill zone sensor 3504 are all divided into four segments and offset by 30 degrees with respect to each other. FIG. 36 shows the sensors used to create the head and kill zone. The outer sensor 3601 and inner kill zone sensor 3603 are spaced a known distance apart and have a semi conic cylinder sensor 3602 between them. FIG. 37 shows the top view of the current invention embodiment and again all the rings are divided into 4 rings and offset by 30 degrees. FIG. 38 shows the cutaway view of the Omni directional X-Y target. You will notice that the distance from the inner semi conic elliptical sensor to the elliptical cylinder sensor varies from the bottom 3801 of the torso to the top 3802. This slope is used to determine the Y position of impact. Now in this embodiment the shoulder has no vertical reference need to determine the Y position of impact. A series of segmented cascaded elliptical cylinder sensors that stair step their way up the inside of the shoulder cavity 3803 could be used to create that vertical reference. By sensing the time of travel of the projectile through the shoulder outer semi conic elliptical sensor 3804 and inner semi conic elliptical sensor 3805 and determining projectile velocity then measuring the pulse delay time between the inner semi conic elliptical sensor as well as which vertically orientated cascaded elliptical cylinder sensor was hit both X-Y position, azimuth and elevation could be calculated. A thermal heater could be placed in the inner wall of the head and produce a thermal signature in the head that can be seen by aircrafts as a human head signature. By placing the mannequin on a MIT system and adding the ability for it to rotate as well as move up and down a very realistic running man target could be produced. One can change the offset angle and/or divide the sensors into a multitude of segments and/or use more concentric sensors and not deviate from the core essence of this invention.

FIG. 39 shows an embodiment of an actuating mannequin that has the ability to detect X-Y projectile impact and projectile trajectory using non-contact sensing technology. The HDPE mannequin 3901 has articulating appendages that allow it to mimic human response when shot. The mannequin is integrated into the bullet proof control box 3903 with mechanical control assemblies to actuate the mannequin movement and has, in this embodiment, three 3D laser sensors 3902. FIG. 40 shows a top view of the system. The front left 3D laser emitter/sensor 4001 projects the diffused laser beam out at a 210 degree angle from the center of the mannequin and can sense a radius of 180 degrees. The back center 3D laser emitter/sensor 4002 projects the diffused laser beam out at a 90 degree angle from the center of the mannequin and can sense a radius of 180 degrees. The front right 3D laser emitter/sensor 4003 projects the diffused laser beam out at a 330 degree angle from the center of the mannequin and can sense a radius of 180 degrees. This invention uses the 3D laser sensor not only for X-Y projectile impact location it also uses this as a situational awareness system needed to monitor the engaging shooter to determine the mannequin's appropriate engagement response. FIG. 41 shows this inventions 3D lasers sensing area 4101. As a subject approaches the mannequin it utilizes the 3D laser sensors to determine what the subject is doing. For example if the subject reaches for its holstered weapon the mannequin would respond by raising its weapon and firing. The 3D laser sensors also are used to detect incoming projectiles from 360 degrees. This system would work with any type of projectile paintball, simunitions, as well as live rounds and not be limited to a conductive one that is needed for the short circuit sensors. Also because this system is non-contact based the life expectancy would be significantly higher than a contact based target/mannequin. With this type of system the mannequin could be controlled in such a way that when a shot to the right shoulder is detected by that mannequin and it would be momentarily positioned so that it leers back toward its right shoulder and then comes forward and draws its weapon and shoots. Or it can frump to the ground if a fatal impact is determined.

FIG. 42 shows another embodiment of this invention. In this embodiment the three hit detection 3D diffusion lasers are mounted on the 3D laser sensor so that they face toward the adjacent 3D laser sensor. For example the front left 3D laser sensors 4202 is pointed toward the front right 3D laser sensor 4201. The front right 3D laser sensor is pointed toward that back center 3D laser sensor. And finally the back center 3D laser sensor has its laser pointing toward the front left 3D laser sensor. As a projectile 4203 passes through the frontal plane its X-Y entry point is determined and as it exits the mannequin it passes through the back right plane and its X-Y exit point is determined. With this invention not only can the projectile velocity be calculated but the azimuth, elevation, and projectile diameter can also be determined. This embodiment creates a triangular shaped web as shown in FIG. 43. As the projectile 4301 enters through the front plane its position in space is detected by the front left 3D laser sensor 4302 and as it exits through back right plane its position in space is detected by the front right 3D laser sensor 4303. FIG. 44 shows an embodiment that is the combination of the previous inventions. In this embodiment the situational awareness 3D laser sensors face outward and are used to determine how the mannequin is going to respond based on what the approaching subject does. The inner triangular hit detection is performed by a separate set of 3D laser sensors mounted in the same three 3D laser sensor housing. Another embodiment would be to mount the 3D laser sensor in the base control box and have it mounted on a high speed rotating servo system that would swing the 3D laser around sweeping the area. When an incoming projectile is detected both its entry and exit path can be reconstructed from multiple samples detected as it swings through the entry and exit area. The nice thing about this embodiment is that it requires only one 3D laser sensor. In another embodiment only the diffusion laser is mounted to the high speed servo and three or four, one for each side of the control box, laser detector would be permanently affixed to the control box. The laser would illuminate the area and each detector would sense activity in its area of view.

Another embodiment of this invention would be to mount one or two 3D laser sensors in front of a stationary infantry target (SIT), moving infantry target (MIT), stationary armored target (SAT), or moving armored target (MAT). Each 3D laser sensor would detect projectile entry X-Y impact area and if two units are used the exit X-Y position can be determined along with velocity, trajectory path and projectile diameter.

FIG. 45 shows an embodiment of a location of miss and hit (LOMAH) target. This target utilizes short circuit technology as described by earlier inventions. The front of the target has vertical columns of conductive sheet/foil/ink 4501 that are bonded to a non-conductive target medium. The other side of the non-conductive medium contains horizontal rows 4601 of conductive sheet/foil/ink as shown in FIG. 46. Making contact with the conductive columns of the short circuit LOMAH target is easy because they are accessible via the bottom of the target out of harm's way down in the target pit. The problem is how to access the horizontal conductive rows on the back side of the targets non-conductive medium. In this embodiment of the invention the system utilizes a set of insulating sheets with conductive sheet/foil/ink traces running down to the bottom of the target to access all the horizontal conductive rows. FIG. 47 shows the next non conductive sheet 4703 that is bonded to the short circuit target with an adhesive. Exposed on the bonded side are 1 inch square pads of conductive traces which an optional conductive adhesive would ensure a solid electrical connection between each conductive horizontal row of the LOMAH short circuit target and the pickup pads. Because there are more rows needed to be brought to the bottom of the target than there are vertical column space available 2 sets of vertically orientated conductive traces are used with 2 sheets of electrical insulators or non-conductive medium to carry them. The lower set of conductive traces 4701 and 4702 are bonded to the first sheet that is bonded directly, with an adhesive, to the LOMAH conductive horizontal row back side. The rest of the conductive contact pads belong to the second set of conductive traces. FIG. 48 shows the last insulating non-conductive sheet 4803 that carries the second set of vertically orientated traces to the bottom of the target. The conductive traces of the first set of traces 4801 are laminated to the front side of this third sheet 4803 and the second traces 4802 shown on FIG. 49 are laminated to the back side of the insulating sheet. To better display the construction of this invention FIG. 50 shows a transparent wire drawing of the current embodiment. The LOMAH front most vertical columns 5001 can be see clearly and behind them are the conductive horizontal rows 5002. The three insulating non-conducting medium 5003 can be seen in upper right hand corner. The outer most horizontal pass through holes 5004 belong to the second set of vertical conductive traces. As you can see there are 2 sets of pass through holes for the vertically orientated conductive traces compared to the single pass through holes 5005 for the first set of vertically orientated conductive traces. This is because the first set of vertically orientated conductive traces only has to pass through one layer of insulation board whereas the second set of vertically orientated conductive traces has to pass through two boards of insulation. Now that we have brought all the signals to the bottom of the target a connector will need to access them. In this embodiment FIG. 51 shows such a way. By recessing the last insulation board 5101 enough to expose the first set of vertically orientated conductive traces 5103 all needed contact points are available. The front conductive vertical columns 5102 are accessed directly from the front whereas the first sets of conductive rows of the LOMAH target are accessed via the traces exposed 5103 on the second non-conductive sheet. And lastly the remaining conductive rows of the LOMAH target are accessed directly on the backside of the third insulating sheet 5104. FIG. 52 shows all the layers of the short circuit LOMAH target. As you can see the only purpose of the 2 insulating sheets is to prevent the vertically orientated conductive traces from shorting out to the previous layer. With an electrical potential placed across the vertical conductive sensor and the conductive horizontal sensors a short circuit will cause current to flow between the front impacted vertical sensor and the horizontal row sensor. By sensing all the rows and columns the projectile's X-Y impact area is known directly down to the minimum size of the intersecting squares. One inch is used in this embodiment because as you go smaller there is more of a likely chance that the sensor vertical or horizontal will get destroyed or severed, by multiple hits in a close proximity, preventing any further impact detections for that area. Also if a projectile where to hit the through hole directly and the trace width was equal to or less then the diameter of the projectile the vertically orientated trace that brings that signal to the bottom of the target would get severed and fail. One embodiment of an acquisition system for this invention would be to apply a voltage potential across the front vertical sensors and the back horizontal sensors. When a projectile shorts the front vertical sensor to the back horizontal sensor a current detection system would determine X-Y directly knowing which column and which row sensor draws current for that moment in time. As with the previous inventions the conductive sensor are spaced less than the expected projectile diameter so that if it were to hit between two adjacent conductors its exact location would be known. In another embodiment a conductive sheet/foil/ink could be laminated between and insulated from the front vertical sensor and the back horizontal sensors. Then the acquisition system would simply apply a voltage potential on the conductive sheet/foil/ink center and monitor each sense line both vertical and horizontal for a momentary voltage pulse. There are many ways to acquire X-Y location in an invention of this design and not deviate from the core essence of the invention.

FIG. 53 shows an embodiment of a LOMAH target that used the previously described resistive rubber interface to reduce the sense wires down to two wires. The vertical conductive sheet/foil/ink sensors 5301 have a resistive rubber strip 5302 running along the bottom of the target electrically bonded to each vertical sensor. FIG. 54 shows the back side of the LOMAH target. The horizontal rows of conductive sheet/foil/ink sensors 5401 are insulated from the front vertical sensor by a non-conducting insulating sheet 5402 with a thickness that is less than the minimum expected projectile length. Running vertically down the target backside is a resistive rubber strip 5403. This strip shown in this embodiment runs down the middle of the back of the target but it could run offset from center or diagonal or utilize multiple resistive rubber strips and not deviate from the core essence of this invention. The acquisition system needed to sense this invention only needs to supply a voltage potential across one of the front vertical sensors and the back bottom horizontal sensor in order to determine the X-Y location of impact. In one embodiment a whetstone bridge as show in FIG. 16 would be able to detect which front vertical sensor and back horizontal sensor was shorted by the projectile just by the unique resistive value across the sense wires. In another embodiment the LOMAH target could be constructed from an electrically non-conductive rubber sheet that is processed so that just the front and back surfaces are impregnated with carbon to create a known resistance per square on just those surfaces. This could be done by dissolving the rubber in a solvent containing carbon black. Then conductive sheets/foil/ink can be bonded vertically on one side and horizontally on the other. This type of target would have a long life expectancy due to the fact that the non-conductive medium was made from self healing rubber and act as a dual type of target because it would also respond to non penetrating impacts like paintball or airsoft rounds as a contact sensitive target.

FIG. 55 shows another embodiment of the same invention. This LOMAH target requires an additional non-conductive sheet 5501. A contiguous conductive sheet/foil/ink 5502 is laminated between the two insulating sheets. The acquisition system simply applies a voltage potential across the center conductor and both the front vertical sensor and the back horizontal sensors. Three wires are attached to this embodiment and the voltage difference could be measured by two sense resistor circuits as shown in FIG. 16 one detecting X and the other detecting Y based on unique resistance, voltage or current levels.

FIG. 56 show a resistive based LOMAH target. Unlike the short circuit target this one depends on the sensors resistance changing when penetrated by a projectile. The vertical resistive sheet/foil/ink sensor 5601 is tied at the top of the target to a power buss and bonded to a non-conducting media 5602. FIG. 57 shows the power buss with the non-conducting medium removed. As you can see the same power buss 5701 which powers the front vertical resistive sensors also wraps around the back of the non-conducting medium to supply power 5801 to the resistive row sensors 5802 as shown in FIG. 58. One advantage of this invention is that a single power buss wrapped around as shown is significantly resistant to single point failure due to a severed power buss. No single rifle round can severe a buss of this design. FIG. 59 shows the vertical sense wires that attach to each row resistive sensor on the back of the target 5903. Then inner most non-conductive medium 5901 sheet carries half of the row sensors to the bottom of the target while the other half is laminated to the outer non-conductive sheet 5902. FIG. 60 shows a close up image with both non-conducting medium sheets removed. The lower half of the resistive row sensors are electrically bonded to the conductive sheet/foil/ink sense wires 6001 and brought to the bottom of the target. The upper half of the resistive row sensors are electrically bonded to the conductive sheet/foil/ink sense wires 6002 and brought to the bottom of the target. FIG. 61 shows the bottom target electrical interconnecting pads. The front vertical resistive sensors 6103 are connected to directly from the front. The bottom half of resistive row sensors are accessed on the middle non-conductive sheet exposed pads 6101 and the top half of resistive row sensors are accessed on the back of the outer non-conductive sheet exposed pads 6102. When a projectile passes through this LOMAH target it will remove a small amount of resistance in both the column and row resistive sensor. An acquisition system can be designed using a multitude of common instrumentation designs such as Wheatstone bridge, current sensing, or analog multiplexing to determine the X-Y point of impact. In another embodiment both the resistive column and row sensors could be replaced with piezoelectric film sensors. The non-conducting media could be very thin and a contact sensitive paintball or airsoft LOMAH target could be produced. In this embodiment the buss bar is grounded and when the target is impacted both the row and column sensor generate a voltage spike due to the piezoelectric effect.

FIG. 62 shows a LOMAH target formed from applying a resistive film/foil/ink 6203 with conductive film/foil/ink trace sense wires 6202 on thin plastic 6201. This invention contains a kill and no kill sensor. FIG. 62 shows the no kill zone sensor whereas FIG. 63 shows the kill zone sensor with the resistive sensor 6301 and the sense traces 6302. FIG. 64 shows both sensors bonded to a thin plastic sheet with the non kill zone pickup 6401 above the kill zone pickup 6402 and with both sense traces shorted together on the other side 6403.

FIG. 65 show a short circuit version of the same target with the exception of the ability to sense a left non kill zone 6502 hit from a right non kill hit zone 6503. The Kill zone 6501 as well as the other zones are formed from a conductive sheet/foil/ink on a non-conductive medium 6601 as shown in FIG. 66. FIG. 67 shows the backside of the short circuit kill/no kill LOMAH target which has a solid conductive sheet/foil/ink 6701 bonded to the back. The target detects which zone is short circuited using the previously described techniques.

FIG. 68 shows a 3D wire frame image of a HDPE tech truck 6801 that can be used for escalation of force or aerial attack. Each of the short circuit LOMAH panels 6802 can detect X-Y position of impact at that plane. By placing them a known distance apart the trajectory of a projectile can be exactly calculated and re-animated on a remote computer screen. The actual damage due to the projectile can be reenacted knowing the trajectory path and typical response of a projectile of that type traveling down that trajectory. Also the sensor in FIG. 1 could be laid on its side in front of the grill and act as a LOMAH X-Y detector for an escalation of force MAT vehicle mounted on rails. In another embodiment the short circuit panels could be placed inside a pop-up vehicle target and add LOMAH capabilities as well as realistic RF signature to aircrafts. A pop-up vehicle target is usually made from cloth and has bars and cables used to stand it upright. If these LOMAH sensors were placed across every support bar a LOMAH vehicle target with trajectory would be possible.

FIG. 69 shows a standard B27 silhouette target on an overhead runner clamp 6901. In this invention short circuit technology is used to determine which ring has been hit on a B27 target and to display it on a remote screen at the shooters station. FIG. 70 shows a non-conductive medium 7001 with a conductive sheet/foil/ink 7002 bonded to the front side. FIG. 71 shows that back side of the non-conductive sheet with concentric rings of conductive sheet/foil/ink 7101 electrically separated from each other by 0.2 inches. FIG. 72 shows the second non-conductive sheet backside 7202 with the conductive sheet/foil/ink traces 7201 running each ring sense signal to the top pickup. FIG. 73 shows the back concentric rings 7303 with both the target and insulating non-conductive medium removed. The sense wires/foil/ink 7301 are electrically bonded to them and insulated from the other rings by the second, not shown, non-conductive medium. The center bulls eye target ring has a 2" wide sense wire/foil/ink 7301 brought to the top where the other rings have two 1" wide sense wire/foil/ink 7302 brought to the top. FIG. 74 shows a 3D wire drawing of the top interconnections. The runner clamp 7401 has guide pins 7402 that allow the target to be properly aligned for the contact pins 7404 to make electrical connections with the sense wires 7403. FIG. 75 show the contact pins 7501 that make connection with the front sensor. FIG. 76 shows an exploded diagram of each layer that makes this embodiment of the B27 ring sensing target. Lastly in order to reduce the complexity and cost of the B27 target a resistive rubber strip 7701 along with a conductive sheet/foil/ink 7702 can be used to create a 2 wire sensing target as shown in FIG. 77. When a projectile hits the front sensor and proceeds through the non-conductive medium and makes contact with a ring a unique resistance will be presented on the two wire system representing that ring just as shown in the earlier LOMAH invention.

FIG. 78 shows the backside of a mannequin torso with foil busses 7801 running up to the head of the mannequin torso. These busses can supply power for a thermal heater or hit detector using resistive or short circuit sensor. In this embodiment the busses are constructed from conductive ink or foil strips laminated between a plastic sheet and double sided adhesive foam. Each end of the conductive busses are electrically connected to standard male snap 7901 connectors as shown in FIG. 79. The eyelet 7902 is riveted through the polycarbonate plastic while the base makes direct contact with the conductive ink/foil. The double sided adhesive foam is then laminated to the bottom and bonded to the HDPE mannequin torso. The heater membrane or impact sensor is then riveted with an eyelet and a snap socket 7903 to mate with the conductive ink/foil buss.

FIG. 80 shows another embodiment where the conductive ink/foil busses terminate with molded power connectors.

FIG. 81 shows a thermal heater/hit detector comprised of resistive ink formed in a matrix pattern 8101. The power buss 8102 is formed from purely conductive ink and is in direct contact with the resistive ink matrix. Both the resistive matrix heater/hit detector are bonded to a plastic sheet 8103.

FIG. 82 shows the same resistive matrix thermal heater/impact sensor with power busses formed from a matrix of conductive ink 8201. The matrix based power buss uses purely conductive traces but because it is not solid it uses approximately 40% less conductive ink significantly reducing the cost while maintaining a robust buss that will survive live fire.

FIG. 83 shows an embodiment that utilized aluminum foil to create a robust power buss.

The aluminum buss is folded around the back of the plastic substrate for form a ultra wide buss. This foil can be applied to the plastic substrate prior to the printing of the resistive ink or in a post process where it is in contact with the purely conductive power buss as shown in FIG. 84. The resistive matrix 8401 is in contact with the purely conductive buss 8402, which are both laminated to the front of the thermal panel 8405. The aluminum foil 8403 is in direct contact with the conductive buss and is wrapped around the back of the back substrate to form a very robust power buss that can withstand large projectiles passing through an not degrade its ability to supply power or signal. FIG. 85 shows the close up view of the edge of the plastic substrate where the aluminum foil wraps around the back side.

In another embodiment snap connectors in FIG. 79 can be used to electrically tie multiple sheets of different temperature heating panels to create a thermal signature of a vehicle such as a Tank or Tech truck. By offsetting the snap connectors a distance equivalent to the buss width the problem with cold bands running down a target can be avoided. The cold bands are created by the purely conductive busses which do not generate any heat but are needed to power the resistive heater. By offsetting them the conductive buss rides over the adjacent heater panel which heats the buss up thereby giving a homogeneous realistic vehicular thermal signature.

Mannequin lifter systems and methods for determining an impact of a projectile onto mannequin targets are provided herein. For example, a mobile mannequin lifter 8601 includes a linear actuator 8602 as depicted in FIG. 86-FIG. 89. The linear actuator drives a mannequin target 8603 up using a servo or stepper motor 8604. On the top of the linear actuator is a solenoid 8605 that when activated causes the entire mannequin to drop. An arm 8701 of a mannequin 8603 has a cable or strap 8607 that is attached and extends upwardly to a pulley 8608 where it wraps around and down to a servo/stepper arm control motor 8804 that controls the movement of arm 8701 via the rotation of a take-up spindle 8801 which receives the strap 8607. A tension sensor 8803 is located right next to take-up spindle 8801 of a motor 8804 to ensure that the cable is never allowed to lose so much tension that it would come off the spindle as depicted in FIG. 88. Arm control motor 8804 ensures that the arm can independently be remotely controlled or use an embedded processor (not shown). FIG. 87 shows mannequin 8603 in a raised position, with arm 8701 shown in a raised position, along with a lower position thereof depicted in phantom lines. FIG. 88 shows a close-up of arm control motor 8804 with tension sensor 8803. In particular, arm control motor is coupled or connected to cable or strap 8607 such that by retracting or extending cable or strap 8607 (i.e., via the rotation of spindle 8801) arm 8701 may be raised or lowered. For example, the arm may be raised to present the appearance of a target (i.e., mannequin 8603) being armed with a weapon. In another embodiment the arm could be lifted using synthetic muscle membrane.

A platform 8610 supporting mannequin lifter 8602 and mannequin 8603 is mounted on a servo controlled set of wheels 8606 as depicted in FIG. 86-FIG. 89. A system controller (not shown) may guide the unit (i.e., platform 8610 with lifter 8602 and mannequin 8603) along a surface using a preprogrammed scenario or manually using a RC hand held controller, for example.

Using a hit technology sensor (e.g., a projectile impact detection system as described in co-owned U.S. Pat. Nos. 5,516,113, 7,207,566 and/or 7,862,045 and described within) solenoid 8802 may be activated remotely/or directly using an embedded processor to cause mannequin 8603 to drop when a hit is detected. Thus, the impact of a projectile upon mannequin target 8603 may be detected by such a hit technology sensor or projectile impact detection system such that the detection of the projectile causes the solenoid to be activated thereby causing the mannequin to drop to a lower position (e.g., as depicted in FIG. 86) indicating to someone viewing the mannequin that the mannequin has been hit. A spring 8609 on platform 8610 may be used to absorb the shock on the mannequin when the mannequin falls onto the platform as depicted in FIG. 86.

A pulley/cable system 8905 is located in a leg 8906 of mannequin 8603, which is not directly driven by linear actuator 8602 as is a driven leg 8902, and the base is used to supply lift for non powered leg 8906 as depicted in FIG. 86-FIG. 89. FIG. 89 shows a close-up of cable pulley system 8906 used to lift non-powered leg 8906. A cable 8907 is attached to an interior of platform 8610 through a series of pulleys 8906 as depicted in FIG. 89. In particular, cable 8907 is attached to a portion of leg 8901 and/or actuator 8602 such that cable 8907 is pulled as the actuator extends vertically upward to cause movement of cable 8907 along pulleys 8902, 8903, 8904 such that leg 8906 is also moved upward at the same time leg 8901 is moved upward. For example, the cable may be attached to leg 8906 and extend upwardly to a first pulley 8904 then extend downwardly to a second pulley 8903 followed by extending horizontally to a third pulley 8902 and then extend upwardly to attach to leg 8901 or the linear actuator such that as leg 8901 is raised cable 8905 is pulled to raise leg 8906.

In another example, FIG. 90-FIG. 91 shows a system without a motorized arm control unit which is mounted, as an add-on option, to a standard popup target lifter 9001 in both a sitting position 9004 and a lying down position 9005, respectively. This system allows a controller 9102 to program a mannequin target 9003 for a multitude of scenarios. An arm 9002 is attached to a cable/strap 9106 that travels around a pulley 9107 in its shoulder and travels down to a base 9105 where it is secured with a removable pin 9104. Cable 9106 is attached via the removable pin to the base so if the user does not want to utilize a weapon in the hand of arm 9002 the user may simply remove pin 9104 from base 9105, thereby causing the arm and weapon to be in a lowered position. On the contrary, when pin 9104 is connected to base 9105 as the mannequin (i.e., target 9003) is being lifted, tension is put on cable 9106 causing arm 9002 to rise up. FIG. 91 shows the mannequin in the up position with arm 9101 lifted. A solenoid (not shown) may be placed in the hand of the mannequin to cause the gun to drop based on a remote command or using an embedded processor. The gun also may be programmed to fire remotely (i.e., by remote control) or to be controlled by the embedded processor that uses a wired or wireless network to communicate with the control program. It could fire a bright LED, shoot an Airsoft pellet, paintball, or a MILES gear laser. An AK-47 weapon could also be lifted with such a system if both hands were mounted to the gun, for example. The lifting arm described above relative to FIG. 90-FIG. 91, for example, could be composed of a composite plastic or expendable material that when shot with live rounds could easily be replaced in the field. This invention allows the mannequin to be concealed when in the down position. When raised up by the standard target lifter 9001 then lifted by the vertical lifter 9103, described earlier in previous embodiments, the mannequin would be unconcealed.

FIG. 92-FIG. 94 show a mannequin target 9201 with telescopic legs 9202. A drive system is composed of a servo/stepper motor 9401 and a worm drive screw 9402. The screw drives the target (i.e., mannequin target 9201) to a top position and allows a solenoid 9403 mounted in the leg to lock mannequin target 9201 into place at such elevated position. FIG. 93 shows this system with mannequin 9201 in the top position while FIG. 92 shows mannequin 9201 in a lowest position. FIG. 94 shows a close up of a bottom portion of mannequin target 9201 including motor 9401, drive screw 9402, and solenoid 9403. As described above relative to FIG. 86-FIG. 88, solenoid 9403 may be used to drop mannequin 9201 from a raised position as depicted in FIG. 93 to a lowered position depicted in FIG. 92. In particular, when a particular portion of mannequin 9201 having an impact sensor located thereon is impacted (e.g., via a projectile impact detection system as described above), solenoid 9403 may be activated to cause mannequin 9201 to descend to its lowest vertical position. Other mechanisms for allowing the legs to disengage and descend in response to the impact of a projectile could also be utilized.

FIG. 95 shows a mannequin 9501 that uses a cable/strap system 9503 to allow mannequin 9501 to frump down to a lowest position. A linear screw-drive 9502 may cause tension on a cable 9503 that is wrapped around the ankle, knee and attached to the chest of the mannequin torso. Each joint is movable and will force the mannequin to stand erect when tightened by drive 9502 (i.e., when drive 9502 pulls on cable 9503). When a hit is detected by an impact detection system such as that described above, a solenoid 9504 (e.g., coupled to a controller for receiving data from the impact detection system) that holds cable 9503 to screw-drive 9502 energizes and pulls a pin 9601 allowing the cable to release and the mannequin to free fall to the ground. Other mechanisms for allowing such release could also be utilized. FIG. 96 shows a close-up of the system in the down position with a linear actuator/screw 9602 of drive 9603 in its fully extended position (i.e., when little or no tension is applied to cable 9604). FIG. 97 shows mannequin 9701 in the up position. Once the target controller receives a target up command the linear actuator(s) fully retract. FIG. 98 shows a close-up of the cable/strap system with linear actuator/screw 9802 of drive 9803 fully retracted and solenoid 9801 in the armed position (i.e., such that solenoid 9801 contacts and holds screw 9802). The tension on the cable/belt system 9804 causes the legs to straighten and the torso to rotate to the upright position. By using independent drive systems on each leg the mannequin could be driven in such a way as to have it lean/leer when hit by a projectile. For example if a projectile is detected by the right shoulder sensor then the left leg linear drive could move forward giving the cable/strap system slack causing the mannequin to lean/leer left. By driving each linear actuator in opposite directions a multitude of movements could be created.

FIG. 99 shows an interconnecting buss for a mannequin leg or arm created for thin plastic, coated with conductive ink or conductive foil. Each upper circle 9902 (e.g., a ring of ink) is connected to a buss 9903 that supplies power and/or signal down to a low ring 9904 (e.g., via a cavity in arm). This system can be bonded to a mannequin using double sided adhesive foam/psa, for example. A covered area 9905 could be an impact sensor (e.g., a projectile or hit technology sensor as described above) or a thermal generator (e.g., as described in co-owned U.S. patent application Ser. No. 11/853,574, filed Sep. 11, 2007, entitled "Thermal Target System" depending on the application. FIG. 100 shows an example of a torso 10001 and arm 10002 connected to each other utilizing buss 10004 for electrically connecting such an arm and torso. Interconnecting busses (e.g., interconnecting buss 10004) could be utilized to form interconnecting joints in an arm (e.g., arm 10002) and an elbow (e.g., elbow 10003) and would contain the circuit allowing signals/power to be delivered to each appendage and be resilient against bullet (or other projectile) penetration. Because of the redundant busses (e.g., FIG. 99 Buss 9903) and wide rings (e.g., FIG. 99 rings 9902 and 9904) this system is robust against failure due to bullet impacts. For example, if projectiles form holes in one of FIG. 99 rings 9902 other of such rings could still maintain an electrical connection between an arm and a torso.

In another example, FIG. 101 shows membrane busses which may be utilized to supply signals/power to the torso, upper arm, and lower arm. FIG. 102 shows an isometric 3D model of how a flexible buss could be mounted in one embodiment. FIG. 103 shows another isometric view of the same 3D model depicted in FIG. 102. FIG. 104 shows a close-up of how a lower arm membrane 10401 could be attached with dimples 10402 to fix the position of the lower arm to an upper arm having corresponding nipples that locks into the dimples. FIG. 105 shows an isometric close-up view of the 3D upper arm assembly. The membrane buss system is adhered to the plastic arm so that when the entire arm is assembled and that arm assembly is attached to the mannequin they all electrically interconnect.

FIG. 106-FIG. 107 depicts an embodiment of a mannequin rotation system which allows a mannequin target to rotate 360 degrees. The system is driven by a motor 10601 (e.g., controlled by a controller programmed, or remotely controlled, by a user) and has a drive gear 10602 attached to a shaft of the motor. A linear actuator vertical drive mechanism 10606 is attached to and rotated by a base gear 10603. The base gear rests on a bearing system, such as a Lazy Susan or slip gear mechanism 10604, that is attached to a stationary base plate 10605. FIG. 107 shows a close up view of the rotating drive mechanism. Base gear 10701 is mounted to a Lazy Susan bearing 10702 that allows it to freely rotate. The motor is attached to a mounting bracket 10703 that holds a drive gear 10704 against base gear 10701. A remotely commanded mannequin 10800 shown in FIG. 108 is rotated in a desired direction. In this embodiment a base plate 10801 and control box 10802 are stationary and only a drive mechanism suspending a mannequin torso of mannequin 10800 rotates.

FIG. 109 shows a nylon strap/rope/chain driven mannequin target 10901 with articulating arms and legs. A control box 10902 uses a motor 10905 to raise and lower the mannequin. The motor has two spindles 10910 that spool up nylon straps 10903 in each leg which cause the legs to straighten. Each strap 10903 passes through a pin in the base of each leg, up through and over a knee pin, and around the hip to a back of the torso. A pin 10904 located part way up the calf is attached to control box 10902 and allows the leg to rotate about that point (i.e., the location of the pin). The torso has indentations 10906 in the lower cavity to allow it to frump down parallel to the floor as depicted in FIG. 109. As the strap tightens due to the action of motor 10905 the legs extend and the torso rotates up until the knee hits a protruding mechanical stop 10908, the calf hits a mechanical stop 10909 in a base of control box 10902 and a torso stop pin 10907 hits the end of the channel formed in the hip thereby ceasing motion of the portions associated with the respective stops. This system would also work using a linear actuator or screw drive to pull the nylon strap (i.e., as described above) instead of motor 10905 having spindles 10910 in another example. Also two independent motors could be used to control each leg giving the target the ability to lean when a hit is detected on the left or right side (i.e., due to the tightening or loosening performed by one or both of the motors). For example, by driving one motor to apply slack to one strap and not the other, the target would appear to lean/leer when hit. Control box 10902 utilizing motor 10905 may raise and lower mannequin 10901 based on an impact to a portion of mannequin 10901 determined by an impact detection system as described above. For example, if mannequin 10901 is in an upper position as depicted in FIG. 109, and a projectile impacts a portion of mannequin 10901 covered by such an impact detection system, control box 10902 utilizing motor 10905 may cause the mannequin to be lowered to a position depicted in FIG. 109.

FIG. 110 shows another embodiment of this invention that utilizes a synchronous belt 11001 to rotate a torso 11004 of a mannequin 11000 relative to a remainder thereof. The torso has a synchronous gear 11002 bonded to/formed in it. A lower calf has a synchronous gear 11005 bonded to/formed in it. A synchronous belt 11001 causes the torso to rotate upwardly in sync with the calf rotating toward an alignment of the longitudinal dimension with the vertical. Belt 11001 may be wound around a spindle 11003 by a motor (not shown) to cause mannequin 11000 to be raised from a lowered position in FIG. 110 to a raised position in FIG. 110Error! Reference source not found. Upon an impact of projectile on mannequin 11000 determined by an impact detection system as described above, the motor coupled to such a system may allow spindle 11003 to rotate backwardly or cut power to the motor and allow it to freefall such that mannequin 11000 may be lowered.

FIG. 111 shows another embodiment of the present invention that is driven by two synchronous belts and a linear actuator. As a linear actuator 11106 retracts an extension rod 11109 thereof calf 11102 of a mannequin 11100 is rotated on a stationary spur gear 11104 which forces a mating spur gear, that is attached to the synchronous belt gear 11103, to rotate clockwise. There are two synchronous gears 11105 in the knee. One of gears 11105 is attached to an upper leg 11101 and the other is attached to calf 11102. A mating synchronous gear in the knee that attached to/formed into the upper leg runs on the synchronous belt in the calf causing the upper leg to rotate clockwise. The other synchronous gear in the knee that is attached to the lower calf causes the belt in the upper leg to move counter clockwise causing the torso, with the synchronous gear attached or molded into it, to rotate counterclockwise. Mechanical stops are not required in this embodiment because the travel distance is controlled by the linear actuator 11106 restricting the travel distance of both the torso and the leg assembly. A motor 11107 is attached to a block with a pin 11108 that allows it to rotate and align itself with the lower pin in the bottom of the calf. In order to get the torso to rotate up into the correct position and slightly smaller gear is placed in the knee than in the torso. The gear ratio will allow the torso to rotate farther than the calf.

In another example, two independent linear actuators/screw-drives could be used to allow for a leaning motion of the mannequin by independently moving one and not the other of such actuators/screws or driving them in opposite directions. FIG. 112 shows rod 11202 of the linear actuator 11203 fully retracted and mannequin 11201 upright. As described above, mannequin target 11201 could include an impact detection system such that an impact of projectile with mannequin target 11201 may cause rod 11202 to be extended such that mannequin 11201 is placed in a lowered position as depicted in FIG. 111.

FIG. 113-FIG. 114 show another embodiment of this invention where one dual ribbed synchronous/timing belt 11302 is used. In this embodiment there are two synchronous gears 11303 in the knee but only one is attached to an upper leg 11301 while the other is freewheeling. As a linear actuator 11304 retracts the calf rotates counterclockwise; and the gear, attached to the synchronous gear, rotates clockwise causing the belt to first travel over the freewheeling gear then to the top of the torso synchronous gear causing the torso to rotate counter clockwise then over the synchronous gear attached to the upper leg causing the upper leg to rotate clockwise. There is no need for mechanical stops in this embodiment due to the restricted travel distance of the single dual ribbed belt. In another embodiment a rack and pinion system could be utilized. For example, such a system could include a pinion bar that is formed into an arc that a spur gear attached to a lower synchronous gear rides directly on. This would keep the bottom synchronous gear down inside the control box. As described above relative to the other embodiments, an impact detection system could be coupled to a motor controlling linear actuator 11304 such that an impact on a portion of mannequin target 11300 such that the impact would cause mannequin target 11300 to be lowered from the upright position depicted in FIG. 114 to a lower position as depicted in FIG. 113.

FIG. 115 shows an embodiment where the earlier described examples could be combined into a "Running Man" mannequin invention running on a rail drive system. A strap/synchronous belt driven mannequin is combined with a rotating mannequin invention to produce a system that could be attached to a moving infantry target (MIT) system. For example, such a mannequin could bob down, as shown in FIG. 116-FIG. 118, and weave as needed and rotate, as shown in FIG. 119-FIG. 120, and engage the shooter by presenting a very realistic target. In this embodiment a control box 11501 (FIG. 115 is attached to the infantry target mover that runs on rails 11502 (FIG. 115) via a rotating platform.

Using impact sensor technology such as disclosed in U.S. Pat. Nos. 5,516,113, 7,407,566 and/or 7,862,045, the mannequins described herein may be actuated to cause them to move from, for example, an upright position to a frump or fall position. For example, if an impact is detected on the mannequin, the actuator can be signaled from the processor associated with the sensing system to cause the mannequin to fall and/or rotate indicating that the mannequin has been hit by a projectile, such as a bullet. The movement of the mannequin, e.g., a fall and/or rotation, can be dependent upon the area of impact.

It would be understood to one skilled in the art that the above described examples of mannequin targets could be utilized with an impact detection system for determining when such a mannequin target has been impacted by a bullet, or other projectile (e.g., the systems disclosed in U.S. Pat. Nos. 5,516,113, 7,407,566 and/or 7,862,045) and the mannequin targets may be lowered based on the determination of such an impact to present a realistic response to a shooter causing such impact distant from the target. The described mannequin targets may also present thermal images to present realistic targets to the user (e.g., during a training exercise). Examples of the use of such thermal images are described in co-owned U.S. patent application Ser. No. 11/853,574, filed Sep. 11, 2007, and entitled "Thermal Target System" The raising and lowering of the mannequin targets described above in response to the detection of an impact, or otherwise, may also be done using various mechanisms as described above and as would be known to one skilled in the art.

One skilled in the art of electronics and mechanical engineering could produce a multitude of different variations and not deviate from the core essence or spirit of these inventions. While several aspects of the present invention have been described and depicted herein, alternative aspects may be affected by those skilled in the art to accomplish the same objectives. Accordingly, it is intended by the appended claims to cover all such alternative aspects as fall within the true spirit and scope of the invention.

The invention claimed is:

1. A target system comprising:

a mannequin target;

a mechanism coupled to said mannequin target and moveable to allow said mannequin target to move between a retracted position and an upright position;

a projectile impact detection system coupled to said mannequin target to determine an impact of a projectile onto said mannequin target;

said projectile impact detection system being configured to produce a signal as a result of a projectile impacting said mannequin target to allow said mechanism to position said mannequin target in said retracted position, wherein said mannequin falls into a retracted position upon impact of the projectile on said mannequin target to simulate a fallen target; and said mechanism comprising a belt coupled to a leg of said mannequin target and a torso of said mannequin target, said belt being retractable to cause said mannequin target to move from said retracted position to said upright position.

2. The target system of claim 1 wherein said mechanism comprises one or more of a cable and pulley system.

3. The target system of claim 1 wherein the mechanism comprises a pneumatic cylinder.

4. The target system of claim 1 wherein the mechanism comprises a linear actuator.

5. The target system of claim 1 further comprising a motor coupled to said mechanism to drive said mechanism.

6. The target system of claim 1 further comprising a solenoid coupled to said mechanism to initiate movement of said mechanism.

7. The target system of claim 1 further comprising a sensor coupled to said mechanism to detect the position of said mechanism when said mechanism is in an upright position.

8. The target system of claim 1 further comprising a rotation mechanism coupled to said mannequin target to control a rotation of said mannequin target about an axis parallel to a longitudinal dimension of said mannequin target.

9. The target system of claim 8 wherein said mannequin target comprises one or more arms moveable relative to a torso section of said mannequin target wherein said one or more arms simulate a shooting position when said mannequin target is in its upright position.

10. The target system of claim 9 wherein said one or more arms fold into a retracted position when the mannequin target is in a retracted position; said one or more arms being connected to said mechanism and wherein the position of said one or more arms is controlled by said mechanism.

11. The target system of claim 1 wherein said mechanism is connected to a pop-up target lifter configured to move said target mechanism from a reclined position to a sitting position, said sitting position comprising said retracted position.

12. The target system of claim 11 wherein said leg folds into a retracted position when the mannequin target is in a retracted position; said leg being connected to said mechanism and wherein the position of said leg is controlled by said mechanisms.

13. The target system of claim 1 wherein said mannequin comprises a calf portion connected to a an upper leg portion connected to a torso, a first synchronous gear between said calf portion and said leg portion and a second synchronous gear between said upper leg and said torso, the first gear and the second gear being dimensioned to cause the mannequin to move to the upright position in response to the belt being retracted.

14. The target system of claim 1 wherein an entirety of said mannequin target is movable from a first place along a surface to a second place along a surface to allow said mannequin to act as a moving infantry target.

15. A method comprising:

providing a mannequin target;

providing a mechanism coupled to said mannequin target and moveable to allow said mannequin target to move between a retracted position and an upright position;

coupling a projectile impact detection system to said mannequin target to determine an impact of a projectile onto said mannequin target;

configuring said projectile impact detection system to produce a signal as a result of a projectile impacting said mannequin target to allow said mechanism to position said mannequin target in said retracted position, wherein said mannequin falls into a retracted position upon impact of the projectile on said mannequin target to simulate a fallen target; and coupling a belt to a leg of the mannequin target and a torso of the mannequin target, and retracting the belt being to cause the mannequin target to move from the retracted position to the upright position.

16. The method of claim 15 wherein said mechanism comprises one or more of a cable and pulley system.

17. The method of claim 15 wherein the mechanism comprises a pneumatic cylinder.

18. The method of claim 15 wherein the mechanism comprises a linear actuator.

19. The method of claim 15 further comprising coupling a motor to said mechanism to drive said mechanism.

20. The method of claim 15 further comprising coupling a solenoid to said mechanism to initiate movement of said mechanism.

21. The method of claim 15 further comprising coupling a sensor coupled to said mechanism to detect the position of said mechanism when said mechanism is in an upright or retracted position.

22. The method of claim 15 further comprising rotating said mechanism said mannequin target about an axis parallel to a longitudinal dimension of said mannequin target.

23. A target system of claim 22 wherein said mannequin target comprises one or more arms moveable relative to a torso section of said mannequin target wherein said one or more arms simulate a shooting position when said mannequin target is in its upright position.

24. The method of claim 23 wherein said one or more arms fold into a retracted position when the mannequin target is in a retracted position; and connecting said one or more arms to said mechanism such that the position of said one or more arms is controlled by said mechanism.

25. The method of claim 15 further comprising connecting the mechanism to a pop-up target lifter configured to move said target mechanism from a reclined position to a sitting position, the sitting position comprising the retracted position.

26. The method of claim 25 wherein said leg folds into a retracted position when the mannequin target is in a retracted position; and connecting said leg to said mechanism such that the position of said leg is controlled by said mechanisms.

27. The method of claim 15 further comprising moving an entirety of the mannequin target from a first place along a surface to a second place along the surface to allow the mannequin to act as a moving infantry target.

28. The method of claim 15 wherein the mannequin comprises a calf portion connected to a an upper leg portion connected to a torso, a first synchronous gear between the calf portion and the leg portion and a second synchronous gear between the upper leg and the torso, and the retracting causes movement between the calf, upper leg portion, the first gear and the second gear to cause the mannequin target to move to the upright position.

29. A target system comprising:

a mannequin target;

a mechanism coupled to said mannequin target and moveable to allow said mannequin target to move between a retracted position and an upright position;

a projectile impact detection system coupled to said mannequin target to determine impact of a projectile onto said mannequin target;

said projectile impact detection system being configured to produce a signal as a result of a projectile impacting said mannequin target to allow said mechanism to position said mannequin target in said retracted position, wherein said mannequin falls into a retracted position upon impact of the projectile on said mannequin target to simulate a fallen target;

a rotation mechanism coupled to said mannequin target to control a rotation of said mannequin target about an axis parallel to a longitudinal dimension of said mannequin target;

said mannequin target comprises one or more arms moveable relative to a torso section of said mannequin target wherein said one or more arms simulate a shooting position when said mannequin target is in its upright position; and said one or more arms folding into a retracted position when the mannequin target is in a retracted position; said one or more arms being connected to said mechanism and wherein the position of said one or more arms is controlled by said mechanism.

30. A target system comprising:

a mannequin target;

a mechanism coupled to said mannequin target and moveable to allow said mannequin target to move between a retracted position and an upright position;

a projectile impact detection system coupled to said mannequin target to determine impact of a projectile onto said mannequin target;

said projectile impact detection system being configured to produce a signal as a result of a projectile impacting said mannequin target to allow said mechanism to position said mannequin target in said retracted position, wherein said mannequin falls into a retracted position upon impact of the projectile on said mannequin target to simulate a fallen target; and said mechanism is connected to a pop-up target lifter configured to move said target mechanism from a reclined position to a sitting position, said sitting position comprising said retracted position; and wherein said leg folds into a retracted position when the mannequin target is in a retracted position; said leg being connected to said mechanism and wherein the position of said leg is controlled by said mechanisms.

31. A method comprising:

providing a mannequin target;

providing a mechanism coupled to said mannequin target and moveable to allow said mannequin target to move between a retracted position and an upright position;

coupling a projectile impact detection system to said mannequin target to determine an impact of a projectile onto said mannequin target;

configuring said projectile impact detection system to produce a signal as a result of a projectile impacting said mannequin target to allow said mechanism to position said mannequin target in said retracted position, wherein said mannequin falls into a retracted position upon impact of the projectile on said mannequin target to simulate a fallen target;

rotating said mechanism said mannequin target about an axis parallel to a longitudinal dimension of said mannequin target;

said mannequin target comprising one or more arms moveable relative to a torso section of said mannequin target wherein said one or more arms simulate a shooting position when said mannequin target is in its upright position;

said one or more arms folding into a retracted position when the mannequin target is in a retracted position; and connecting said one or more arms to said mechanism such that the position of said one or more arms is controlled by said mechanism.

32. A method comprising:

providing a mannequin target;

providing a mechanism coupled to said mannequin target and moveable to allow said mannequin target to move between a retracted position and an upright position;

coupling a projectile impact detection system to said mannequin target to determine an impact of a projectile onto said mannequin target;

configuring said projectile impact detection system to produce a signal as a result of a projectile impacting said mannequin target to allow said mechanism to position said mannequin target in said retracted position, wherein said mannequin falls into a retracted position upon impact of the projectile on said mannequin target to simulate a fallen target;

connecting the mechanism to a pop-up target lifter configured to move said target mechanism from a reclined position to a sitting position, the sitting position comprising the retracted position;

said leg folding into a retracted position when the mannequin target is in a retracted position; and connecting said leg to said mechanism such that the position of said leg is controlled by said mechanisms.

33. A target system comprising:

a mannequin target;

a mechanism coupled to said mannequin target and moveable to allow said mannequin target to move between a retracted position and an upright position;

a projectile impact detection system coupled to said mannequin target to determine impact of a projectile onto said mannequin target;

said projectile impact detection system being configured to produce a signal as a result of a projectile impacting said mannequin target to allow said mechanism to position said mannequin target in said retracted position, wherein said mannequin falls into a retracted position upon impact of the projectile on said mannequin target to simulate a fallen target; and said mechanism comprising a cable coupled to a leg of said mannequin target and a torso of said mannequin target, said cable being retractable to cause said mannequin target to move from said retracted position to said upright position.

34. A target system comprising:

a mannequin target;

a mechanism coupled to said mannequin target and moveable to allow said mannequin target to move between a retracted position and an upright position;

a projectile impact detection system coupled to said mannequin target to determine an impact of a projectile onto said mannequin target;

said projectile impact detection system being configured to produce a signal as a result of a projectile impacting said mannequin target to allow said mechanism to position said mannequin target in said retracted position, wherein said mannequin falls into a retracted position upon impact of the projectile on said mannequin target to simulate a fallen target; and an arm control mechanism comprising a cable coupled to an arm of said mannequin target and a torso of said mannequin target, said cable being retractable to cause said arm to move relative to a torso section of said mannequin target between a lowered position and a raised shooting position.

35. A target system comprising:

a mannequin target;

a mechanism coupled to said mannequin target and moveable to allow said mannequin target to move between a retracted position and an upright position;

a projectile impact detection system coupled to said mannequin target to determine an impact of a projectile onto said mannequin target;

said projectile impact detection system being configured to produce a signal as a result of a projectile impacting said mannequin target to allow said mechanism to position said mannequin target in said retracted position, wherein said mannequin falls into a retracted position upon impact of the projectile on said mannequin target to simulate a fallen target;

said mechanism further comprises a cable or belt coupled to a lower portion of said mannequin target and an upper portion of said mannequin target, said cable or belt being retractable to cause said mannequin target to move from said retracted position to said upright position;

a movable platform supporting said mannequin target and said mechanism; and a movement controller coupled to said platform and configured to cause movement of said platform.

* * * * *

UNITED STATES PATENT AND TRADEMARK OFFICE

CERTIFICATE OF CORRECTION

PATENT NO. : 8,925,925 B2
APPLICATION NO. : 13/042351
DATED : January 6, 2015
INVENTOR(S) : Bruce Hodge It is certified that error appears in the above-identified patent and that said Letters Patent is hereby corrected as shown below:

In the Drawings,

Delete "Sheet 93 of 115" and Replace with --Replacement Sheet 93--

Delete "Sheet 104 of 115" and Replace with --Replacement Sheet 104--

Signed and Sealed this
Twenty-eighth Day of July, 2015

Michelle K. Lee

Michelle K. Lee
*Director of the United States Patent and Trademark Office*

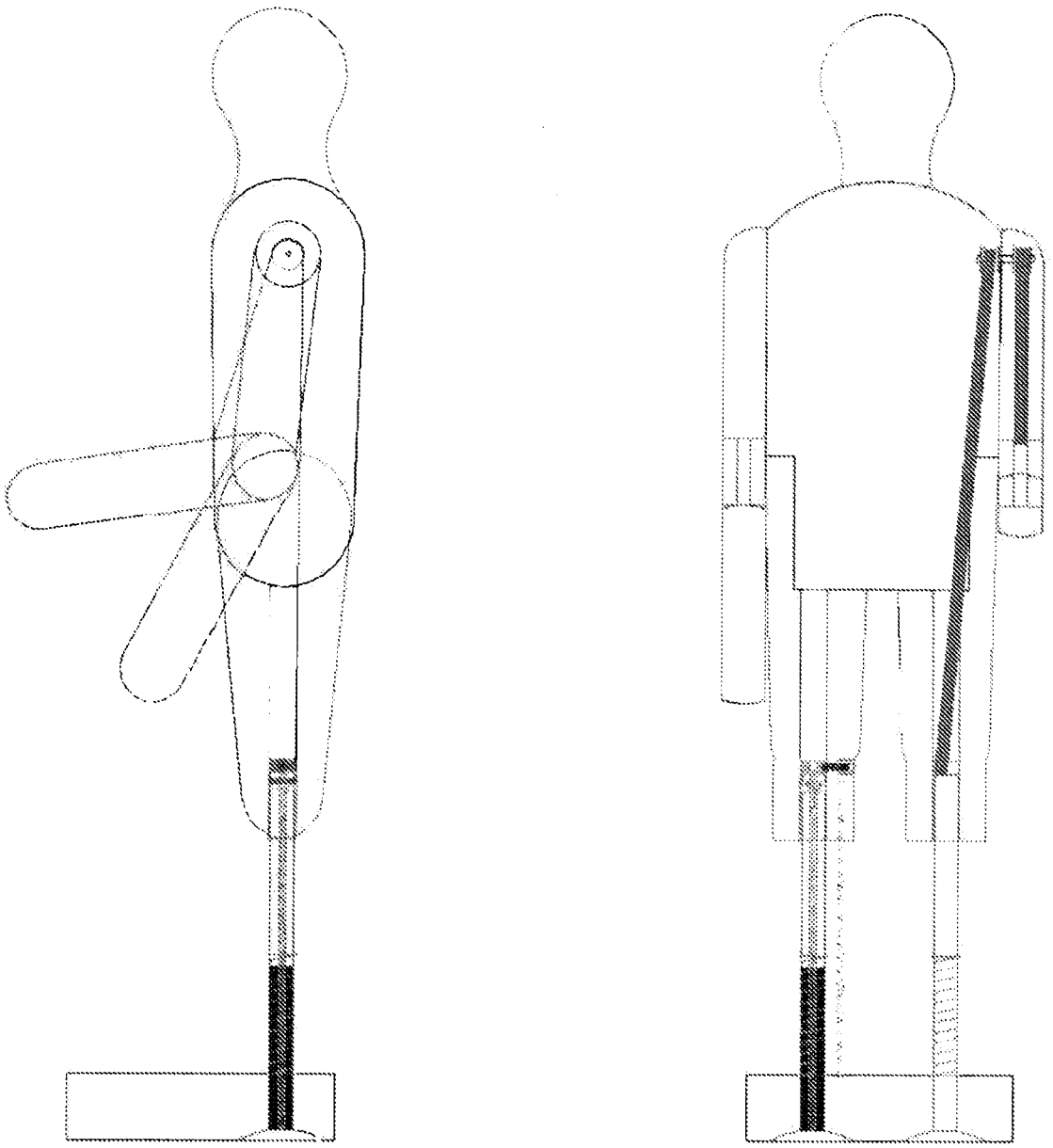
Figure 93: Side and front cross-sectional view of a raised screw driven mannequin target system

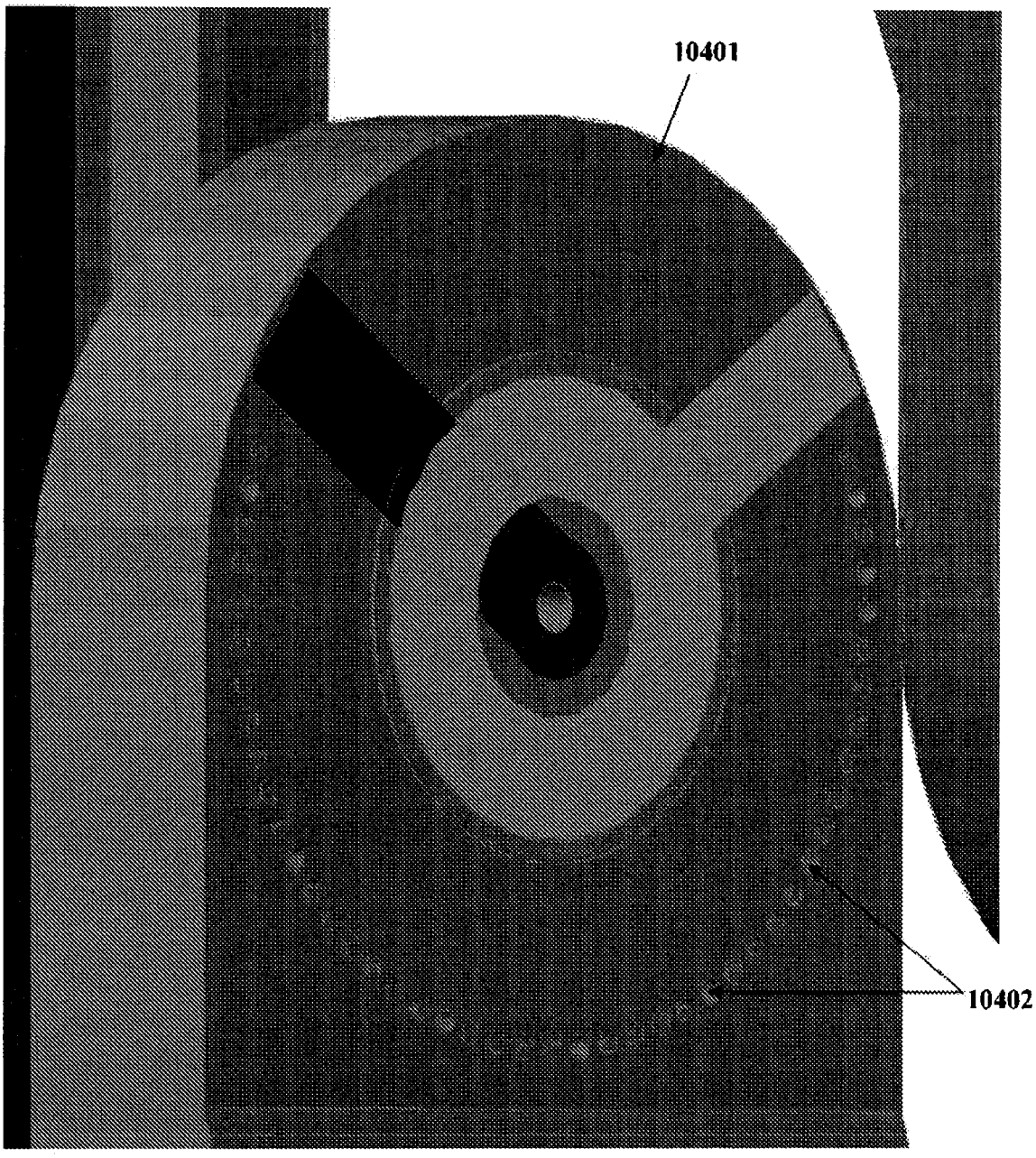
Figure 104: Cross-sectional close up view of a mannequin arm interconnection system